US007002112B2

(12) United States Patent
Kishi et al.

(10) Patent No.: US 7,002,112 B2
(45) Date of Patent: Feb. 21, 2006

(54) HEATING APPARATUS FOR INCREASING TEMPERATURE IN SHORT PERIOD OF TIME WITH MINIMUM OVERSHOOT

(75) Inventors: Kazuhito Kishi, Kanagawa (JP); Eriko Konno, Iwate (JP)

(73) Assignee: Ricoh Company, Ltd., Tokyo (JP)

( * ) Notice: Subject to any disclaimer, the term of this patent is extended or adjusted under 35 U.S.C. 154(b) by 63 days.

(21) Appl. No.: 10/477,209

(22) PCT Filed: Jan. 6, 2003

(86) PCT No.: PCT/JP03/00015

§ 371 (c)(1),
(2), (4) Date: Nov. 18, 2003

(87) PCT Pub. No.: WO03/067930

PCT Pub. Date: Aug. 14, 2003

(65) Prior Publication Data

US 2004/0149740 A1 Aug. 5, 2004

(30) Foreign Application Priority Data

Feb. 4, 2002 (JP) ..... 2002-026815
May 30, 2002 (JP) ..... 2002-157717

(51) Int. Cl.
*H05B 3/02* (2006.01)

(52) U.S. Cl. ..... 219/482; 219/216; 219/497; 219/499; 219/511

(58) Field of Classification Search ..... 219/618–619, 219/660–667, 469–472, 482–483, 488, 490, 219/494, 509, 510–511; 399/33, 69, 81, 399/82, 89, 302

See application file for complete search history.

(56) References Cited

U.S. PATENT DOCUMENTS

| | | | | |
|---|---|---|---|---|
| 4,692,684 | A * | 9/1987 | Schaeffer | 219/202 |
| 4,959,687 | A * | 9/1990 | Katoh et al. | 399/138 |
| 5,568,231 | A * | 10/1996 | Asano et al. | 399/175 |
| 6,542,705 | B1 * | 4/2003 | Fujita et al. | 399/69 |
| 6,847,792 | B1 * | 1/2005 | Nakafuji et al. | 399/69 |

FOREIGN PATENT DOCUMENTS

| | | |
|---|---|---|
| EP | 1035637 | 9/2000 |
| JP | 4-78852 | 3/1992 |
| JP | 4-294086 | 10/1992 |
| JP | 5-232839 | 9/1993 |
| JP | 10-10913 | 1/1998 |
| JP | 10-228208 | 8/1998 |
| JP | 10-282821 | 10/1998 |
| JP | 11-133776 | 5/1999 |
| JP | 2000-75737 | 3/2000 |
| JP | 2000-98799 | 4/2000 |
| JP | 2000-315567 | 11/2000 |
| JP | 2001-83581 | 3/2001 |
| JP | 2001-92281 | 4/2001 |
| JP | 2002-184554 | 6/2002 |

* cited by examiner

*Primary Examiner*—Tu Hoang
(74) *Attorney, Agent, or Firm*—Oblon, Spivak, McClelland, Maier & Neustadt, P.C.

(57) ABSTRACT

A heating apparatus includes a heating roller that is heated by heating units, a main power supply that supplies power from an external power supply to the main heating unitl, and an auxiliary power supply that supplies power to the auxiliary heating unit. The auxiliary power supply further includes a mass capacitor of multiple capacitor cells, which are charged by the external power supply. The connection mode of the capacitor cells is changed at least at the time of electric discharge.

30 Claims, 34 Drawing Sheets

FIG.20

| HUMAN BODY REACTION TO ELECTRIC CURRENT (EXPERIMENTAL VALUE) | | | | | | |
|---|---|---|---|---|---|---|
| EFFECT OF ELECTRIC SHOCK | DC | | AC | | | |
| | | | 60Hz | | 10000Hz | |
| | MALE | FEMALE | MALE | FEMALE | MALE | FEMALE |
| | mA | mA | mA | mA | mA | mA |
| FIRST PERCEPTION WITH A LITTLE BITE | 5.2 | 3.5 | 1.1 | 0.7 | 12 | 8 |
| SHOCK WITHOUT PAIN, MUSCLES ARE FREE | 9 | 6 | 1.8 | 1.2 | 17 | 11 |
| SHOCK WITH PAIN, MUSCLES ARE FREE | 62 | 41 | 9 | 6 | 55 | 37 |
| SHOCK WITH PAIN, LIMIT OF FREE MOVEMENT | 74 | 50 | 16 | 10.5 | 75 | 50 |
| HEAVY SHOCK WITH PAIN, STIFF MUSCLE AND DIFFICULTY IN BREATHING | – | – | 23 | 15 | 94 | 63 |
| RISK OF VENTRICULAR FIBRILLATION, APPLICATION FOR 0.03 SECONDS | 1300 | 1300 | 1000 | 1000 | 1100 | 1100 |
| RISK OF VENTRICULAR FIBRILLATION, APPLICATION FOR 3.00 SECONDS | 500 | 500 | 100 | 100 | 500 | 500 |
| VENTRICULAR FIBRILLATION | 2.75 TIMES OF RESPECTIVE VALUES ABOVE | | | | | |

HEATING APPARATUS FOR INCREASING TEMPERATURE IN SHORT PERIOD OF TIME WITH MINIMUM OVERSHOOT

BACKGROUND OF THE INVENTION

1. Field of the Invention

The present invention relates to heating apparatuses for heating various targets, such as paper and a film; fixing apparatuses; image forming apparatuses, such as a copying apparatus, a printer, and a facsimile apparatus.

2. Description of the Related Art

Image forming apparatuses, such as a copying apparatus, a printer, and a facsimile apparatus, include a process for forming an image on a heating target, such as a sheet of regular paper and OHP paper. In such image forming apparatuses, although various image formation methods are employed, an electro-photographic method is widely adopted from viewpoints of speed, image quality, cost, and so on.

In the electro-photographic method, a toner image that is to be fixed is formed on the heating target, such as a sheet of regular paper and OHP paper, and a fixing process fixes the toner image on the heating target by heat and pressure applied by a fixing apparatus. As the fixing apparatus, a heat roller is widely adopted for rapidity and safety.

The fixing apparatus adopting the heat roller includes a nip part that is constituted by a heating roller heated by a heating unit, such as a halogen heater, and a pressurization roller that counters the heating roller. The heating target is passed between the heating roller and the pressurization roller such that the toner image on the heating target is fixed by heat and pressure. The nip part carries out pressure welding.

When fluoride system resin as a release agent layer covers the metal core of the heating roller of the fixing apparatus of the heat roller method, since the fluoride system resin is hard, a problem of image quality arises as follows. The toner image on the heating target has microscopic unevenness. If the surface of the heating roller is hard, the surface cannot follow the unevenness, and microscopic compliance with the uneven surface of the heating roller becomes low. For this reason, the toner image after being fixed to the heating target contains uneven gloss between a portion where the heating roller makes contact, and a portion where the heating roller does not make contact.

In conventional monochrome copying apparatuses, since required quality of an image is not so high as compared with full color copying apparatuses, the heating roller including the core metal covered with fluoride system resin is acceptable. However, as the speed of the apparatuses is raised, and a monochrome copying apparatus is used for printing, requirements for high-definition production are becoming high.

On the other hand, requirements for producing high-definition images are higher for full color copying apparatuses than for the monochrome copying apparatuses. A high quality fixed image without uneven gloss is obtained by providing close contact between the surface of the heating roller and a toner layer on the heating target, which is realized by covering the core metal of the heating roller with an elastic layer (heat-resistant rubber), the elasticity of the rubber of a heating roller providing the close contact. This technology has been applied to monochrome copying apparatuses.

However, the metal core of the heating roller is made of a metal, such as iron and aluminum, having a high heat capacity. For this reason, the heat roller method has a shortcoming in that it takes a long starting time of several minutes, sometimes longer than ten minutes, for the temperature of the heating roller to rise to about 180 degrees C.

To cope with this problem of the image forming apparatus, power is continuously supplied to the heating roller, even if a user does not use the image forming apparatus, i.e., during standby, such that the temperature of the heating roller is maintained at a preheating temperature, which is set at a little lower than the operational temperature, so that the temperature can be quickly raised to the operational temperature when the heating roller is used. While this solution shortens the waiting time of the user, excessive energy is wasted during the standby period. In addition, an investigation report says that the consumption of energy during the standby period often ranges about 70 to 80 percent of the consumption energy of the image forming apparatus in operation.

Recently and continuing, energy-saving regulations are enacted from the rise of environmental protection consciousness in countries worldwide. In Japan, the Law concerning the Rational Use of Energy is being revised and strengthened, and in the U.S., energy-saving programs, such as energy star and ZESM (Zero Energy Star Mode), are being enacted. In order to meet these regulations and programs, it is desirable to suspend the power supply to the heating roller while the image forming apparatus is in the standby mode. Given that the power consumption during the standby mode is considerably high, such suspension will greatly contribute to power-saving.

However, if the power is not supplied to the heating roller during the standby mode in the case of the conventional fixing apparatus, it takes the long time for the temperature of the heating roller to rise at the time of reuse, and the long waiting time reduces user-friendliness. For this reason, an energy-saving type image forming apparatus wherein the temperature of the heating roller quickly rises is desired. For example, ZESM requires a re-starting time of 10 seconds or less.

In order to shorten the temperature rising (heating) time of the heating roller, it is effective to lower the heat capacity of the whole fixing apparatus including the pressurization roller. Japanese Provisional Patent No. H11-133776 discloses a fixing apparatus that realizes high-definition image production, improvement in speed, energy saving, and long service life by preparing a fixing roller containing an elastic layer, a pressurization belt constituting a nip part, and a pressurization unit arranged inside the pressurization belt, wherein a heating target is passed between the fixing roller and the pressurization belt.

Further, Japanese Patent No. 2001-92281 discloses a fixing apparatus that fixes a toner image on a transfer medium by heating and pressurization, providing high definition, energy saving, and a long service life, which includes:

- a film-like rotational unit that is prepared enclosing a fixed heating element, and
- a rotational unit having a roll-like structure for heat ray fixing, which further includes a heat ray irradiation unit for emitting heat rays installed countering the film-like rotational unit, a transparent cylindrical unit that transmits the heat rays, a transparent elastic layer prepared outside of the transparent cylindrical unit, and a heat ray absorption layer for absorbing the heat rays prepared outside of the transparent elastic layer.

The temperature rising time of the heating roller can be shortened by increasing injection energy per unit time, i.e., rated power, provided to the heating element that heats the heating roller. In fact, high-speed image forming apparatuses using a power supply voltage of 200 V are available, wherein the temperature rising time of the heating roller is shortened. However, in Japan, generally available commercial power supply is at 100 V 15 A, and a 200 V power supply is available only after a special installation. Thus, expecting a voltage higher than 100 V is not realistic.

Further, image forming apparatuses that raise the total power injected to the heating element of the fixing apparatus, using two systems of the commercial power supply of 100 V 15 A are also available. However, availability of two separate power line systems is not common.

Furthermore, when the supply power to the heating element of the fixing apparatus is simply increased, safety precautions become more important. The temperature of the heating roller rises quickly as a result of supplying high power to the heating element. When a system hangs up, and control of the supply power to the heating element becomes impossible, the probability of ignition becomes considerably high. If the temperature rise of the heating roller is too quick, the temperature of the heating roller may exceed the ignition temperature of paper before safeguards, such as a temperature fuse and a thermostat, operate.

As mentioned above, conventionally, there is a limit to the amount of the injection energy for raising the temperature of the heating roller in a short time.

In order to realize energy savings when increasing the maximum power supplied to the heating element, using an auxiliary power supply for supplying power to the heating element is proposed, wherein a rechargeable battery is used as the auxiliary power supply. As the rechargeable battery, a lead storage battery, a NiCd battery, etc., are typical ones.

However, since it takes several hours to fully charge the rechargeable battery, the problem is that it cannot be used repeatedly in a day. Further, the rechargeable battery is deteriorated through repeated recharging, the capacity being decreased, and has the nature that the greater is the discharge current, the shorter the service life becomes. In the case of a NiCd battery, which is generally considered to have a long service life and being capable of providing a large current, the number of times of recharging is about 500–1000. If recharging is performed 20 times a day, the service life is about a month. Accordingly, time and effort for battery replacement are required, and operating costs, such as battery costs, become high. Further, since it takes a long time to charge the rechargeable battery, recharging is often performed at night, with the rechargeable battery being taken out of the apparatus. Further, the rechargeable battery is capable of discharging little by little, but it has difficulty providing high power for a short duration. Further, if charging is continued without discharging, gas is generated, causing a failure and being unsafe. Furthermore, the lead storage battery uses liquid sulfuric acid, which is not desirable for use in an office apparatus. Due to the shortcomings as described above, it is practically difficult to employ a rechargeable battery for supplying power to the heating element.

In order to solve the shortcomings of the rechargeable battery, proposals have been made that a mass capacitor, such as an electric double layer capacitor, be used by the fixing apparatus, as an auxiliary power supply. In the case of the mass capacitor, the number of times of recharging is almost unlimited, with almost no degradation of charging characteristics, dispensing with periodic maintenance. Further, the mass capacitor can be charged in a short period of time, such as from several seconds to dozens of seconds, which compares favorably with the rechargeable battery requiring several hours of charging time. Further, the electric double layer capacitor is capable of supplying a large current, such as dozens of amperes to hundreds of amperes, which enables power supply in a short time. Further, the mass capacitor does not generate gas and the like, and is safe even when charging is continued. Furthermore, since stored energy of the electric double layer capacitor automatically declines as electric discharge is carried out for a predetermined time, voltage falls, and power supplied is reduced, which provides high safety.

As described above, if a capacitor is used as the auxiliary power supply, power greater than the power that the commercial power supply can provide becomes available to the fixing apparatus during a short time of several seconds to dozens of seconds when the fixing apparatus is heated. Further, since the mass capacitor uses up the stored energy in a short period of time, the power available is reduced after the predetermined time from the start of the electric discharge, realizing a safe configuration of the heating roller, which is not excessively heated. In this manner, a fixing apparatus featuring a short starting time, reliability, durability, and high safety is realized.

Japanese Provisional Patent No. H5-232839 discloses a heating apparatus wherein an auxiliary power supply provides power to a second heating element, rather than increasing the power to a first heater for heating the fixing roller.

Japanese Provisional Patent No. H10-10913 discloses an energy-saving type fixing apparatus that employs an auxiliary power supply. With this fixing apparatus, the rechargeable battery serving as the auxiliary power supply is provided in order to obtain two levels of power from a single power supply. It does not aim at supplying power greater than the power available from only the main power supply.

Japanese Provisional Patent No. H10-282821 discloses an image forming apparatus that uses an auxiliary power supply, such as a rechargeable battery and a primary battery, in addition to the main power supply for providing various functions.

Japanese Provisional Patent No. 2000-315567 discloses a heating apparatus using a mass capacitor in addition to the main power supply as an auxiliary power supply. According to this heating apparatus, the auxiliary power supply assists the commercial power supply at the time of starting; thereby heating time is shortened, saving energy.

Japanese Provisional Patent No. 2000-075737 discloses an image forming apparatus equipped with a power supply based on the commercial power supply and a storage battery, including storage battery checking means for determining presence of the storage battery, and charge capacity surveillance means for supervising charging capacity of the storage battery, wherein productivity is reduced during the charging of the storage battery based on determinations of the storage battery checking means and the charge capacity surveillance means.

Further, according to Japanese Provisional Patent No. 2000-075737, charging a storage battery is carried out externally and during night hours, for charging the storage battery takes a long time.

As a fixing system that realizes the temperature rise of the image forming apparatus in a short period of time, there is a configuration such that a heat-resistant resin film is wound around the circumference of a plate-like ceramic heater. Since the heat capacity of the ceramic heater is made small in this manner, the starting time is shortened. The configuration is put in practical use with low speed image forming apparatuses that deliver 30 sheets a minutes or less.

However, when the configuration is to be applied to a high-speed image forming apparatus, the heat-resistant resin film (the film) has to be thick such that the film is prevented from breaking. Since thermal conductivity of the resin is less than metal, the temperature of the film has to be raised before the film is fed into the nip part, otherwise the heat cannot be transmitted to the heating target in the nip part. For this reason, the area of the plate-like part of the heater becomes large, and high power is required to quickly raise the temperature.

(Objective of the Invention)

With a fixing apparatus and a heating apparatus using the mass capacitor mentioned above as an auxiliary power supply, the following problems are now clear.

In order to shorten the starting time, while reducing the heat capacity of the fixing roller (heating roller), it is necessary to provide high power to the fixing roller. Then, in order to obtain high power from the auxiliary power supply, a high voltage is more desirable than a large current in view of the load of wiring and a circuit.

However, in a case that an auxiliary power supply employing a mass capacitor is used, and the fixing roller temperature is controlled by turning on/off the power supply, high power is supplied to the heater, which causes sharp changes of the temperature of the fixing roller, as shown by FIG. 4. Accordingly, when the temperature of the fixing roller changes in the middle of fixing an image on the heating target, unevenness of image quality develops, and the image quality is degraded.

As mentioned above, a heating roller, having a core metal covered by an elastic layer (heat-resistant rubber) is available, which prevents gloss unevenness from occurring, and provides a high quality image. However, the elastic layer has poor thermal conductivity, and as many sheets are processed, the surface temperature of the heating roller tends to fall, causing poor fixing. In order to avoid this poor fixing, some image forming apparatuses secure fixing quality by reducing process speed, when the surface temperature of the heating roller becomes lower than a predetermined temperature. Thus, the poor thermal conductivity of the elastic layer of the heating roller works against the speed.

Further, in order to use up the energy that the mass capacitor holds at the starting time that lasts several seconds to dozens of seconds, a configuration that takes out high power from the mass capacitor is required. Since the power=voltage×current, high power can be obtained from the mass capacitor by making output voltage of the mass capacitor high, and increasing the output current of the mass capacitor.

However, the maximum current of a halogen heater that is usually used for heating of the heating roller is about 10 A through 12 A, and it is difficult to increase the maximum current. This is because the life of the halogen heater becomes short if a large current is supplied to the halogen heater. Therefore, in order to supply high power to the halogen heater, the voltage needs to be raised.

However, the mass capacitor has an inherent characteristic in that the voltage per one capacitor cell is as low as about several volts, a little more than 1 V in the case of a hydro-system, and a little less than 3 V in the case of an organic system. The low voltage is for preventing an electrolytic solution from forming inside the capacitor cell of the mass capacitor. For this reason, when the halogen heater conventionally used is to generate heat for heating, dozens of the mass capacitor cells are connected in series to make a power supply unit capable of supplying about 50 V through 100 V to the halogen heater.

Installing the power supply unit of a high voltage in the apparatus, however, poses the following problems. Although an access to the inside of the apparatus is in many cases performed by a maintenance person, a power supply terminal may be inadvertently touched during maintenance work, and an electric shock accident may occur. Further, it is conceivable that a general office worker accesses inside the apparatus for removing a jammed sheet of paper, and the like. For this reason, a preventive measure against an electric shock is required.

Further, as the storage capacity of a capacitor cell of the mass capacitor is becoming large, the number of the capacitor cells to be connected in series for obtaining the high voltage and high power is decreasing, and the fewer number of capacitor cells are capable of raising the temperature of the heating target. However, in order to obtain the high voltage using the mass capacitor, it is necessary to increase the number of the capacitor cells, and in other words, an excess capacity of the capacitor cells has to be provided as the configuration of the power supply unit. At present, since the energy density of the mass capacitor is still low, the size is large, and the cost is still high, it is essential to reduce the number of capacitor cells.

That is, where a halogen heater is employed as the heating element, in order to raise the supply voltage to the halogen heater, capacitor cells capable of providing excess energy are needed, and the power supply for supplying power to the halogen heater becomes large in size and high in cost.

Further, another important objective is related to preventing an overshoot of the temperature. At present, a thermistor is used for detecting the temperature of the fixing roller. Although the size of the thermistor is quite small and reaction speed is improved, the temperature detecting speed of the thermistor is still low for the configuration where power supplied to the halogen heater is high, and the temperature rises quickly. Thus, the overshoot of the temperature is another problem to be solved.

BRIEF SUMMARY OF THE INVENTION

The present invention is made in order to solve the above-mentioned problems, aiming at providing a heating apparatus that is capable of heating with little temperature change, using as much stored energy of the capacitor as possible, quickly raising the temperature such that the starting time can be shortened, providing high-definition and high-speed, and improving separation characteristics of the heating unit from a toner image.

Another object of the present invention is to provide an image forming apparatus that can make a high quality output without unevenness of the image.

Another object of the present invention is to provide a fixing apparatus, the heating apparatus, and the image forming apparatus that are safe in view of an electric shock hazard by lowering the output voltage of the source of auxiliary power.

Another object of the present invention is to provide the heating apparatus, the fixing apparatus, and the image forming apparatus that allow the size of the auxiliary power supply to be small, an installation space to be small, and production costs to be low.

Another object of the present invention is to provide the heating apparatus, the fixing apparatus, and the image forming apparatus wherein the temperature overshoot is reduced.

(Means of Solving the Problems)

In order to attain the above-mentioned objects, the heating apparatus according to a feature of the present invention includes a heating unit, the temperature of which is raised by heat generated by a heating unit, a main power supply that uses the commercial power supply and supplies power to the heating unit, and a mass capacitor, used as an auxiliary power supply, which further includes a plurality of capacitor cells for supplying power to the heating unit, which capacitor cells are charged by the commercial power supply, wherein the number of the cells to be connected is variable at least at the time of electric discharge.

The heating apparatus according to another feature of the present invention includes a main heating unit that generates heat by power supplied from the main power supply that is capable of supplying steady power, an auxiliary power supply that can be charged, an auxiliary heating unit that generates heat by power supplied from the auxiliary power supply, and a heating target that is heated by the main heating unit and the auxiliary heating unit, wherein the output voltage of the auxiliary power supply is reduced according to predetermined directions.

The heating apparatus according to another feature of the present invention includes a heating unit that generates heat by power supplied, power supply means for supplying power to the heating unit, the power supply means including at least an auxiliary power supply that can be charged, and a step-up means for stepping-up the output voltage of the auxiliary power supply.

The heating apparatus according to another feature of the present invention includes the main heating unit that generates heat by steady power supplied from the main power supply, the auxiliary power supply that can be charged, the step-up means for stepping-up the output voltage of the auxiliary power supply, the auxiliary heating unit heated by power supplied from the step-up means, and the heating target heated by the main heating unit and the auxiliary heating unit, wherein detection means is provided for detecting information about the auxiliary power supply, and the output voltage of the step-up means is controlled based on the information detected by the detection means.

The fixing apparatus according to another feature of the present invention includes one of the heating apparatuses described above as fixing means for fixing yet-to-be-fixed material on the heating target.

The image forming apparatus according to another feature of the present invention includes image formation means for forming an image on a recording medium, and image heating means for heating the image on the recording medium, wherein the image heating means employs one of the heating apparatuses described above.

The image forming apparatus according to another feature of the present invention includes image formation means for forming a yet-to-be-fixed image on a recording medium, and fixing means for heating and fixing the yet-to-be-fixed image on the recording medium, wherein the fixing means employs one of the heating apparatuses descried above.

BRIEF EXPLANATION OF THE DRAWINGS

FIG. 20 is a table showing experimental values about an influence of an electric current to a human body according to "Electrician's Text" published by The Japan Electric Association.

PREFERRED EMBODIMENTS

Figure 7:
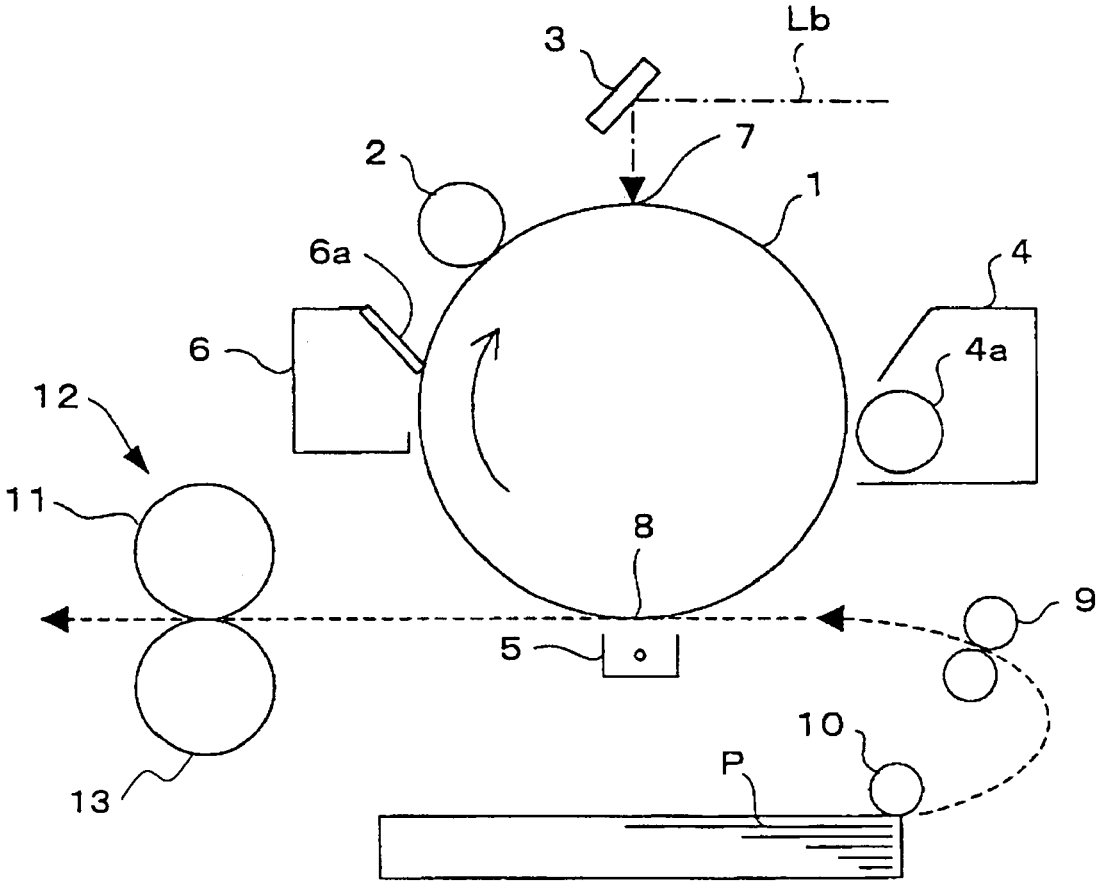
FIG. 7 is a schematic diagram showing the fixing apparatus according to Embodiment 1 of the present invention.

FIG. 7 shows an outline of Embodiment 1 of the present invention. Embodiment 1 is an embodiment of the image forming apparatus employing an electro-photographic system, including a fixing apparatus. A photo conductor 1 in the shape of a drum, for example, is used as an image holding body, which is rotationally driven by a driving unit that is not illustrated. Around the photo conductor 1, in the rotational direction shown by an arrow, one by one, an electrification apparatus 2 serving as electrification means, a mirror 3 serving as a part of exposure means, and a development apparatus 4 serving as development means, a transfer apparatus 5 serving as transfer means for transferring a toner image, yet-to-be-fixed, on the photo conductor 1 to a sheet-like heating target, i.e., a recording medium, such as transfer paper P (e.g. plain paper and OHP sheet), and a cleaning apparatus 6 serving as cleaning means, etc., are arranged.

The electrification apparatus 2 includes an electrification roller, and the development apparatus 4 includes a development roller 4*a*. The cleaning apparatus 6 includes a blade 6*a* that is in sliding contact with the cylindrical surface of the photo conductor 1.

The mirror 3 scans the photo conductor 1 by the exposure means with exposure light Lb between the electrification apparatus 2 and the development roller 4*a*, and the position where the exposure light Lb is irradiated on the photo conductor 1 is named exposure position 7. The transfer apparatus 5 opposes the surface of the photo conductor 1 at a position named transfer position 8.

A pair of resist rollers 9 is provided at an upstream position in the conveyance direction of the transfer paper P as viewed from the transfer position 8, and the transfer paper P is sent out by a feed roller 10 from a paper tray toward the resist roller pair 9. The transfer paper P is guided by a conveyance guide, which is not illustrated, and stops at the resist roller pair 9.

In a downstream position viewed from the transfer position 8 in the transfer paper conveyance direction, a fixing apparatus 12 serving as a heating apparatus that includes a heating roller 11 is arranged.

In this image forming apparatus, image formation is performed as follows. At the time of use, the photo conductor 1 starts rotating, the photo conductor 1 is uniformly charged by the electrification apparatus 2 in the dark during rotation of the photo conductor 1, and a static latent image corresponding to an image to be formed is formed by scanning the exposure light Lb being irradiated at the exposure position 7 on the photo conductor 1 through the mirror 3 by the exposure means. The static latent image on the photo conductor 1 moves to the location of the development apparatus 4 by rotation of the photo conductor 1, a visible image is formed by the development apparatus 4 by applying toner, and a toner image is formed.

On the other hand, the feed roller 10 starts feeding the transfer paper P from the paper tray, the transfer paper P passes along the conveyance course shown by a dashed line, and waits for a timing of sending at the position of the pair of resist rollers 9, such that the timing agrees with the toner image on the photo conductor 1 arriving at the transfer position 8. When the timing comes, the transfer paper P that is standing by at the position of the resist roller pair 9 is further transported to the transfer position 8 by the resist roller pair 9.

The toner image on the photo conductor 1 and the transfer paper P meet at the transfer position 8, and the toner image on the photo conductor 1 is transferred to the transfer paper P by an electric field generated by the transfer apparatus 5. Accordingly, the photo conductor 1, the electrification apparatus 2, the exposure means, the development means 4, and the transfer apparatus 5 constitute image formation means for forming the yet-to-be-fixed image that is a toner image on the transfer paper P. The transfer paper P holds the transferred toner image, and is conveyed toward the fixing apparatus 12. While passing the fixing apparatus 12, the toner image is fixed, and the transfer paper P is delivered to a delivery unit that is not illustrated.

Further, toner that remains on the photo conductor 1, without being transferred at the transfer position 8, is cleaned by the blade 6*a* when arriving at and passing the cleaning apparatus 6 with the rotation of the photo conductor 1, and the next image formation may start.

Figure 8:
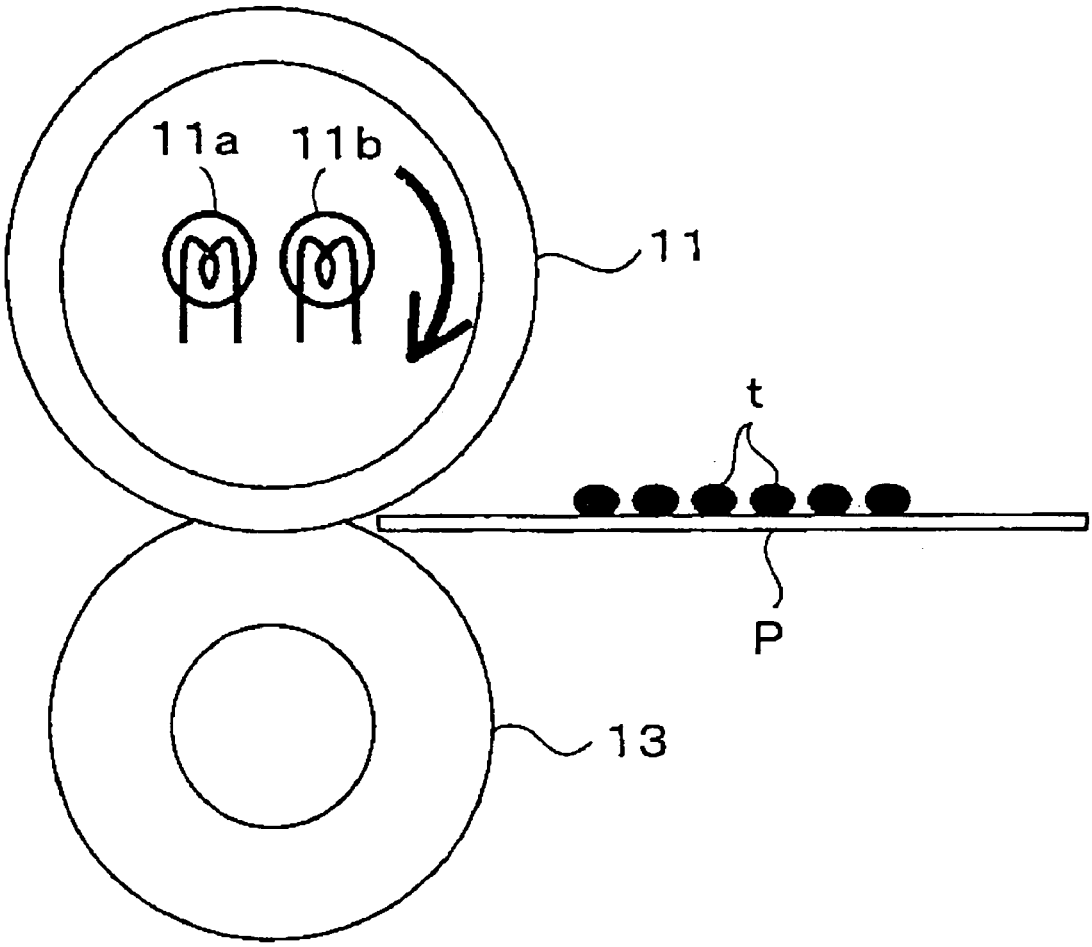
FIG. 8 is a cross-sectional view showing the detailed configuration of a fixing roller of the fixing apparatus according to Embodiment 1 of the present invention.

FIG. 8 shows a detailed configuration of the fixing apparatus 12. The fixing apparatus 12 includes the heating roller 11 as a heating unit, and a pressurization roller 13 as a pressurization unit that contacts the heating roller 11 with pressure. A driving unit that is not illustrated drives the heating roller 11 and the pressurization roller 13. The heating roller 11 is heated by heat generated by a main heating unit 11*a* and an auxiliary heating unit 11*b*. The heating units 11*a* and 11*b*, also collectively called a heating unit, typically employ halogen heaters. However, other heating material, such as a resistance heating element, may be used instead.

While the transfer paper P that holds toner image t passes the nipping part of the heating roller 11 and the pressurization roller 13, the toner image t is fixed by heating and pressurization by the heating roller 11 and the pressurization roller 13.

Figure 1:
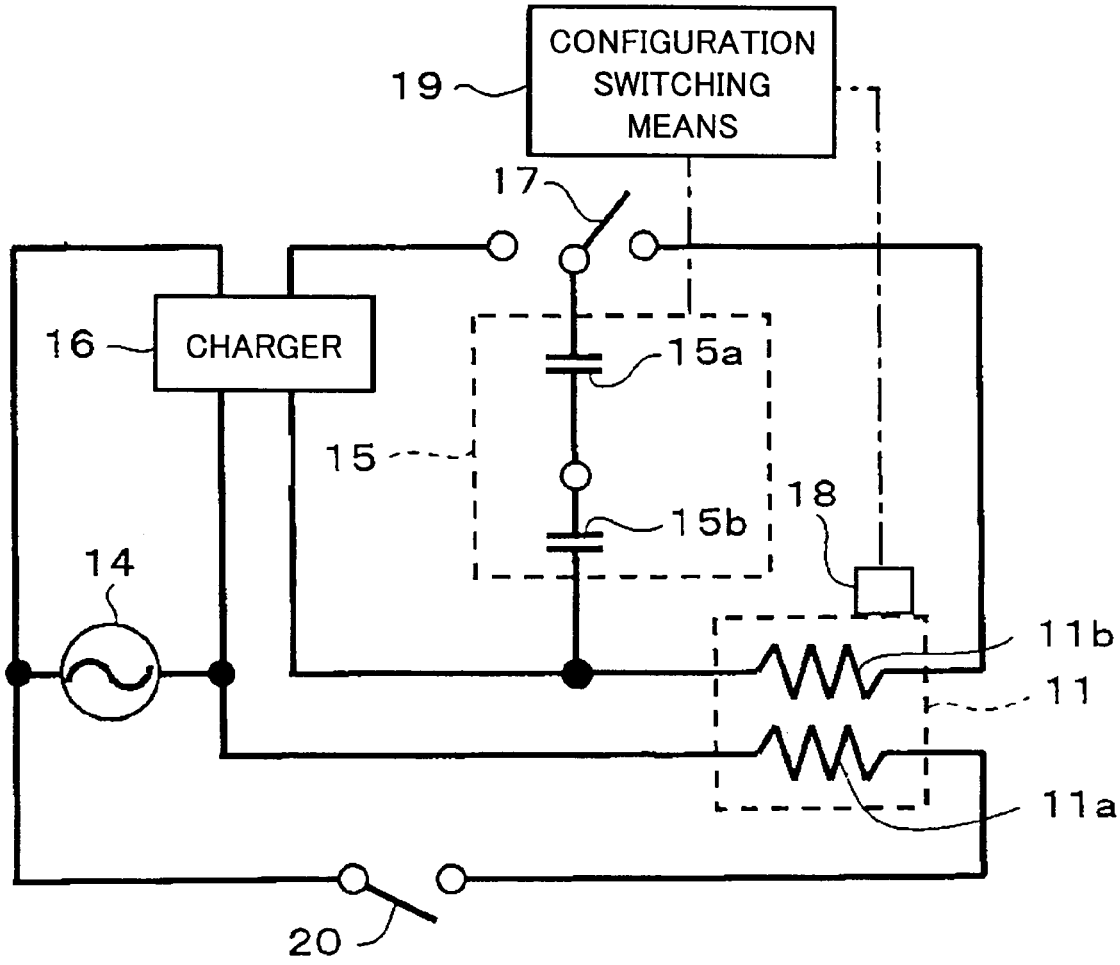
FIG. 1 is a schematic diagram of the circuit configuration of the fixing apparatus according to Embodiment 1 of the present invention, wherein capacitor cells are connected in series.
Figure 2:
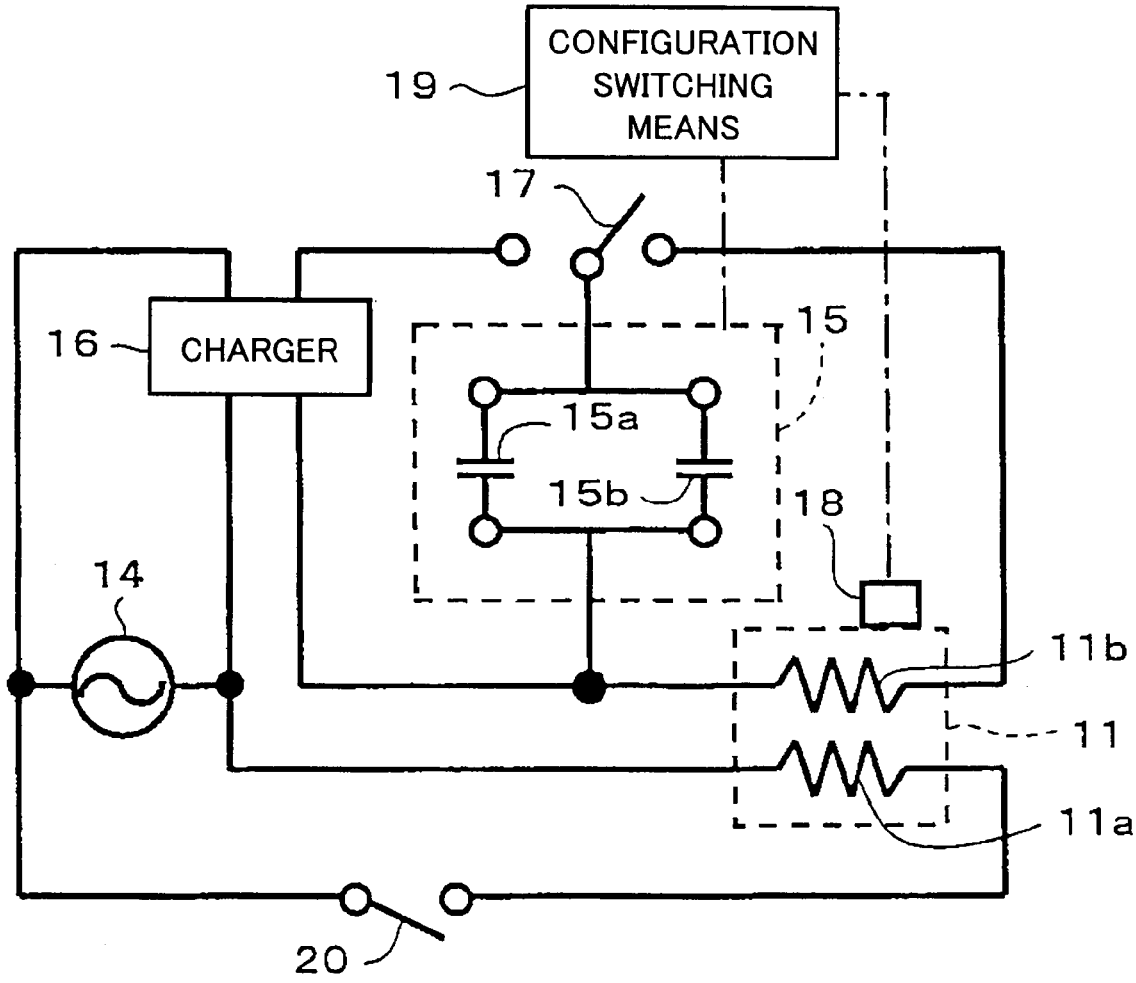
FIG. 2 is a schematic diagram of the circuit configuration of the fixing apparatus of Embodiment 1 of the present invention, wherein capacitor cells are connected in parallel.

FIGS. 1 and 2 show circuit configurations of the fixing apparatus 12 that include a main power supply 14, an auxiliary power supply 15, a charger 16, a switch 17 serving as charging/discharging switching means for switching between charging and discharging of the auxiliary power supply 15, a temperature sensor 18 serving as temperature detection means for detecting the temperature (surface temperature) of the heating roller 11, configuration switching means 19, and a power switch 20 for controlling power supply to the heating unit 11*a*. The heating roller 11 includes the heating units 11*a* and 11*b*. The heating unit 11*a* generates heat with power supplied from the main power supply 14 through the power switch 20, and heats the heating roller 11.

The main power supply 14 receives external power, typically commercial power, by connecting to a wall socket installed near the place where the image forming apparatus is installed, and outputs power, which may be one of voltage-adjusted alternate current and rectified DC, according to the heating roller 11. The auxiliary power supply 15 is capable of being charged and discharging, and employs an electric double layer capacitor that is a mass capacitor according to the embodiment. The mass capacitor, which does not utilize a chemical reaction as a rechargeable battery does, has the following outstanding features.

(1) Charge Time is Short.

Where a common nickel-cadmium battery is used as the rechargeable battery of the auxiliary power supply, it takes several hours for charging even if charging is performed under a rapid charge mode. For this reason, a large power supply for heating is available only several times a day, and every several hours, which is not practical. On the other hand, with the auxiliary power supply using the mass capacitor, since the rapid charge is completed in a short period of time, such as from dozens of seconds to several minutes, the number of times of heating using the auxiliary power supply can be increased to a practical number of times. Accordingly, when a mass capacitor is used as an auxiliary power supply according to the embodiment, compared with the case where a common nickel-cadmium battery is used as an auxiliary power supply, the number of times of heating of the fixing roller using the auxiliary power supply within the same given period of time increases.

(2) Service Life is Long.

The service life of a nickel-cadmium battery is short, such as the number of times of charging/discharging being 500 to 1000 times. For this reason, the service life is short for an auxiliary power supply for heating, and the time, effort and cost of replacements pose a problem. On the other hand, an auxiliary power supply using the mass capacitor can be charged/discharged for 10,000 times or more, almost an eternal service life, and also is subject to little degradation by repeated charging/discharging. Accordingly, the mass capacitor is advantageous especially for heating apparatuses and image forming apparatuses that repeatedly switch between a standby mode and an operation mode. Further, since the mass capacitor requires neither liquid exchange nor liquid supplement, which is required by a lead storage battery, maintenance is hardly needed.

(3) Safety is High.

A rechargeable battery, using a chemical reaction, has the risk of a container becoming pressurized by the gas produced by the chemical reaction, and exploding, when charging is continued after the rechargeable battery is fully charged while there is no electric discharge. On the other hand, since an auxiliary power supply using a mass capacitor is based not on a chemical reaction, but on a physical phenomenon, no gas is generated, and it is safe.

In recent years and continuing, capacitors that can store a great amount of electric energy are being developed to an extent that the capacitor is used by an electric car. For example, an electric double layer capacitor that NIPPON CHEMI-CON CORP. developed has a static capacity of about 2000 F, which capacity is sufficient for the power being supplied for several seconds, or dozens of seconds. Further, NEC's hyper-capacitor provides about 80 F, which is capable of supplying a current of about 10 A for dozens of seconds.

According to the embodiment, the power supply to the heating units 11*a* and 11*b* of the heating roller 11 is arranged such that power is supplied to the heating unit 11*a* from the main power supply 14 via the power switch 20, and power is supplied to the heating unit 11*b* from the auxiliary power supply 15 through the switch 17. Accordingly, the heating roller 11 is heated by the power supplied from both the main power supply 14 and the auxiliary power supply 15 for a predetermined short time that ranges from several seconds to about dozens of seconds, the combined power level exceeding the maximum power available from the main power supply 14 alone.

When the auxiliary power supply 15 including a capacitor is not fully charged, the switch 17 is switched to a point on the side of the charger 16 by control means that is not illustrated during a period of time when not much power is being consumed, such as during the standby mode. Then, the auxiliary power supply 15 is charged by direct-current power provided by the charger 16 through the switch 17, the direct-current power being transformed from alternating-current power supplied by the main power supply 14. When the heating roller 11 requires high power, such as at starting when the temperature of the heating roller 11 is required to rapidly rise from room temperature to operating temperature (temperature at which fixing can be performed), the control means turns the switch 17 to a point on the side of the heating unit 11*b* so that the auxiliary power supply 15 is connected to the heating unit 11*b* through the switch 17.

In this manner, when the heating roller 11 requires high power, the power from the main power supply 14 and the auxiliary power supply 15 are supplied to the heating units 11*a* and 11*b*, respectively, of the heating roller 11, and the temperature of the heating roller 11 is raised in a short period of time. Using a capacitor as the auxiliary power supply 15 provides an effect that is not available from a rechargeable battery.

The control means that is not illustrated turns on the power switch 20 when a detection signal from the temperature sensor 18 indicates that the surface temperature of the heating roller 11 is below a predetermined temperature at which fixing is to be performed; and turns off the power switch 20 when the surface temperature of the heating roller 11 is equal to or higher than the predetermined temperature at which fixing is to be performed such that the power supply to the heating unit 11*a* from the main power supply 14 is shut off for maintaining the surface temperature of the heating roller 11.

According to the embodiment of the present invention, the auxiliary power supply 15 includes at least two capacitor cells 15*a* and 15*b*, wherein modes of connection of the capacitor cells 15*a* and 15*b* are selectable at least when supplying power. Further, the configuration of the auxiliary power supply 15 that includes the capacitor cells 15*a* and 15*b* can be changed at least at the time of electric discharge. The configuration change means 19 changes the configuration so that the power supplied to the heating units 11*a* and 11*b* becomes low when the temperature of the heating roller 11 becomes high based on the detection signal from the temperature sensor 18.

For example, the configuration change means 19 connects the capacitor cells 15*a* and 15*b* in series, as shown by FIG. 1, when the temperature of the heating roller 11 is lower than the predetermined temperature, such as at the time of initial heating, so that the voltage applied to the heating unit 11*b* is high, making the power supplied to the heating unit 11*b* high.

Figure 4:
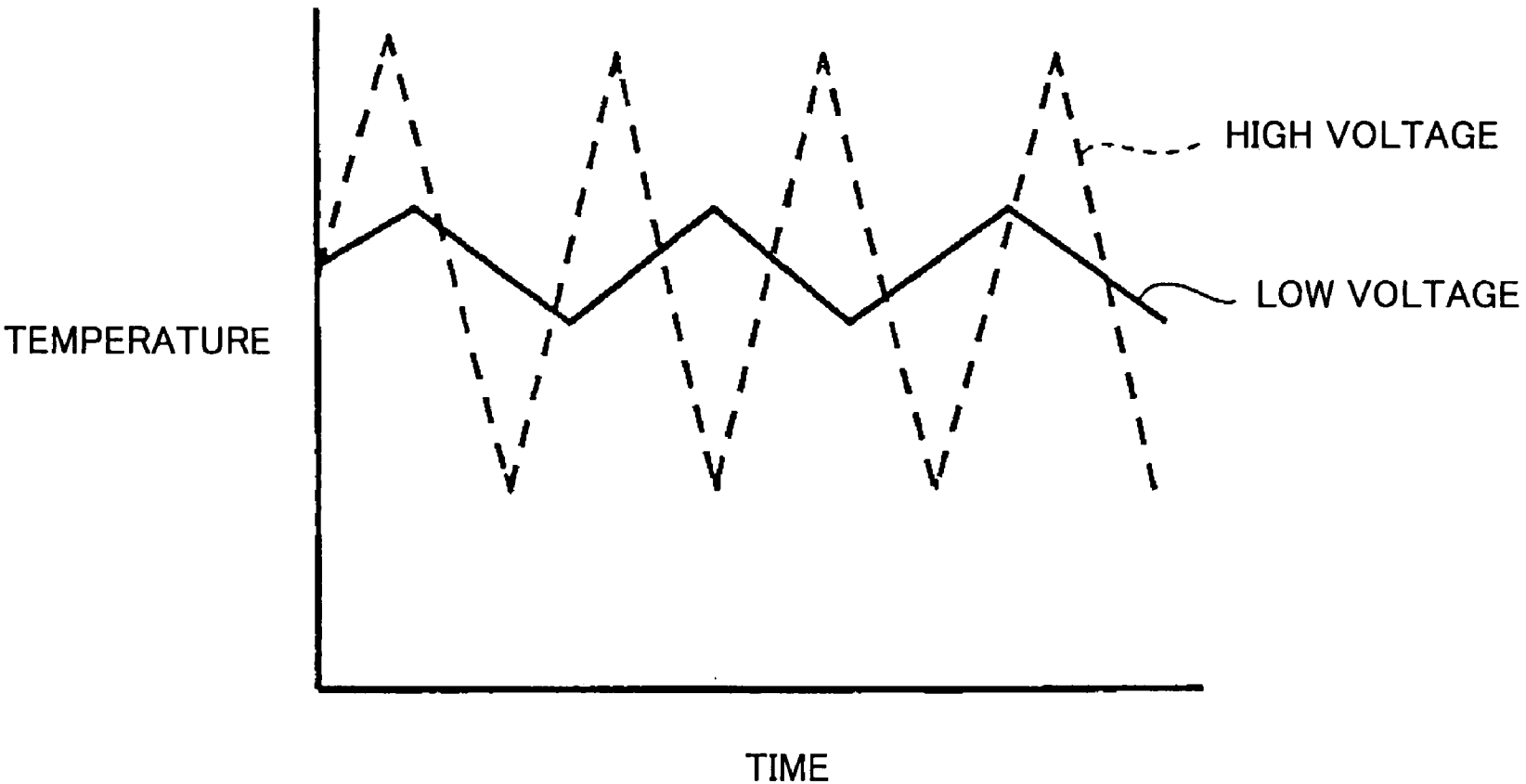
FIG. 4 is a graph showing temperature change of a fixing roller of the fixing apparatus, wherein a conventional capacitor is used as an auxiliary power supply according to Embodiment 1 of the present invention.

When the temperature of the heating roller 11 becomes equal to or greater than the predetermined temperature, the configuration change means 19 connects the capacitor cells 15*a* and 15*b* in parallel as shown by FIG. 2, so that the voltage applied to the heating unit 11*b* is lowered as shown by FIG. 4, and the power supplied to the heating unit 11*b* is lowered. In this manner, turning on and off the power supplied to the heating units 11*a* and 11*b* of the heating roller 11 from the main power supply 14 and the auxiliary power supply 15 makes the temperature change of the heating roller 11 less steep, and heating unevenness of the image formed on the transfer paper P becomes small, providing a high quality image.

Figure 3:
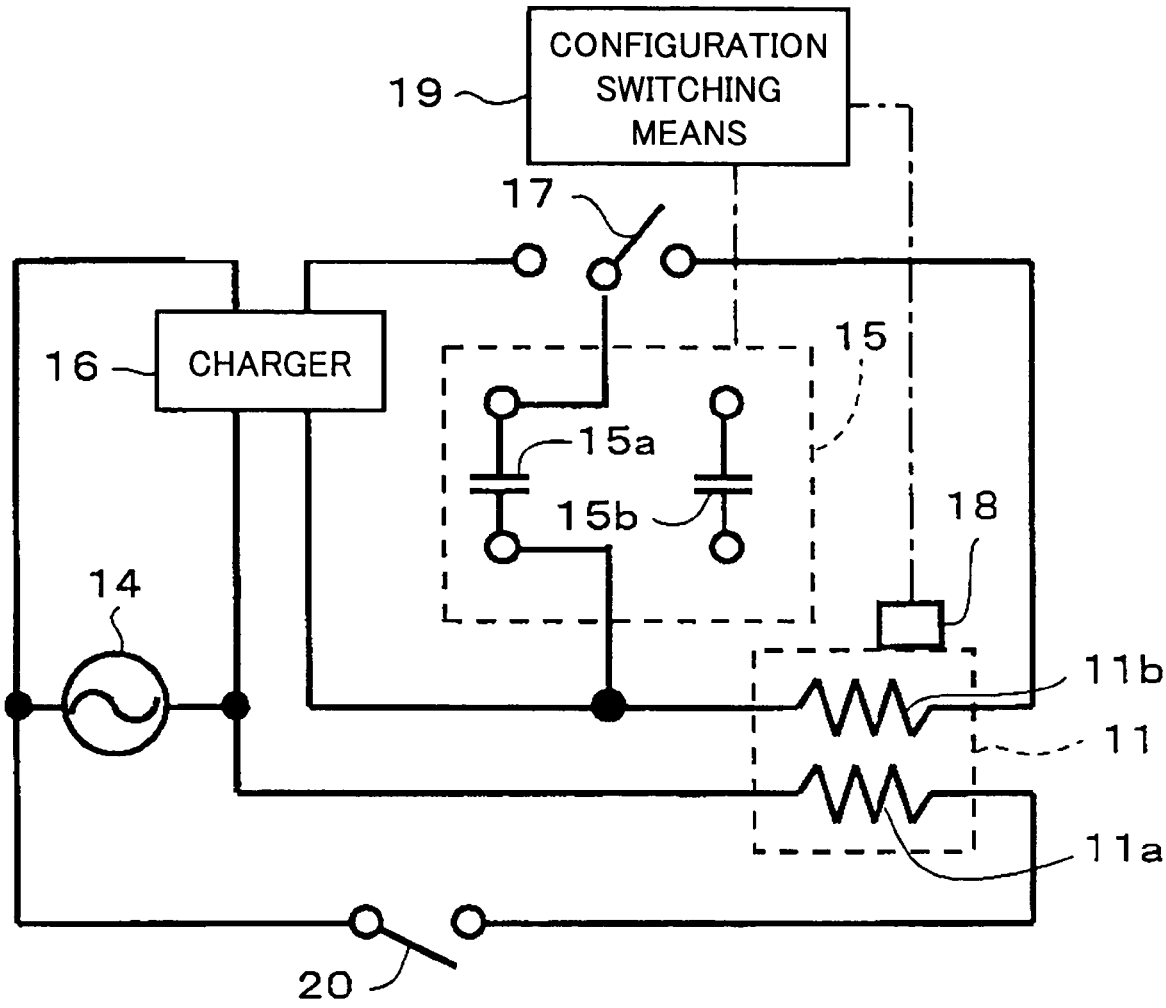
FIG. 3 is a schematic diagram for explaining Embodiment 1 of the present invention.

In addition, as to the connecting mode of the capacitor cells 15*a* and 15*b*, the capacitor cells 15*a* and 15*b* do not have to be connected in series as shown by FIG. 1, but only one capacitor cell, e.g., the capacitor cell 15*a*, may be connected to the heating unit 11*b* through the switch 17 as shown by FIG. 3. However, in FIG. 3, since the energy that is supplied to the heating unit 11*b* is only a part of the stored energy of the auxiliary power supply 15, and since the stored energy between the capacitor cell 15*a* and the capacitor cell 15*b* becomes unbalanced, which can be a cause for an imbalance at the time of charge, it is desirable that the capacitor cells 15*a* and 15*b* be connected in series for providing the power to the heating unit 11*b* as shown by FIG. 1.

According to Embodiment 1, the heating apparatus includes the heating roller 11 serving as a heating component, the temperature of which is raised by heat generated by the heating units 11*a* and 11*b*; the main power supply 14 for supplying power to the heating unit 11*a* based on an external power supply, such as a commercial power supply; and the auxiliary power supply 15, including the mass capacitor consisting of a plurality of capacitor cells, such as the capacitor cells 15*a* and 15*b*, which is charged by an external power supply for supplying power to the heating unit 11*b*. Therein, the connecting mode of the plurality of capacitor cells, such as the capacitor cells 15*a* and 15*b*, is made variable at least at the time of electric discharge. In this manner, temperature unevenness of the heating units can be reduced by supplying a lower power level to the heating unit 11*b*. That is, if high power is supplied by a high voltage when the temperature of the heating units is low, the temperature unevenness of the heating units becomes large; but, by supplying a lower power level to the heating unit 11*b* by a lower voltage, generating of temperature unevenness of the heating component 11 can be reduced and temperature change of the heating component 11 can be made small.

Further, according to Embodiment 1, the configuration is such that the plurality of capacitor cells, such as the capacitor cells 15*a* and 15*b*, can be connected in parallel and in series. In this manner, as much energy stored by the capacitor cells as possible can be used.

Further, according to Embodiment 1, the detection means (temperature sensor 18) is provided for detecting the situation of the apparatus concerned and changing connection mode of the plurality of capacitor cells, such as the capacitor cells 15*a* and 15*b*, using the detection information from the detection means. In this manner, the temperature change can be made small and the starting time for fixing can be shortened.

Further, according to Embodiment 1, the temperature sensor 18 serving as the temperature detection means for detecting the temperature of the heating component 11 is used as the detection means. In this manner, the temperature change can be made small and the starting time can be shortened.

Further, since according to Embodiment 1, when the plurality of capacitor cells, such as the capacitor cells 15*a* and 15*b*, are connected in parallel, and power is supplied to the heating component 11 from the capacitor cells, when the temperature of the heating component 11 is higher than the predetermined temperature, the temperature change of the heating component 11 can be made small.

Further, according to Embodiment 1, when the plurality of capacitor cells, such as the capacitor cells 15*a* and 15*b*, are connected in series and power is supplied to the heating component 11 from the capacitor cells, when the temperature of the heating component 11 is lower than the predetermined temperature, the temperature rise can be made quickly and the temperature change can be made small.

Figure 5:
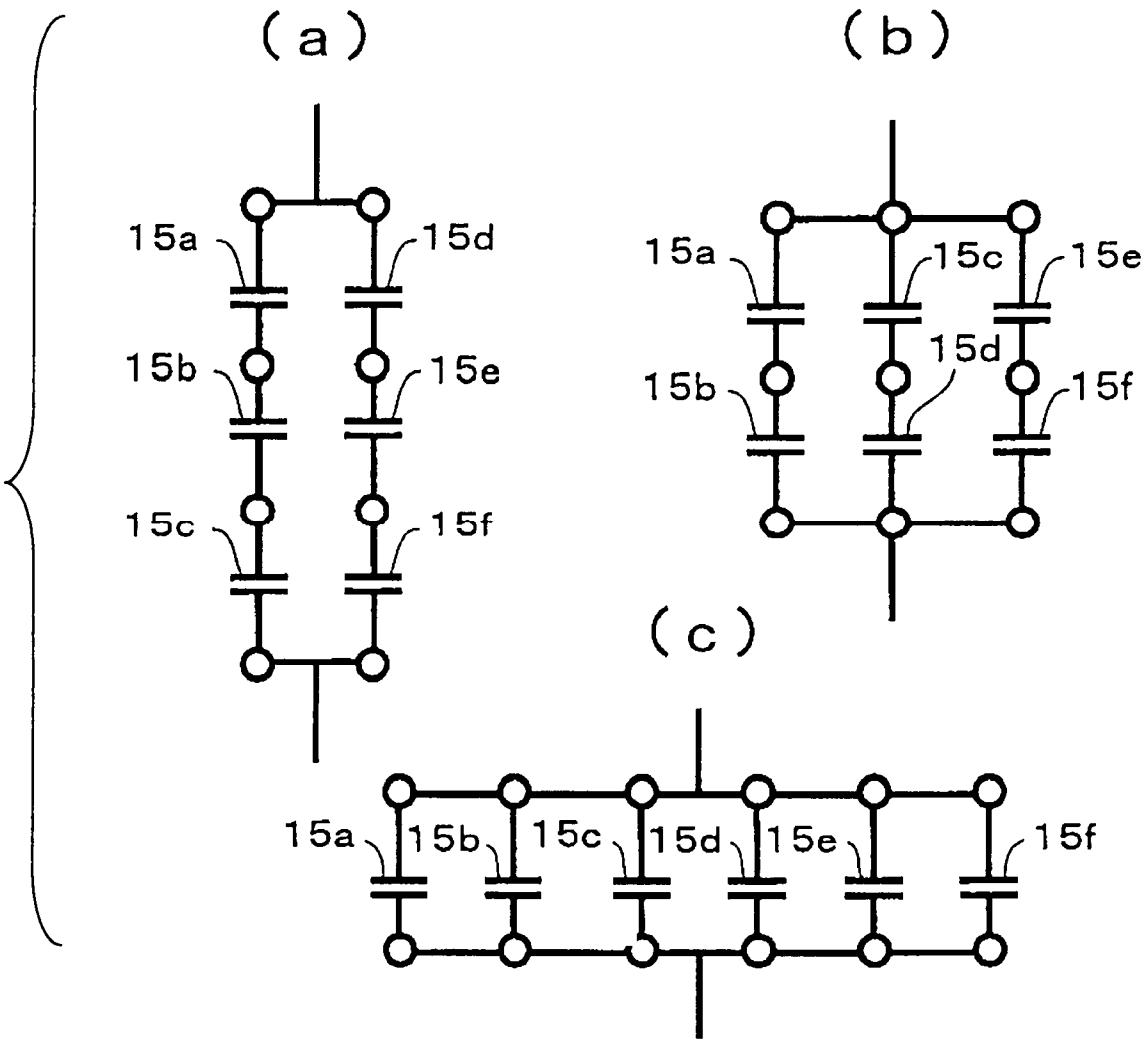
FIG. 5 is a schematic diagram showing connection variations of capacitor cells according to Embodiment 2 of the present invention.

FIG. 5 shows various connection modes of capacitor cells according to Embodiment 2 of the present invention. In Embodiment 2, the mass electric double layer capacitor of the auxiliary power supply 15, described with reference to Embodiment 1, includes a plurality of capacitor cells 15*a* through 15*f*. When the capacitor cells 15*a* through 15*c* connected in series, and the capacitor cells 15*d* through 15*f* connected in series are connected in parallel, as shown at (a) of FIG. 5, the output voltage of the auxiliary power supply 15 is 3 v, where v represents the voltage of each of the capacitor cells 15*a* through 15*f*.

In the case that is shown at (b) of FIG. 5, the capacitor cells 15*a* and 15*b* connected in series, the capacitor cells 15*c* and 15*d* connected in series, and the capacitor cells 15*e* and 15*f* connected in series are connected in parallel, wherein the output voltage of the auxiliary power supply 15 is 2 v. Further, in the case that is shown by at (c) of FIG. 5, each of the capacitor cells 15*a* through 15*f* is connected in parallel, wherein the output voltage of the auxiliary power supply 15 is 1 v.

The configuration change means 19 changes the connection mode of the capacitor cells 15*a* through 15*f* according to the temperature of the heating roller 11 based on the detection signal from the temperature sensor 18. The configuration change means 19 does not have to change the connecting mode using all the three modes, namely the modes marked by (a), (b) and (c) in FIG. 5. Rather, the mode change may be between the modes marked (a) and (b), for example, in FIG. 5.

As for the heating units 11*a* and 11*b*, there is a minimum heating voltage at which heat generating is stopped. For this reason, if the number of sequences of parallel connection and the number of in-series connections of the capacitor cells 15*a* through 15*f* are changed in a simple manner such as shown by FIG. 1 and FIG. 2, the heating units 11*a* and 11*b* may not generate sufficient heat at the time of low power supply. In this case, the configuration change means 19 changes the connection mode of the capacitor cells 15*a* through 15*f* to the mode marked by (a) of FIG. 5, and the mode marked by (b) of FIG. 5, based on a detection signal from the temperature sensor 18 according to the temperature of the heating roller 11 (i.e., whether the temperature of the heating roller 11 reaches the predetermined temperature). In other words, when the temperature of the heating roller 11 does not reach the predetermined temperature, the capacitor cells 15*a* through 15*f* are connected as shown by (a) of FIG. 5; and when the temperature of the heating roller 11 is higher than the predetermined temperature, the capacitor cells 15*a* through 15*f* are connected as shown by (b) FIG. 5. In this manner, slightly higher voltages of 2 v and 3 v (voltages providing a small temperature change) are applied to the heating unit 11*b*, and an image forming apparatus having the heating roller 11 that generates small unevenness of the temperature change is realized.

According to Embodiment 2, the temperature change of the heating component can be made small, since the number of sequences of parallel connections of two or more capacitor cells 15*a* through 15*f* is made variable.

Figure 6:
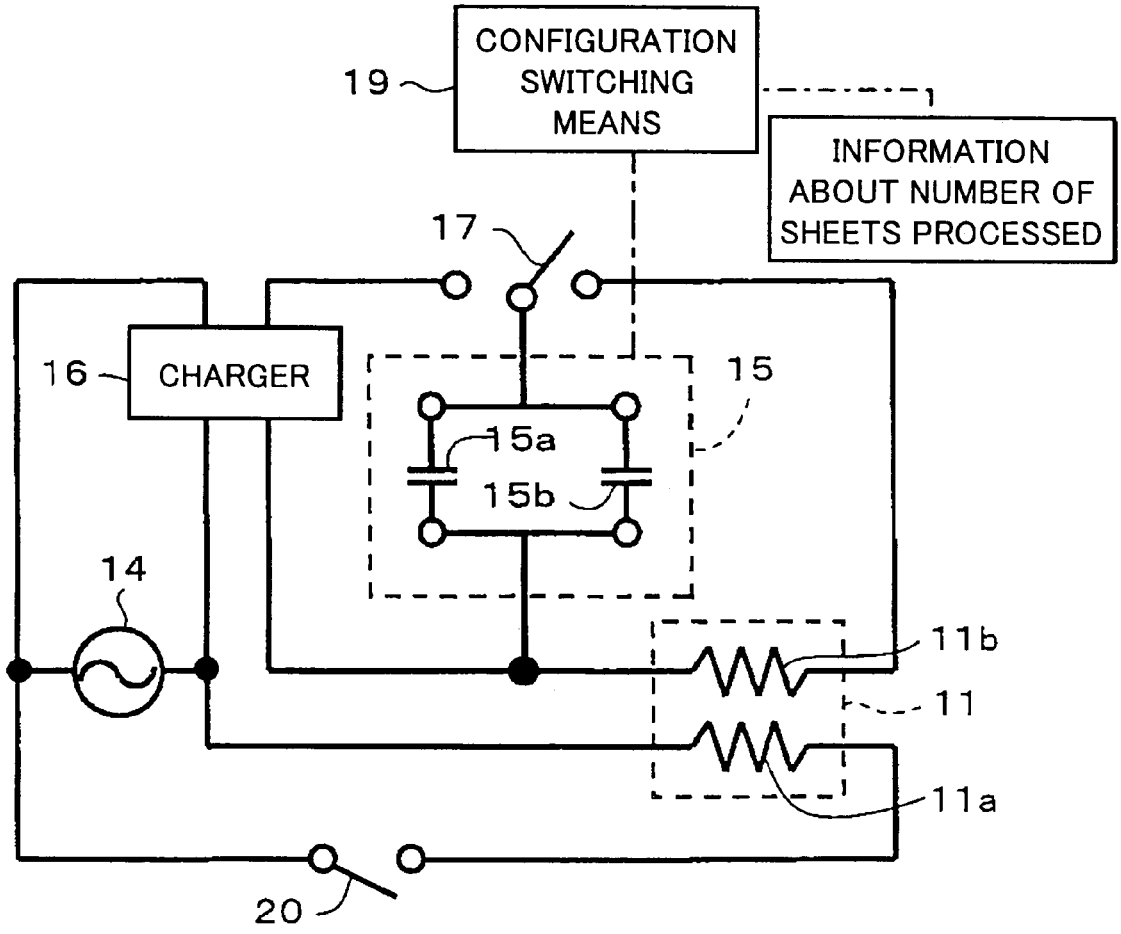
FIG. 6 is a schematic diagram showing the circuit configuration of the fixing apparatus according to Embodiment 3 of the present invention.

FIG. 6 shows a circuit configuration of the fixing apparatus according to Embodiment 3 of the present invention. Embodiment 3 is similar to Embodiment 1, and in addition the control unit of the image forming apparatus calculates and stores the number of image formation sheets that are processed in continuation. In Embodiment 3, the information about the number of image formation sheets processed in continuation is provided to the configuration change means 19. The configuration change means 19 receives the information about the number of image formation sheets processed in continuation from the control unit instead of the detection information from the temperature sensor 18, and controls the connection mode of the capacitor cells 15*a* and 15*b* according to the information about the number of image formation sheets processed in continuation in order to properly control the power provided to the heating unit 11*b*.

That is, as the number of image formation sheets processed in continuation increases, the temperature of the heating roller 11 decreases. Accordingly, the configuration change means 19 changes the connection mode of the capacitor cells 15*a* and 15*b* such that the power supplied to the heating unit 11*b* becomes higher as the number of image formation sheets processed in continuation increases. For example, while the number of image formation sheets processed in continuation does not reach a predetermined number of sheets, the capacitor cells 15*a* and 15*b* are connected as shown by FIG. 2; and when the number of image formation sheets processed in continuation becomes equal to or greater than the predetermined number of sheets, the configuration change means 19 connects the capacitor cells 15*a* and 15*b* as shown by FIG. 1.

According to Embodiment 3, the temperature change of the heating component can be made small, since the connection mode of the capacitor cells is changed based on the number of sheets that are continuously heated (i.e., the number of image formation sheets processed in continuation).

Further, according to Embodiments 1 through 3, the image forming apparatus includes the image formation means (the photo conductor 1, the electrification apparatus 2, the exposure means, the development means 4, and the transfer apparatus 5) for forming an image on the transfer paper P as the heating target, and the image heating means for heating the image on the transfer paper P, wherein the image heating means employs the fixing apparatus 12 serving as the heating apparatus as described above. In this manner, unevenness of the image can be eliminated and the output quality can be improved.

Further, according to Embodiments 1 through 3, the image forming apparatus includes the image formation means (the photo conductor 1, the electrification apparatus 2, the exposure means, the development means 4, and the transfer apparatus 5) for forming a yet-to-be-fixed image on the transfer paper P that is the heating target, and the fixing means for heating the yet-to-be-fixed image on the transfer paper P, and fixing to the transfer paper P, wherein the fixing means employs the fixing apparatus 12. In this manner, unevenness of the image can be eliminated and the output quality can be improved.

Figure 9:
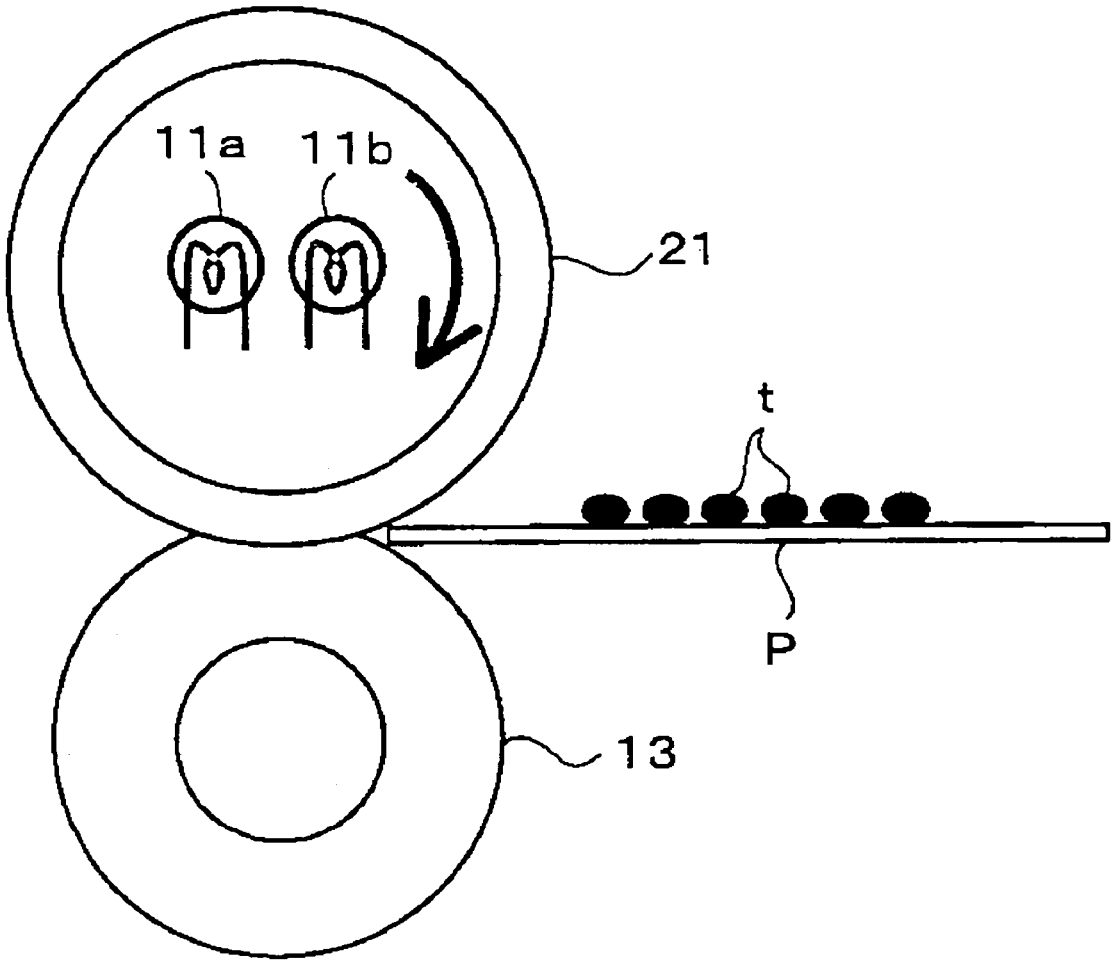
FIG. 9 is a cross-sectional view showing a heating apparatus according to Embodiment 4 of the present invention.

FIG. 9 shows the heating apparatus according to Embodiment 4 of the present invention. While the above-mentioned Embodiment 1 employs the heating roller 11, Embodiment 4 employs a heating roller 21. The heating roller 21 includes an elastic layer and a demolding layer formed one by one in this sequence on the core metal, thus having a three-layer structure.

Figure 10:
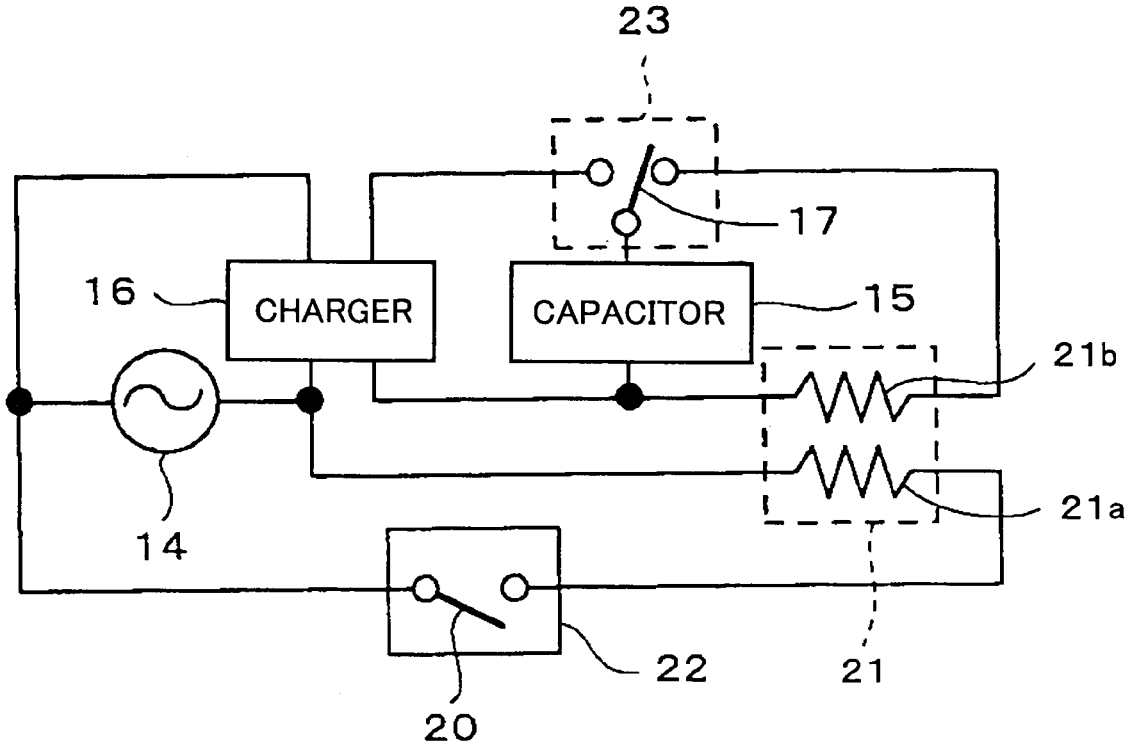
FIG. 10 is a schematic diagram showing the circuit configuration of the fixing apparatus according to Embodiment 4 of the present invention.

FIG. 10 shows a circuit configuration of the fixing apparatus 12 according to Embodiment 4. A control unit 22 serving as control means for turning on and off power to a heating unit 11*a* includes a control device, such as a CPU. When the surface temperature of the heating roller 21 is below a predetermined temperature, the control unit 22 turns on the switch 20 based on a detection signal from the temperature sensor 18 such that power is supplied from the main power supply 14 to the heating unit 11*a*. When the surface temperature of the heating roller 21 exceeds the predetermined temperature, the switch 20 is turned off such that the power from the main power supply 14 to the heating unit 11*a* of the heating roller 21 is stopped. In this manner, the surface temperature of the heating roller 21 is controlled at the predetermined temperature.

A charging/discharging switching unit 23 serving as charging/discharging switching means for switching between charging and discharging of the auxiliary power supply 15 turns a switch 17 to the side of the charger 16 during a period while power consumption is comparatively low if the auxiliary power supply 15 is not fully charged. Then, the charger 16 charges the auxiliary power supply 15 through the switch 17. If high power is required, such as at the time of the standup when the temperature of the heating roller 21 is to be quickly raised from room temperature to operating temperature (temperature appropriate for fixing operations), the charging/discharging switching unit 23 turns the switch 17 to the side of the heating unit 11*b* such that the power from the auxiliary power supply 15 is supplied to the heating unit 11*b* via the switch 17.

According to Embodiment 4, since the elastic layer covers the core metal of the heating roller 21, the elasticity of the elastic layer provides close contact of the heating roller 21 to the toner layer on the transfer paper P, and a high quality image without gloss unevenness is obtained. Further, even if relatively poor thermal conductivity of the elastic layer of the heating roller 21 causes reduction of the surface temperature of the heating roller 21 in the case that only the main power supply 14 supplies the power to the heating unit 11*a* and the number of image formation sheets is large, a high image fixing quality is available without reducing process speed by the auxiliary power supply 15 supplying the power to the heating unit 11*b*.

As the core of the heating roller 21, metal having high thermal conductivity, such as iron, aluminum, and stainless steel, is used.

As the elastic layer of the heating roller 21, a heat-resistant high elastic material, such as silicone rubber, fluoride rubber, and the like, is used. Especially, silicone rubber is desirable as the material of the elastic layer of the heating roller 21 from the point of heat resistance and durability. As for thickness of the elastic layer of the heating roller 21, about 0.1 through 1 mm is desirable depending upon rubber hardness of the material to be used. If the thickness of the elastic layer of the heating roller 21 is thinner than 0.1 mm, unevenness of the toner layer and the transfer paper cannot be absorbed (eliminated), and a poor image, with such as gloss unevenness, arises. Further, if the elastic layer of the heating roller 21 is thicker than 1 mm, the heat capacity of the heating roller 21 becomes too great, and it takes a long time at the starting up, which is not desirable.

As the demolding layer of the heating roller 21, a heat-resistant resin is used, such as a fluoro-resin and silicone resin. As for the mold-release characteristic and durability, especially a fluoro-resin is desirable for the demolding layer of the heating roller 21, such as PFA (perfluoro alkyl vinyl ether copolymerization resin), PTFE (poly tetra fluoro ethylene), and FEP (tetrafluoro ethylene hexafluoropropylene copolymerization resin).

The thickness of the demolding layer of the heating roller 21 is preferred to be between 5 and 30 micrometers. Otherwise, if the thickness of the demolding layer of the heating roller 21 is less than 5 micrometers, the durability of the demolding layer may become low; and if the thickness of the demolding layer of the heating roller 21 exceeds 30 micrometers, the demolding layer may become hard, and poor image quality, such as gloss unevenness, may result. The demolding layer of the heating roller 21 is not an indispensable item; however, the separation of the fixing roller from the toner on the transfer paper is improved if a demolding layer of the heating roller 21 is present. Accordingly, it is desirable for the heating roller 21 to include a demolding layer.

Thus, according to Embodiment 4, since the heating roller 21, described in Embodiment 1 as the heating component, is equipped with an elastic layer, a high quality image is produced at a high speed.

Further, according to Embodiment 4, since the thickness of the elastic layer is 0.1 mm or greater, high quality is secured.

Furthermore, according to Embodiment 4, since a demolding layer is provided in the outermost layer of the elastic layer, the separation nature of the heating component and the toner image is raised.

By the way, according to Embodiment 4, if the surface temperature of the heating roller 21 becomes below the predetermined temperature, heat cannot be fully given to the toner on the transfer paper P from the heating roller 21, and poor fixing is carried out. Embodiment 5 of the present invention features the charging/discharging switching unit 23 described above in reference to Embodiment 4 being controlled based on the detection signal from the temperature sensor 18, which signal indicates whether the surface temperature of the heating roller 21 becomes the predetermined temperature while processing a large number of sheets in continuation (at the time of continuous image formation). If the surface temperature of the heating roller 21 is determined to be below the predetermined temperature, the switch 17 is turned on the side of the heating unit 11*b* such that the auxiliary power supply 15 supplies the power to the heating unit 11*b* via the switch 17, and the surface temperature of the heating roller 21 is maintained within a temperature range wherein poor fixing does not arise. The charging/discharging switching unit 23 turns the switch 17 on the side of the charger 16 during the standby when the power consumption is comparatively small if the auxiliary power supply 15 is not fully charged, such that the charger 16 charges the auxiliary power supply 15 through the switch 17.

According to Embodiment 5, wherein the surface temperature of the heating roller 21 is controlled by turning on and turning off the power supply from the main power supply 14 to the heating unit 11*a* by the switch 20, and the auxiliary power supply 15 employing a mass capacitor is used, high power is supplied from the auxiliary power supply 15 to the heating unit 11*b* within a short period of time, which causes large fluctuations along the time axis of the surface temperature of the heating roller 21 as shown by FIG. 4.

In the case that the power supplied to the heating unit 11*a* of the fixing apparatus 12 becomes slightly insufficient, while the heating roller 21 continues heating operations only with the supply power of the main power supply 14, power is supplied to the heating unit 11*b* from the auxiliary power supply 15. If the power is too high and quickly supplied from the auxiliary power supply 15, the surface temperature of the heating roller 21 changes too much and too quickly while a sheet of image formation paper is processed, producing unevenness in the image, and thereby degrading the image quality.

To cope with this problem, the level of power supplied from the auxiliary power supply 15 to the heating unit 11*b* is adjusted by changing the connection mode of the plurality of capacitor cells, such as the capacitor cells 15*a* and 15*b*, by the configuration change means 19. For example, at the time of initial heating where the surface temperature of the heating roller 21 is determined to be below the predetermined temperature, based on the detection signal from the temperature sensor 18, the capacitor cells 15*a* and 15*b* are connected in series as shown by FIG. 1 such that high voltage is supplied to the heating unit 11*b*.

Then, in the case of supplying power from the auxiliary power supply 15 to the heating unit 11*b* while image formation is continuously processed, with the surface temperature of the heating roller 21 being above the predetermined temperature, the configuration change means 19 changes the connection mode of the capacitor cells 15*a* and 15*b* as shown by FIG. 2 such that low voltage is supplied to the heating unit 11*b*.

As described above, according to Embodiment 5, the plurality of capacitor cells, such as the capacitor cells 15*a* and 15*b*, of the auxiliary power supply 15 can be connected in parallel at least at the time of electric discharge. When the surface temperature of the heating roller 21 becomes slightly lower than the predetermined temperature such as at the time of continuous image formation, the capacitor cells, such as the capacitor cells 15*a* and 15*b*, are connected in parallel such that low voltage is supplied to the heating unit 11*b*. In this manner, when the power from the auxiliary power supply 15 to the heating unit 11*b* is turned on and turned off, change of the surface temperature of the heating roller 21 is reduced. That is, the time change of the surface temperature of the heating roller 21 becomes small, heating unevenness by the fixing apparatus 12 of the image becomes small, and quality image formation becomes possible.

According to Embodiment 5, when the surface temperature of the heating roller 21 becomes below the predetermined temperature while sheets of the transfer paper P, which are the heating target, continuously pass through the fixing apparatus 12 (at the time of continuous image formation), the power is supplied to the heating unit 11*b* from the auxiliary power supply 15. In this manner, temperature decline of the heating roller 21 at the time of continuous image formation is prevented from occurring, and a high speed process is realized.

Further, since the auxiliary power supply 15 is equipped with a plurality of capacitor cells, such as the capacitor cells 15*a* and 15*b*, and the connection mode thereof is made switchable according to Embodiment 5, the power provided from the auxiliary power supply 15 to the heating unit 11*b* is optimized.

Further, according to Embodiment 5, since the capacitor cells 15*a* and 15*b* are connected in parallel at the time of electric discharge of the auxiliary power supply 15, the stability of the temperature of the heating roller 21 serving as the heating component is enhanced.

The amount of decline of the surface temperature of the heating roller 21 is mostly decided by the number of image formation sheets continuously processed (the number of continuous sheets), although it is also dependent on the kind of transfer paper P. According to Embodiment 6 of the present invention, the charging/discharging switching unit 23 described above concerning Embodiment 4 determines whether the number of sheets becomes greater than a predetermined number, where the control unit of the image forming apparatus counts the number of sheets. When the number of sheets is determined to be greater than the predetermined number, the switch 17 is turned on the side of the heating unit 11*b* such that the power is supplied from the auxiliary power supply 15 to the heating unit 11*b* via the switch 17 for maintaining the surface temperature of the heating roller 21 within the temperature range so that satisfactory fixing is available without sacrificing speed. Here, the predetermined number of sheets is dependent on the injection power from the main power supply 14, the configuration of the heating roller 21 (especially heat capacity and heat conductivity), a process, a conveyance interval (distance) of the transfer paper, the kind of transfer paper, etc. When the auxiliary power supply 15 is not fully charged, the charging/discharging switching unit 23 turns the switch 17 on the side of the charger 16 during the standby, etc., when power consumption is comparatively small, such that the charger 16 charges the auxiliary power supply 15 through the switch 17.

Further, the charging/discharging switching unit 23 adjusts the level of power supplied to the heating unit 11*b* by switching the connection mode of the capacitor cells 15*a* and 15*b*, such that high power is supplied to the heating unit 11*b* from the auxiliary power supply 15, for example, at the time of initial heating when the surface temperature of the heating roller 21 is determined to be low based on the detection signal from the temperature sensor 18 by connecting the capacitor cells 15*a* and 15*b* in series as shown in FIG. 1.

Afterward, during the time of continuous processing (at the time of continuous image formation), with the surface temperature of the heating roller 21 being higher than the predetermined temperature, the charging/discharging switching unit 23 connects the plurality of capacitor cells, such as the capacitor cells 15*a* and 15*b*, in parallel as shown by FIG. 2, such that the power supplied to the heating unit 11*b* from the auxiliary power supply 15 become low.

According to Embodiment 6, the power is supplied to the heating unit 11*b* from the auxiliary power supply 15 when the number of sheets (the number of image formations of sheets processed in continuation) of the transfer paper P that is the heating target that pass the fixing apparatus 12 continuously reaches the predetermined number of sheets. In this manner, temperature decline of the heating component at the time of continuous process (at the time of continuous image formation) is prevented, and improvement in the speed is attained.

Embodiment 7 of the present invention including the heating roller 21 is a variation of Embodiment 2 that includes the heating roller 11.

According to Embodiment 7, the capacitor cells 15*a* through 15*f* of the auxiliary power supply 15 are connected at least at the time of electric discharge such that the voltage applied to the heating unit 11*b* exceeds the minimum heating voltage of the heating unit 11*b*. In this manner, the minimum heating voltage of the heating unit 11*b* is ensured so that the heating roller 21 is reliably heated.

Embodiment 8 of the present invention including the heating roller 21 is a variation of Embodiment 3 that includes the heating roller 11, and the same effect as Embodiment 4 is acquired.

Next, Embodiment Example 1 of the present invention is explained. Embodiment Example 1 is related to Embodiment 4. The heating roller 21 was structured by an iron hollow cylinder-like core having an outer diameter of 40 mm, and a thickness of 1 mm, on the surface of which an elastic layer of silicone rubber that is 0.5 mm thick was prepared, and on the surface of which a PFA layer 30 micrometers thick was formed in order to raise the surface mold-release characteristics. The pressurization roller 13 having an outer diameter of 40 mm was structured by a metal core made from aluminum, and an elastic layer of silicone rubber with a thickness of 3 mm was prepared on the perimeter of the metal core. The pressurization roller 13 was loaded with a spring that was installed in the direction of the axis of rotation of the heating roller 21, and the width of the nip part with the heating roller 21 was about 8 mm. As the heating unit 11*a*, a main heater of 900 W was used, and as the heating unit 11*b*, an auxiliary heater of 500 W was used. Since the surface temperature of the heating roller 21 fell gradually when the heating roller 21 was heated only by the main heating unit 11*a* and a continuous process was performed by the fixing apparatus 12, power was supplied from the auxiliary power supply 15 to the auxiliary heating unit 11*b* when the surface temperature of the heating roller 21 fell to 165 degrees C. As a result, the surface temperature of the heating roller 21 was maintained and sufficient fixing was available without reducing linear speed.

Next, Comparative Example 1 is explained. Comparative Example 1 is the same as Embodiment Example 1, except that the auxiliary power supply 15 was not used. Then, the surface temperature of the heating roller 21 fell to 160 degrees C. or lower by the continuous process, and poor fixing was produced. The linear speed had to be reduced in order to maintain the surface temperature of the heating roller 21, and to obtain a satisfactory result.

Next, Embodiment Example 2 of the present invention is explained. Embodiment Example 2 is related to Embodiment 7, wherein the heating roller 21, and the heating units 11*a* and 11*b* were the same as that of Embodiment Example 1, and the capacitor cells 15*a* through 15*f* were connected as shown at (b) of FIG. 5. Then, a continuous process was performed to the fixing apparatus 12, with the heating roller 21 being heated only by the main heating unit 11*a*. Since the surface temperature of the heating roller 21 fell gradually, power was supplied from the auxiliary power supply 15 to the auxiliary heating unit 11*b* when the fixing apparatus 12 has processed 130 sheets. As the result, the surface temperature of the heating roller 21 gradually recovered, producing satisfactory fixing without reducing the linear speed.

Next, Comparative Example 2 is explained. Comparative Example 2 is the same as Embodiment Example 2, except that the auxiliary power supply 15 was not used, wherewith poor fixing was produced at the 135th sheet in the continuous process.

Next, Comparative Example 3 is explained. Comparative Example 3 is the same as Embodiment Example 2, except that the capacitor cells 15*a* through 15*f* were connected as shown at (c) of FIG. 5. In Comparative Example 3, the voltage applied to the auxiliary heating unit 11*b* became below the minimum heating voltage of the auxiliary heating unit 11*b*. For this reason, the auxiliary heating unit 11*b* was not heated, and the surface temperature of the heating roller 21 fell as the continuous process was performed to the fixing apparatus 12, and poor fixing was produced.

Next, Embodiment Example 3 is explained. Embodiment Example 3 is the same as Embodiment 7, except that the heating roller 21 was structured by a hollow cylinder-like metal core made from aluminum, having an outer diameter of 40 mm and a thickness of 3 mm, on the surface of which an elastic layer of silicone rubber having a thickness of 0.3 mm was prepared, on the surface of which a PFA layer with a thickness of 30 micrometers was prepared for raising the surface mold-release characteristics. The pressurization roller 13 having an outer diameter of 40 mm was structured by an aluminum metal core, on the perimeter of which a 3 mm-thick elastic layer of silicone rubber was prepared. The pressurization roller 13 was loaded with a spring installed in the direction of the axis of rotation of the heating roller 21. The width of the nip part of the heating roller 21 was about 8 mm. As the heating unit 11*a*, a main heater of 900 W was used. As the heating unit 11*b*, an auxiliary heater of 500 W was used. The capacitor cells 15*a* through 15*f* were connected as shown at (b) of FIG. 5 for supplying power to the auxiliary heating unit 11*b*. Since the surface temperature of the heating roller 21 fell gradually when the heating roller 21 was heated only by the main heating unit 11*a* and the continuous process was performed by the fixing apparatus 12, power was supplied from the auxiliary power supply 15 to the auxiliary heating unit 11*b* when the surface temperature of the heating roller 21 fell to 165 degrees C. As a result, the surface temperature of the heating roller 21 gradually recovered, and satisfactory fixing was obtained without reducing the linear speed. Further, the images after fixing had neither gloss unevenness nor rough finish, and the image quality was satisfactory.

Figure 11:
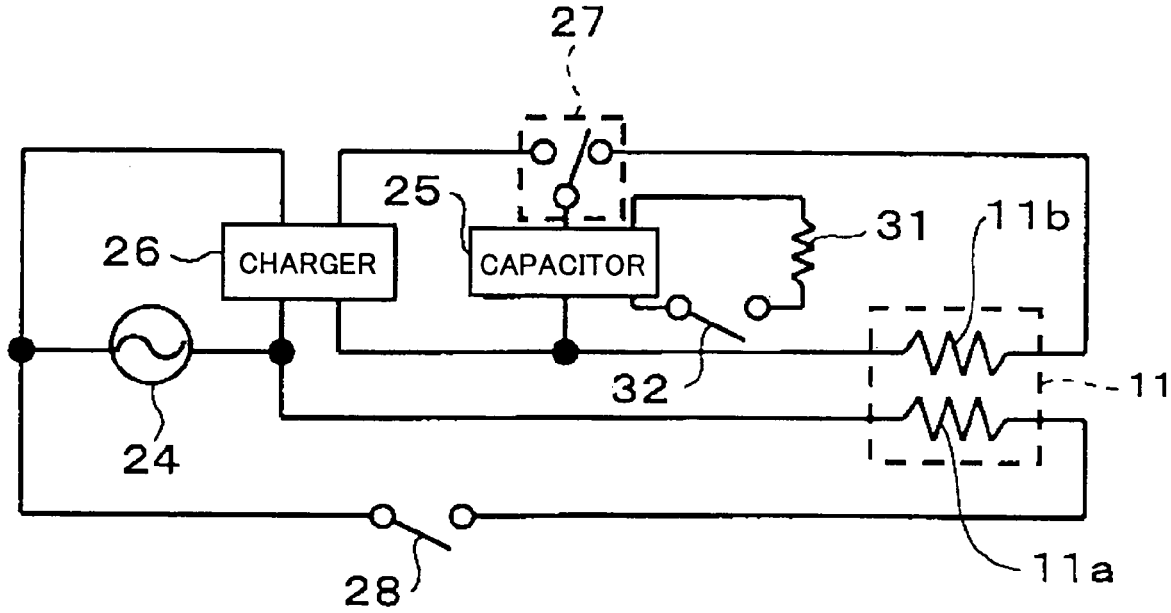
FIG. 11 is a schematic diagram showing the circuit configuration of the fixing apparatus according to Embodiment 9 of the present invention.

Next, Embodiment 9 of the present invention is explained. Embodiment 9 is the same as Embodiment 1, except that the circuit configuration of the fixing apparatus is as shown by FIG. 11. The fixing apparatus shown by FIG. 11 includes the main power supply 24 that outputs AC power from an external power supply, such as a commercial power supply acquired from a wall socket, the auxiliary power supply 25, a charger 26, charging/discharging switching means 27 for switching charging/discharging of the auxiliary power supply 25, and main power control means 28 for controlling the power supplied from the main power supply 24 to the main heating unit 11*a*.

The main power supply 24 supplies the power to the main heating unit 11*a* through the main power control means 28 for generating heat, and the auxiliary power supply 25 supplies the power to the auxiliary heating unit 11*b* for generating heat. The charger 26 converts the AC power from the main power supply 24 into DC power, and supplies the DC power to the auxiliary power supply 25 for charging through the charging/discharging switching means 27. The charging/discharging switching means 27 switches the power of the auxiliary power supply 25 between the charger 26 and the auxiliary heating unit 11*b*. As described above, the power is independently supplied to the main heating unit 11*a* and the auxiliary heating unit 11*b* supplied from the main power supply 24 and the auxiliary power supply 25, respectively, which simplifies the circuit and reduces costs. The fixing apparatus of Embodiment 9 is compared with a fixing apparatus as shown by FIG. 13 that includes only one heating unit 11*c*, to which the power is supplied from the main power supply 24 and the auxiliary power supply 25.

Figure 13:
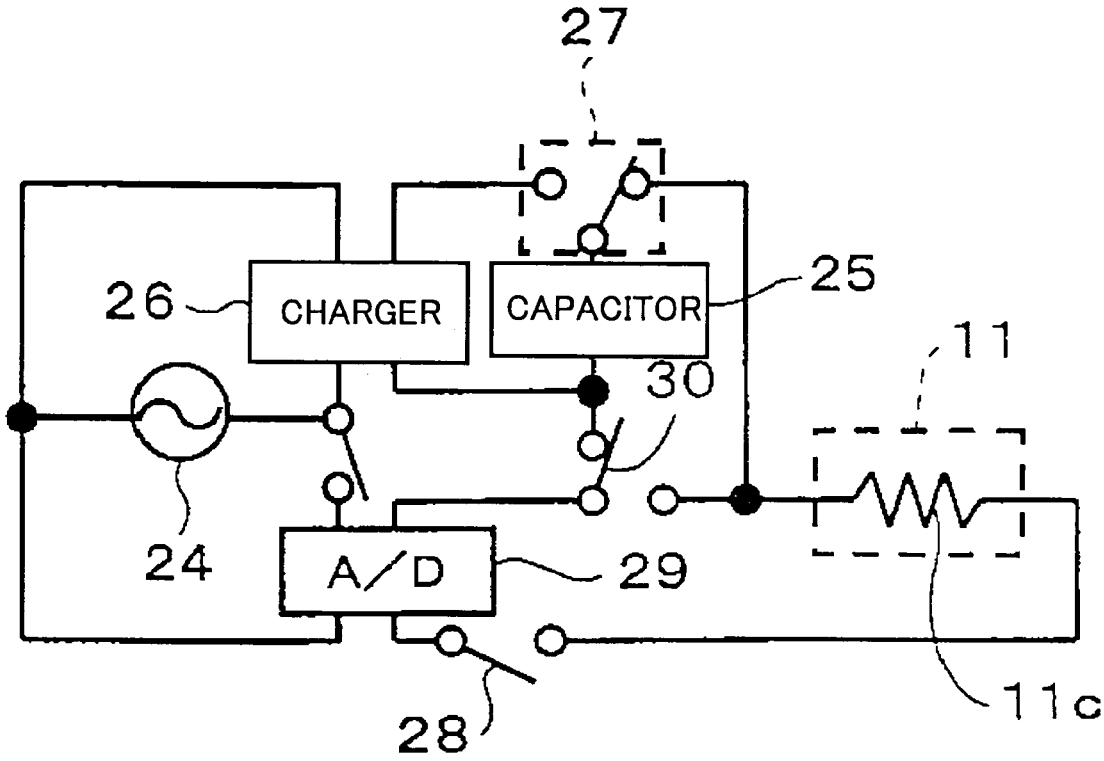
FIG. 13 is a schematic diagram showing a Comparative Example of circuit configuration of the fixing apparatus for comparison purposes.

According to the fixing apparatus shown by FIG. 13, the AC power from the main power supply 24 is converted to DC power by an A/D conversion unit 29, the DC power being supplied to the heating unit 11*c* through main power control means 28 and a changeover switch 30, and the power from the auxiliary power supply 25 being supplied to the heating unit 11*c* through the charging/discharging switching means 27 and the changeover switch 30. For this reason, the configuration is complicated, the cost is increased, and a new problem occurs further in that the power declines depending on the conversion efficiency of the A/D conversion unit 29. Therefore, it is desired that a fixing apparatus have two heating units as shown by FIG. 11.

The heating roller 11, serving as a fixing roller in Embodiment 9, includes the heating units 11*a* and 11*b*. As the heating units 11*a* and 11*b*, a halogen heater, a ceramic heater wherein a heating element formed on a ceramic base generates heat by power that is supplied, and a thin film resistor made of a metal resistance thin film, etc., are used.

Embodiment 9 includes the main heating unit 11*a* that generates heat with the power supplied from the main power supply part 24 through the main power control means 28, and the auxiliary heating unit 11*b* that generates heat with the power supplied from the auxiliary power supply 25 through the charging/discharging switching means 27, and raises the surface temperature of the heating roller 11 to a predetermined temperature.

In Embodiment 9, a halogen heater is used as the heating units 11*a* and 11*b*. A halogen heater uses light irradiated from a halogen lamp as heat, and even if a filament that consists of tungsten evaporates, because the tungsten reacts with the halogen gas sealed in glass by the halogen cycle, the tungsten returns to the filament. Thus, it has a long life.

The main power supply 24 is connected to a wall socket near the installation place of the apparatus according to Embodiment 9, and outputs AC power from an external power supply, such as the commercial power supply, which usually is 100 V in Japan. Furthermore, in many cases, a circuit breaker is rated at 15 A, i.e., a circuit is capable of providing up to about 1500 W. The main power supply 24 may be provided with functions such as rectification, voltage adjustment, and stabilization of the AC power according to the heating unit 11*a*, in addition to simply providing the power to the heating unit 11*a* through the main power control means 28.

The auxiliary power supply 25 is a power supply capable of charging/discharging, and the auxiliary power supply 25 according to the present embodiment uses an electric double layer capacitor that is a mass capacitor. Since the capacitor is not accompanied by a chemical reaction, unlike a rechargeable battery, it has the outstanding features (1) through (3) as described above, and further, it has the outstanding feature of discharging within a short time interval. Since the mass capacitor can discharge within a short time, stored energy can be quickly used up, and voltage gradually falls according to the amount of electric discharge.

According to Embodiment 9, a plurality of capacitor cells of 500 F and 2.5 V are connected in series for serving as the auxiliary power supply 25 that provides the power to the auxiliary heating unit 11*b*. The auxiliary power supply 25 structured in this manner is capable of providing power to the auxiliary heating unit 11*b* for a period of time that ranges from several seconds to dozens of seconds.

Further, the auxiliary power supply 25 may employ a redox capacitor, a pseudo capacitor, etc., besides the electric double layer capacitor.

According to Embodiment 9, the main power supply 24 supplies power to the heating unit 11*a* through the main power control means 28, and the auxiliary power supply 25 supplies power to the heating unit 11*b* through the charging/discharging switching means 27. By simultaneously applying power to both heating units 11*a* and 11*b* in the heating roller 11 from the main power supply 24 and the auxiliary power supply 25, respectively, power greater than the power that can be provided by the main power supply 24 can be supplied to the heating units in the heating roller 11.

Figure 12:
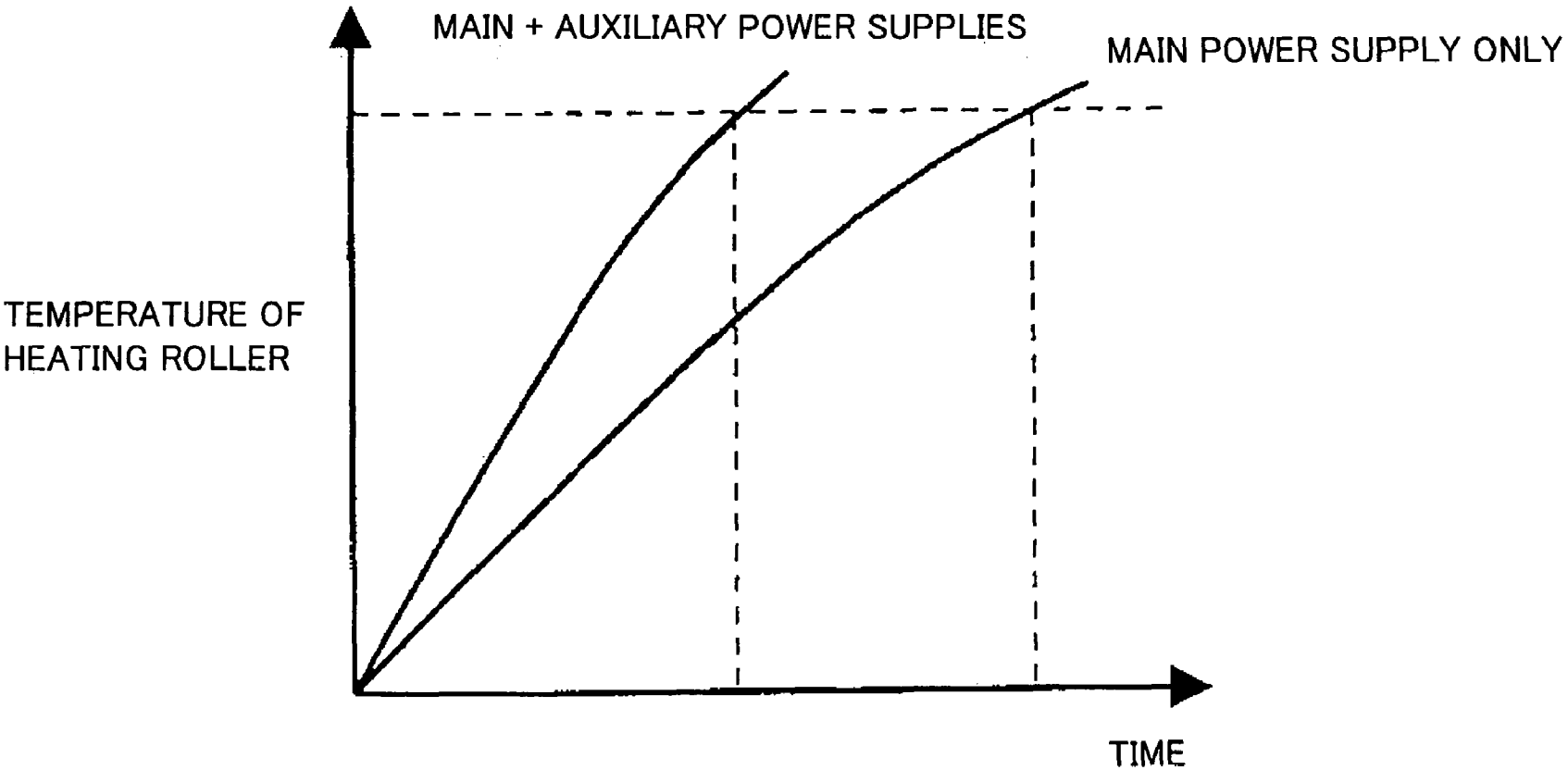
FIG. 12 is a graph showing the temperature standup characteristic of the heating roller according to Embodiment 9 of the present invention.

For this reason, time required for the temperature of the heating roller 11 to rise to a desired temperature is shorter when the main power supply 24 and the auxiliary power supply 25 are simultaneously used compared to only the main power supply 24 being used, as shown by FIG. 12. Further, since the power output of the auxiliary power supply 25 declines as electric discharge continues, it functions as if equipped with a safeguard that interrupts power automatically. In this manner, the fixing apparatus using the main power supply 24 and the auxiliary power supply 25 safely provides quick heating, compared with a fixing apparatus using only the main power supply 24, with increased power capability.

Figure 14:
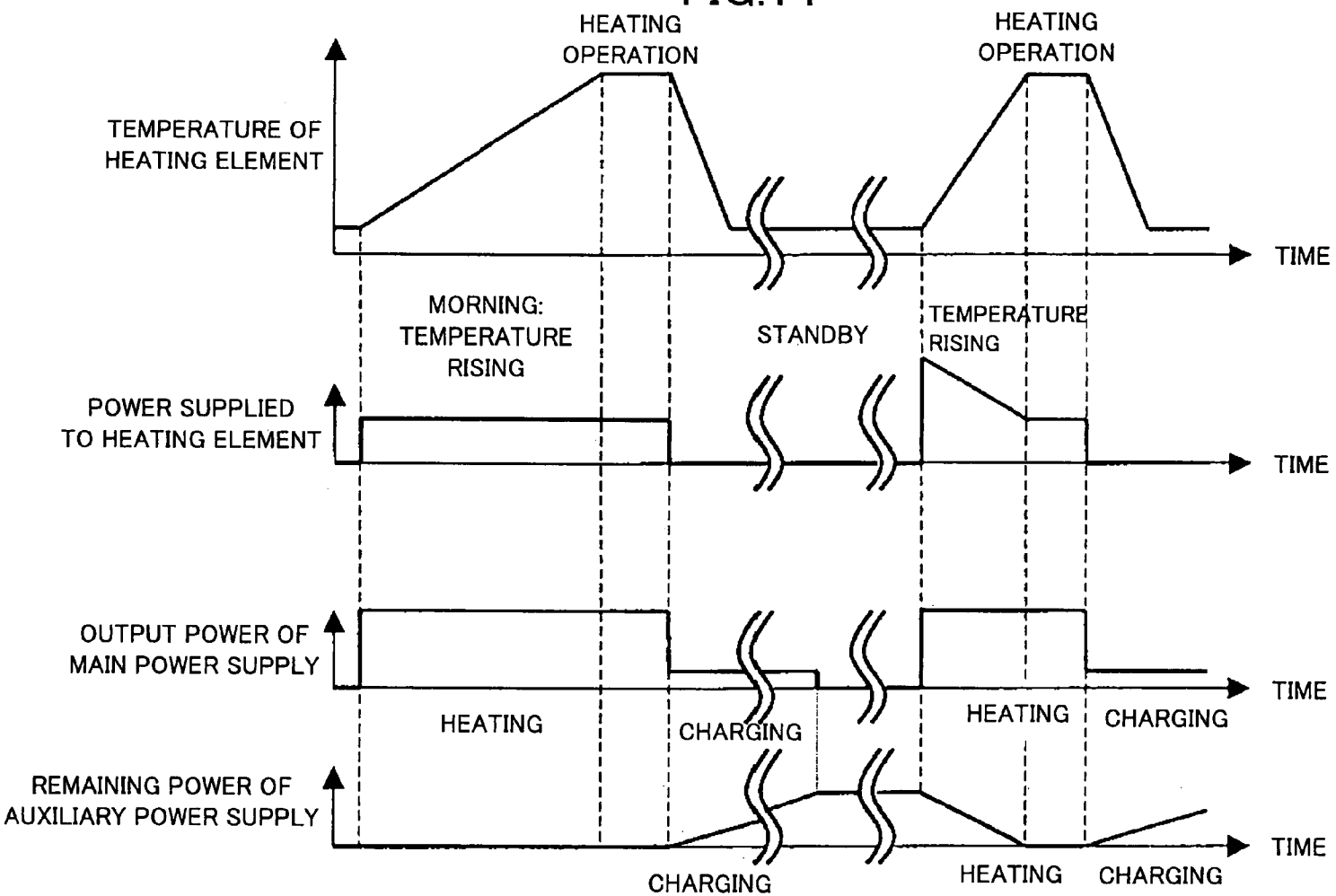
FIG. 14 is a timing chart showing a Comparative Example of heating operations of the heating apparatus according to Embodiment 9 of the present invention.

FIG. 14 shows an example of operations according to Embodiment 9. As described above, according to Embodiment 9, high-speed temperature rise is possible, and the charge time of the auxiliary power supply 25 is short. When the auxiliary power supply 25 that consists of a mass capacitor of an electric double layer capacitor, and the like, which can be quickly charged, is not fully charged, such as the first thing in the morning, power is supplied only to the heating unit 11*a* from the main power supply 24. In the standby state while the temperature of the heating roller 11 does not have to be high, power is supplied to the auxiliary power supply 25 from the main power supply 24 through the charger 26 and the charging/discharging switching means 27 such that the auxiliary power supply 25 is charged.

Then, when a lot of power is needed such as when the temperature of the heating roller 11 needs to be raised, power is supplied to the heating units 11*a* and 11*b* from the main power supply 24 and the auxiliary power supply 25 through the main power control means 28 and the charging/discharging switching means 27, respectively. In this manner, power higher than with only the main power supply 24 is supplied to the heating units 11*a* and 11*b*, and the temperature of the heating roller 11 rises in a short time. Thus, an effect that is not acquired with a rechargeable battery can be acquired by using a capacitor as the auxiliary power supply 25.

A heating roller, the temperature of which can be raised to a predetermined temperature in 30 seconds, for example, is explained. Here, the heating roller is structured by an iron roller having a 0.7 mm thickness and a diameter of 50 mm. For the temperature of the heating roller to reach the predetermined temperature, which is about 180 degrees C., it takes about 30 seconds using a halogen heater of 1200 W, which is normally used by conventional fixing apparatuses.

Next, an example is explained, wherein an electric double layer capacitor serving as the auxiliary power supply is charged at a high voltage, and a heating unit has a supply current that is restricted to 12 A. A halogen heater is characterized by having a maximum current that can pass. When the electric double layer capacitor is charged to 50 V, the power of 12 A×50 V=600 W can be taken out from the electric double layer capacitor. When the power of 600 W of the auxiliary power supply is supplied to the halogen heater simultaneously with the 1200 W of the commercial power supply, the power of 1800 W is supplied to the halogen heater, and the temperature rise time of the heating roller is shortened to about 20 seconds, compared with 30 seconds as described above.

However, using 50 V that is obtained by connecting two or more capacitor cells, each being capable of 2.5 V, in series as the power supply to the halogen heater, poses a safety problem. That is, there is a possibility of receiving an electric shock when the terminal part of the high voltage is touched by a user or a maintenance person accessing the inside of the apparatus, since the high voltage of about 50 V is used by the image forming apparatus.

According to "Electrician's Text" published by the Japan Electric Association, a human starts feeling electricity at about 3.5 mA of a DC current of such as capacitor, and feels "a shock without pain" at about 6 mA. Since a human's electric resistance ranges between 5 and 10 kohm, the human receives the electric shocks as described above in a range between 18 and 35 V, and a range between 30 and 60 V, respectively. Accordingly, in the case of 50 V, produced by 20 capacitor cells, each capable of 2.5 V, connected in series, there is a potential hazard of an electric shock to the user and the maintenance person who accidentally touches the circuit.

According to Embodiment 9, a resistor 31 that is an electric load is connected to the auxiliary power supply 25 through the switching means 32 as alternative connection means between terminals of the auxiliary power supply 25, and the switching means 32 is usually opened. If the switching means 32 is closed by a predetermined direction (command), the resistor 31 is connected between the terminals of the auxiliary power supply 25, power is supplied to the resistor 31 from the auxiliary power supply 25, and the voltage of the auxiliary power supply 25 drops. Instead of the resistor 31, a fin and the like may be used such that heat generated by the electric load is efficiently dissipated and damage is prevented.

The direction to the switching means 32 is carried out in a conventional manner. For example, access detection means (detection means for detecting an access inside of the apparatus by the user and the maintenance person) such as an opening-and-closing detection switch of the cover of the case that contains the auxiliary power supply 25 is interlocked with the switching means 32. The access detection means detects opening of the case, the switching means 32 closes the contacts based on the access detection signal, and power is supplied to the resistor 31 from the auxiliary power supply 25. The direction to the switching means 32 may be carried out by the access detection means detecting the opening and closing of a unit that contains a high voltage terminal of the auxiliary power supply 25 such that the direction of electric discharge to the switching means 32 is automatically provided when the user and the maintenance person access the high voltage terminal.

In Embodiment 9, a resistor having a resistance of about 13 ohms is used as the resistor 31. When the switching means 32 closes the switch, the resistor 31 is connected, and the voltage of the auxiliary power supply 25 is lowered from 50 V to 30 V in about 2.5 minutes. That is, the voltage of the power supply terminal of the auxiliary power supply 25 can be lowered to a level at which a human does not receive painful electric shock. Further, since the user and the maintenance person are not required to manually direct the electric discharge of the auxiliary power supply 25 to the resistor 31, an electric shock from careless access is avoided, which is desirable from a safety view point.

Thus, according to Embodiment 9, an electric shock can be prevented by lowering the output voltage of the auxiliary power supply to a voltage that does not give an electric shock even if a human accidentally touches it, and safety is high. Further, access by a person inside the apparatus can be detected automatically, upon which detection the voltage is reduced automatically, and a heating apparatus with minimal risk of an electric shock is realized. Furthermore, since direct current DC flows in a human body less easily than alternating current AC by a factor of about 4 in a voltage range up to 200 V, the embodiments of the present invention realize a safe auxiliary power supply, compared with an AC-based power supply having the same power supply capability at the same voltage.

Figure 15:
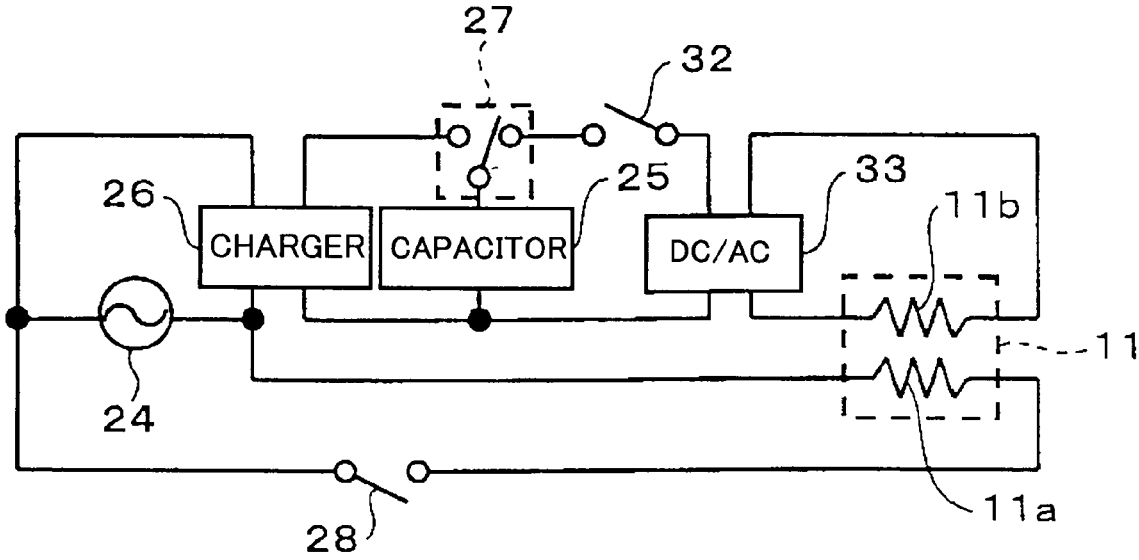
FIG. 15 is a schematic diagram showing the circuit configuration of the fixing apparatus according to Embodiment 10 of the present invention.

FIG. 15 shows a circuit configuration of the fixing apparatus according to Embodiment 10 of the present invention. Embodiment 10 is the same as Embodiment 9, except that a DC/AC converter 33 is provided instead of the resistor 31. The input side of the DC/AC converter 33 is connected to the auxiliary power supply 25 through the charging/discharging switching means 27 and the switching means 32. The output side of the DC/AC converter 33 is connected to the heating unit 11*b*. Contrary to Embodiment 9, the switching means 32 is normally closed, and is opened by a predetermined direction provided by the access detection means, such as an opening-and-closing detection switch of the cover of the case that contains the auxiliary power supply 25, etc.

Figure 16:
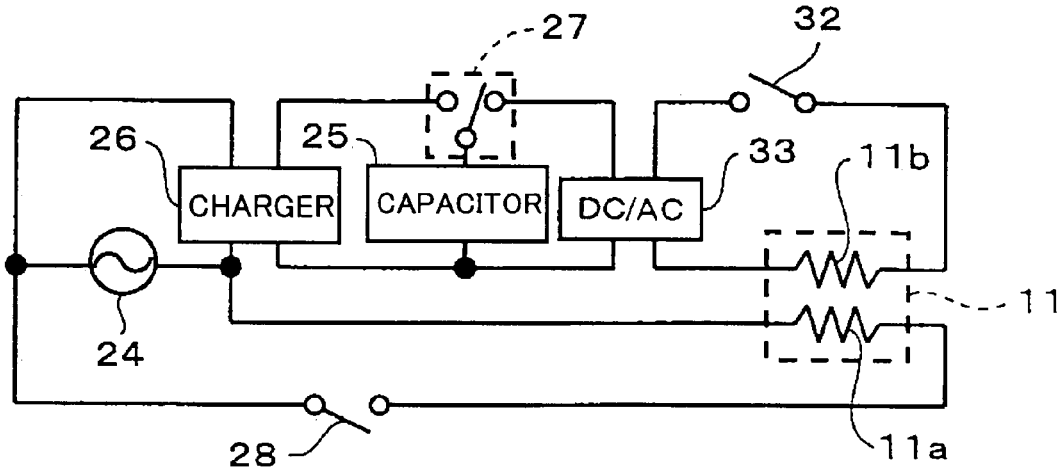
FIG. 16 is a schematic diagram showing Comparative Example 3 of the fixing apparatus for comparison purposes.

The DC power from the auxiliary power supply 25 that is a DC power supply provided through the charging/discharging switching means 27 and the switching means 32 is transformed into AC power by the DC/AC converter 33, and provided to the auxiliary heating unit 11*b*. The DC/AC converter 33 is capable of simple DC/AC conversion of the output of the auxiliary power supply 25 without special attention concerning the output voltage, or alternatively, is capable of DC/AC conversion and stepping-up or stepping-down. Here, the DC/AC converter 33 converts the DC voltage of 50 V provided by the auxiliary power supply 25 into an AC voltage of 50 V. The switching means 32 that turns on and turns off the power supply to the auxiliary heating unit 11*b* is installed on the input side of the DC circuit of the DC/AC converter 33. However, the switching means 32 may be installed on the output side, i.e., in the AC circuit of the DC/AC converter 33 as shown by FIG. 16, which shows Comparative Example 3 of the fixing apparatus.

An action and effect of Embodiment 10 are explained below. Here, voltages of various points in the "stop state" wherein the switching means 32 is turned off are considered. When the switching means 32 is provided in the DC circuit of Embodiment 10, points in the DC circuit are where the user and the maintenance person may encounter an electric shock from 50 V, if touched. Since power is not supplied to the DC/AC converter 33, potential is 0, and an electric shock is not a concern with the AC circuit.

When the switching means 32 is provided in the AC circuit of the Comparative Example 3, the user and the maintenance person may receive an electric shock of 50 V, if a part of the AC circuit or the DC circuit is touched. That is, although risk of an electric shock from the DC voltage of 50 V is present in Embodiment 10 and Comparative Example 3, there is no risk of an electric shock from the AC voltage of 50 V according to Embodiment 10.

According to "Electrician's Text" published by the Japan Electric Association, AC of a voltage is 4 times as dangerous as DC of the same voltage concerning electric shock to humans. As shown by the table of FIG. 20, in the case of direct current DC, a human starts feeling the electricity when the current is about 3.5 mA, and receives "a shock without pain" at about 6 mA. In the case of alternating current AC, about 3.5 mA current definitely causes "a shock without pain", and about 6 mA gives "a shock with pain".

Since human resistance ranges from 5 to 10 kohm, the electric shocks as described above are received at ranges between 18 and 35 V, and between 30 and 60 V, respectively, and the danger is about 4 times as great with AC. For this reason, according to Embodiment 10, even when a human receives an electric shock, the electric shock is by a direct current, and the safety of the human body is enhanced.

Thus, according to Embodiment 10, the auxiliary power supply is realized with greater safety. This is because direct current DC does not flow in a human body as easily as alternating current AC by a factor of about 4 in a voltage range less than 200 V, an auxiliary power supply based on AC having the same power supply capability and the same voltage being 4 times as dangerous as the DC of Embodiment 10.

Figure 17:
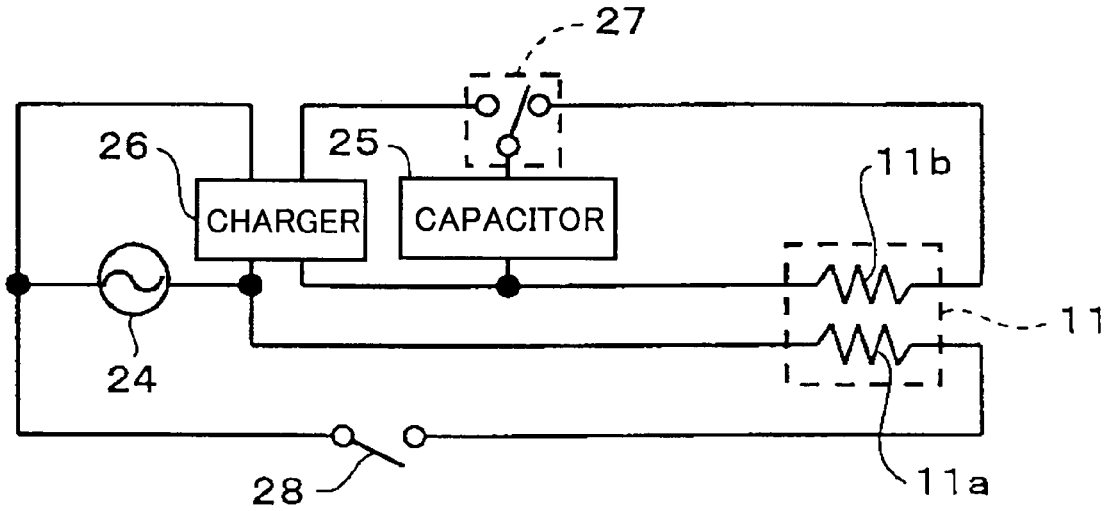
FIG. 17 is a schematic diagram showing the circuit configuration of the fixing apparatus according to Embodiment 11 of the present invention.

FIG. 17 shows a circuit configuration of the fixing apparatus according to Embodiment 11 of the present invention. Embodiment 11 is the same as Embodiment 9, except that the auxiliary heating unit 11*b* is used as the electric load for discharging the auxiliary power supply 25 instead of the resistor. The auxiliary heating unit 11*b* employs a halogen heater, and is capable of outputting 600 W.

The auxiliary heating unit 11*b* is capable of discharging, higher power than the mere resistor 31 employed in Embodiment 9, and can reduce the voltage of the auxiliary power supply 25 in a short period of time. For example, in the case that the auxiliary power supply 25 is capable of providing 600 W, the auxiliary heating unit 11*b* can step-down from 50 V to 30 V in about 1 minute, and the time required for stepping-down the output voltage of the auxiliary power supply 25 by electric discharging can be shortened to about ⅓. Further, in the case that the auxiliary power supply 25 is capable of outputting 1200 W, step-down of the auxiliary power supply 25 can be carried out in 30 seconds.

According to Embodiment 11, the auxiliary heating unit 11*b* is used as the electric load for discharging the auxiliary power supply 25, which is advantageous in that a measure for heat generated can be minimal. That is, the auxiliary heating unit 11*b* is designed with a premise that the temperature becomes high, and an apparatus for cooling the auxiliary heating unit 11*b* can be easily prepared.

When the auxiliary power supply 25 according to Embodiment 11, having a capacity of 25 F and outputting 50 V, was discharged, the temperature of the heating roller 11 was raised to about 120 degrees C. at the maximum, which temperature does not require a special temperature control to be prepared, and thermally safe electric discharging was available. In this manner, a safe heating apparatus is realized, without the apparatus becoming complicated.

Electric discharging operations of the auxiliary power supply 25 are activated by a maintenance person. For example, an operations panel of a copying machine often provides a special setting screen that only the maintenance person can set up, and it is also the case with Embodiment 11. According to Embodiment 11, when the maintenance person is to access the inside of the apparatus, and there is a possibility that the maintenance person may touch a high-voltage terminal of the auxiliary power supply 25, the maintenance person is to set up on the special setting screen such that the voltage of the auxiliary power supply 25 is lowered. Specifically, the charging/discharging switching means 27 is switched to the side of the heating unit 11*b*, the auxiliary power supply 25 discharges to the heating unit 11*b*, and the voltage of the auxiliary power supply 25 is lowered. In this manner, when safety precautions are fully implemented concerning a terminal that has a high voltage, useless electric discharge of the auxiliary power supply 25 is avoided.

Thus, according to Embodiment 11, an electric shock is prevented, and high safety is provided. Since power rating of a resistor tends to be small, electric discharge time is long. Accordingly, when a worker accesses the inside of the apparatus after a short period of time, the voltage of the auxiliary power supply 25 may not have fully fallen yet. In contrast, since the resistance of the heating unit 11*b*, used as the electric load, is small, it takes a shorter time for the auxiliary power supply 25 to discharge. In this manner, the voltage of the auxiliary power supply 25 can be reduced in a short time, and an apparatus that is safely workable without risk of an electric shock is realized.

Further, in the case that the auxiliary power supply is installed with precautions against danger, such as an inadvertent access being prevented, discharging of the auxiliary power supply every time the cabinet door is opened can waste power, and spoils user convenience because subsequent starting takes time. Since discharging of the auxiliary power supply 25 is to be activated by the maintenance person, useless electric discharging of the auxiliary power supply 25 is avoided, energy consumption can be lessened, and the user convenience is enhanced. In addition, even if the auxiliary power supply 25 is fully discharged, the temperature of the heating roller 11 does not exceed 180 degrees C., depending on the capacity of the auxiliary power supply 25, and there is no concern about a recording paper being burned.

Figure 18:
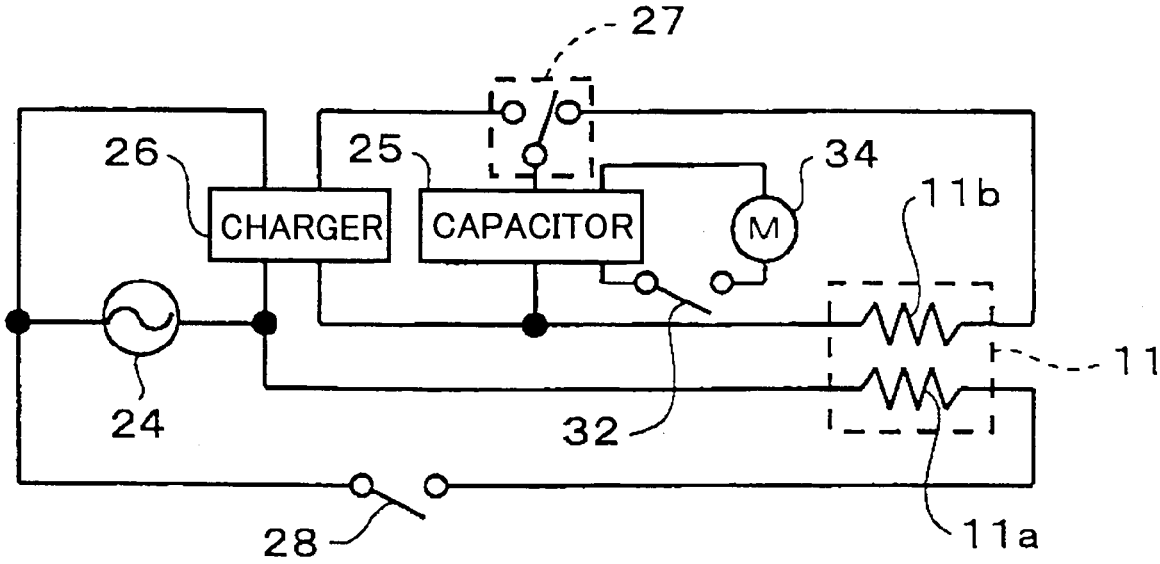
FIG. 18 is a schematic diagram showing the circuit configuration of the fixing apparatus according to Embodiment 12 of the present invention.

FIG. 18 shows a circuit configuration of the fixing apparatus according to Embodiment 12 of the present invention. Embodiment 12 is the same as Embodiment 9, except that a motor 34 is used instead of the resistor 31 as the electric load for discharging the auxiliary power supply 25. In this manner, the voltage of the auxiliary power supply 25 can be dropped while reducing heat generation inside the apparatus.

According to Embodiment 12, the energy of the auxiliary power supply 25 is consumed without generating heat, so that discharge of the auxiliary power supply can be carried out without raising temperature. In this manner, the voltage of the auxiliary power supply can be lowered without raising the temperature of the recording paper, even when the recording paper remains in the inside of the apparatus because of a recording paper jam, for example. Since the amount of heat generated is remarkably reduced, compared with the case where the resistor is used as the electric load for discharging the auxiliary power supply 25, even if the recording paper, etc., remains inside of such as the fixing apparatus, the temperature does not exceed the recording paper ignition point (about 300 degrees C.), and an apparatus that is safely workable without risk of an electric shock is realized.

Figure 19:
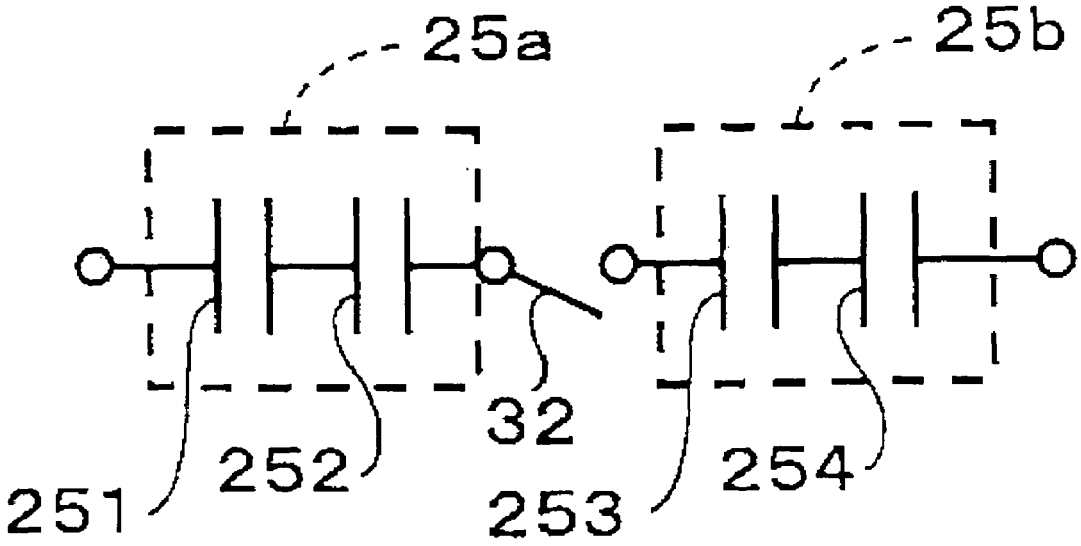
FIG. 19 is a schematic diagram showing the auxiliary power supply according to Embodiment 13 of the present invention.

FIG. 19 shows the auxiliary power supply according to Embodiment 13 of the present invention. Embodiment 13 is the same as Embodiment 9, wherein the auxiliary power supply 25 includes a plurality of auxiliary power supply modules 25*a* and 25*b* that are connected in series through the switching means 32. Each of the auxiliary power supply modules includes two or more capacitor cells connected in series, such as capacitor cells 251 and 252 for the auxiliary power supply module 25*a*; and capacitor cells 253 and 254 for the auxiliary power supply module 25*b*. Here, the number of capacitor cells included in each of the auxiliary power supply modules is not limited to two, but the number may be one, three and greater; further, the capacitor cells may be connected in series or in parallel.

The auxiliary power supply modules 25*a* and 25*b* are connected in series through the switching means 32 such that a large voltage is supplied to the heating unit 11*b*. By a predetermined direction, the switching means 32 disconnects the connection between the auxiliary power supply modules 25*a* and 25*b* such that only one of the auxiliary power supply modules 25*a* and 25*b* is connected to the heating unit 11*b*. The switching means 32 is normally closed, connecting the auxiliary power supply modules 25*a* and 25*b* in series. When the access detection means, such as an opening-and-closing detection switch of the cover of the case that contains the auxiliary power supply 25, etc., detects a predetermined access operation (opening of the cover), the connection between the auxiliary power supply modules 25*a* and 25*b* is disconnected such that only one of the auxiliary power supply modules 25*a* and 25*b* is connected to the heating unit 11*b*.

For example, the auxiliary power supply of Embodiment 13 is configured to provide 50 V by connecting two auxiliary power supply modules, each capable of providing 25 V, in series through the switching means 32, each of the auxiliary power supply modules including ten capacitor cells, each having a capacity of 500 F at 2.5 V, in series. Although the capacitor cells inside the auxiliary power supply modules 25*a* and 25*b* are not arranged for separation (disconnection), the auxiliary power supply modules 25*a* and 25*b* can be separated (disconnected) by the switching means 32 such that only one of the auxiliary power supply modules 25*a* and 25*b* is connected to the heating unit 11*b*.

In this manner, when the maintenance person and the user access the inside of the image forming apparatus, the auxiliary power supply modules 25*a* and 25*b* can be disconnected such that only one of the auxiliary power supply modules 25*a* and 25*b* is connected to the heating unit 11*b*. That is, the voltage of the terminal of the auxiliary power supply 25 drops from 50 V to 25 V, instantly preventing the risk of an electric shock.

Although the terminal voltage of 50 V of the auxiliary power supply 25 is equally divided into two sections in the present embodiment, the terminal voltage may be divided into three or more sections such that the voltage of each of the auxiliary power supply modules is further lowered. Further, the terminal voltage of 50 V may be divided into different voltage sections like 20 V and 30 V. This configuration allows the use of a battery, such as a lithium ion battery, the voltage of which does not fall with discharge, besides the capacitor, for the auxiliary power supply.

Thus, according to Embodiment 13, the high voltage of the auxiliary power supply 25 is divided by a plurality of auxiliary power supply modules, each module providing a lower voltage. In this manner, the voltage of the power output terminal of the auxiliary power supply can be lowered, and the apparatus that is safely workable without risk of an electric shock is realized. In this case, since electric discharge of the auxiliary power supply does not occur, time to change into a safe state is short, and there is no waste of power. Further, even if batteries, such as lithium ion batteries, fuel capacitor cells, etc., the voltages of which do not fall with discharging, are used as the auxiliary power supply 25, an apparatus that is safely workable without risk of an electric shock is realized.

Figure 21:
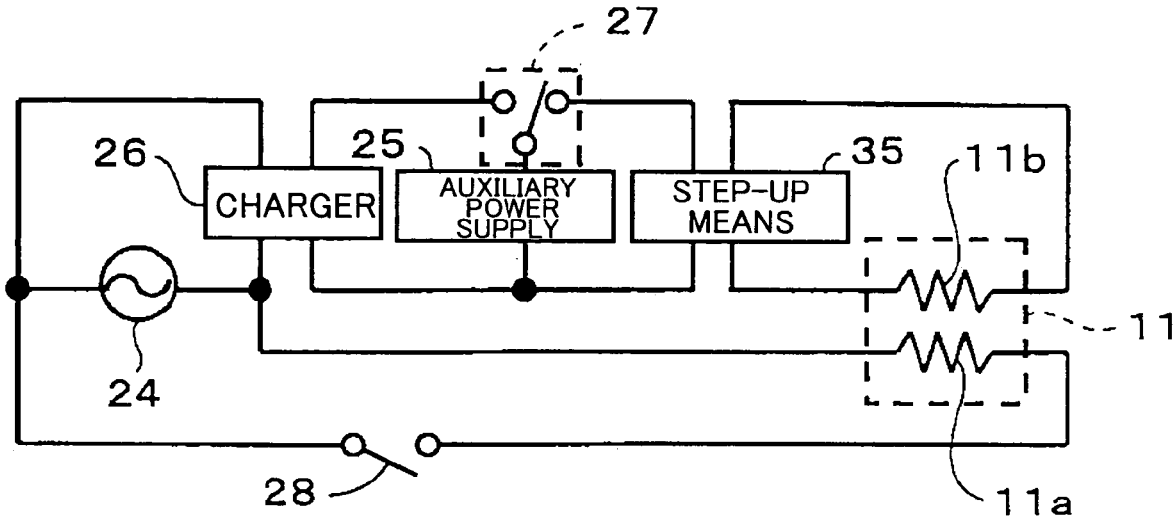
FIG. 21 is a schematic diagram showing the circuit configuration of the fixing apparatus according to Embodiment 14 of the present invention.

FIG. 21 shows a circuit configuration of the fixing apparatus according to Embodiment 14 of the present invention. Embodiment 14 is the same as Embodiment 9, except that the resistor 31 and the switching means 32 are omitted, and instead, a step-up means 35 is included. The input side of the step-up means 35 is connected to the auxiliary power supply 25 through the charging/discharging switching means 27, and the output side of the step-up means 35 is connected to the heating unit 11*b*.

The auxiliary power supply 25 is configured by, e.g., two or more capacitor cells connected in series, each of the capacitor cells having a capacity of 1300 F and providing 2.5 V. The power from the auxiliary power supply 25 is provided through the charging/discharging switching means 27 to the step-up means 35 for stepping-up the voltage for providing the stepped-up voltage to the heating unit 11*b*.

Figure 22:
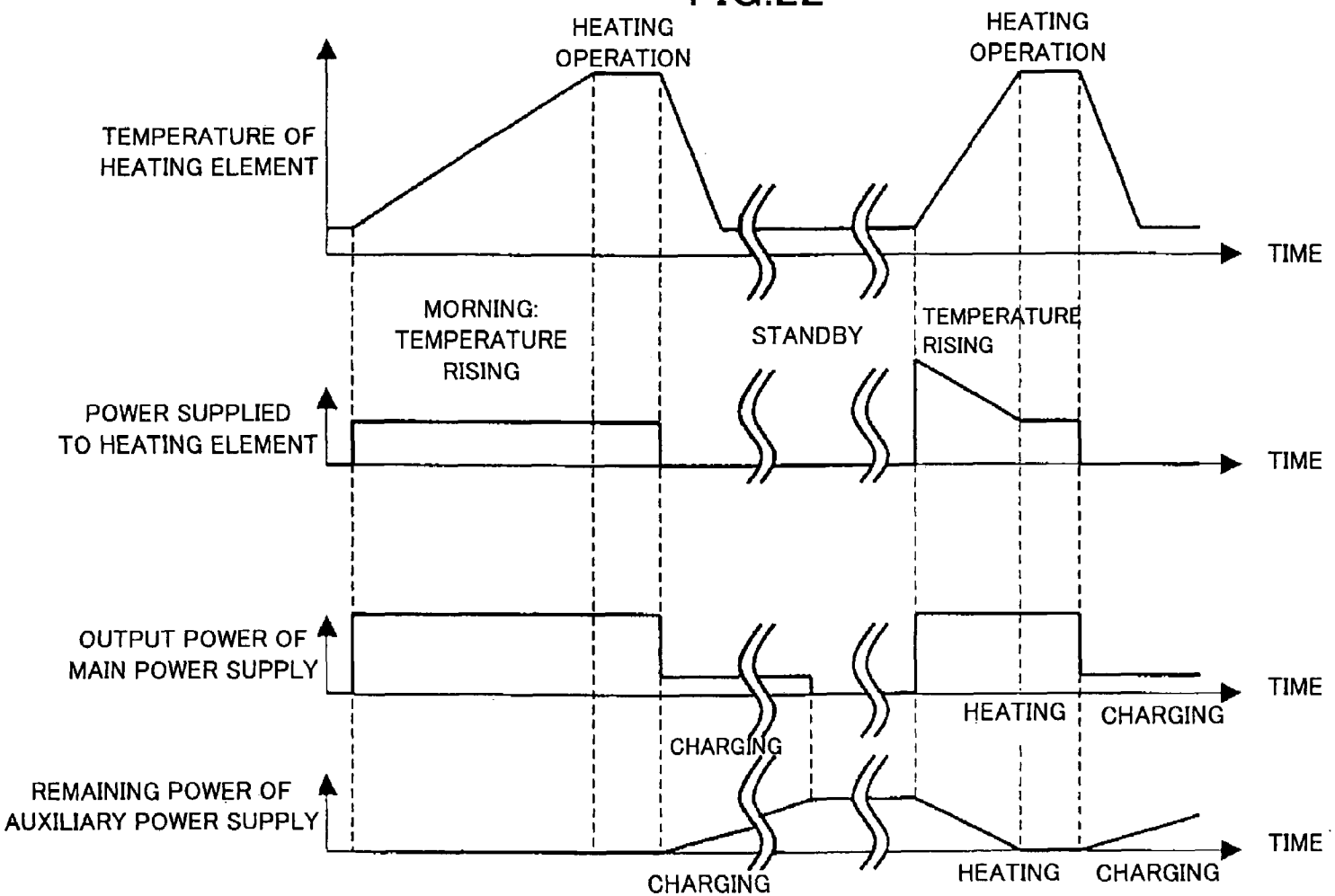
FIG. 22 is a timing diagram showing a Comparative Example of heating operations of the fixing apparatus according to Embodiment 14 of the present invention.

FIG. 22 shows an example of operations according to Embodiment 14. According to Embodiment 14, high-speed temperature rise of the heating roller 11 is possible, and the charge time of the auxiliary power supply 25 is short. Accordingly, the first thing in the morning when the auxiliary power supply 25 consisting of a mass capacitor that can be quickly charged, using an electric double layer capacitor, and the like, is not fully charged, and the main power supply 24 is turned on, only the heating unit 11*a* is heated using the commercial power supply. Then, during the standby mode when the temperature of the heating roller 11 does not have to be high, the main power supply 24 provides power to the auxiliary power supply 25 through the charger 26, and the charging/discharging switching means 27 such that charging is carried out.

When high power is needed as when the temperature of the heating roller 11 has to be raised, power is supplied to heating unit 11*b* from the auxiliary power supply 25 through the charging/discharging switching means 27, and the step-up means 35, while the main power supply 24 provides the power to the heating unit 11*a* through the main power control means 28. In this manner, the temperature of the heating roller 11 rises in a shorter period of time than the case where only the heating unit 11*a* is heated by the power from the main power supply 24.

When a capacitor is used in the auxiliary power supply 25, an important feature is that a predetermined amount of energy of the auxiliary power supply 25 is used up, and a configuration that safely realizes a fast temperature rise of the heating roller 11 is offered.

As for simply increasing the power supplied to a heating roller, methods are conceivable, such as that a power supply may be constituted by two lines (systems), and that power may be increased using a rechargeable battery, a fuel capacitor cell, etc. When these methods are employed, a safeguard, such as a temperature fuse and a thermostat, for interrupting the power supply circuit is indispensable such that the power supply is immediately interrupted to prevent the system from running out of control. As the temperature rising time of the heating roller becomes short, the reaction time of the safeguard becomes relatively longer, and the safeguard cannot catch up with the temperature rising speed of the heating roller. This causes the temperature of the heating roller to rise too high before the time when the safeguard kicks in, and in the worst case, a recording paper may ignite.

Conversely, when a configuration employs a capacitor as an auxiliary power supply, even when the system runs out of control, predetermined energy of the capacitor is used up, the power from the capacitor to a heating element stops flowing, and temperature rise of the heating roller is automatically stopped. For this reason, quick temperature rise of the heating roller is safely realizable by using a capacitor as the auxiliary power supply.

Thus, the effect that is not acquired with a rechargeable battery can be acquired by using a capacitor as an auxiliary power supply of the fixing apparatus.

Here, the temperature rise of a heating roller made from aluminum of 1 mm of thickness having a diameter of 30 mm, for example, is considered. The temperature of the heating roller can rise to a predetermined temperature, about 180 degrees C., in 10 seconds. The amount of heat required to raise the temperature to about 180 degrees C. is about 12,000 J. A halogen heater normally used by conventional fixing apparatuses is rated at about 1200 W at 100 V. Accordingly, the halogen heater can raise the temperature of the heating roller in about 10 seconds.

Figure 23:
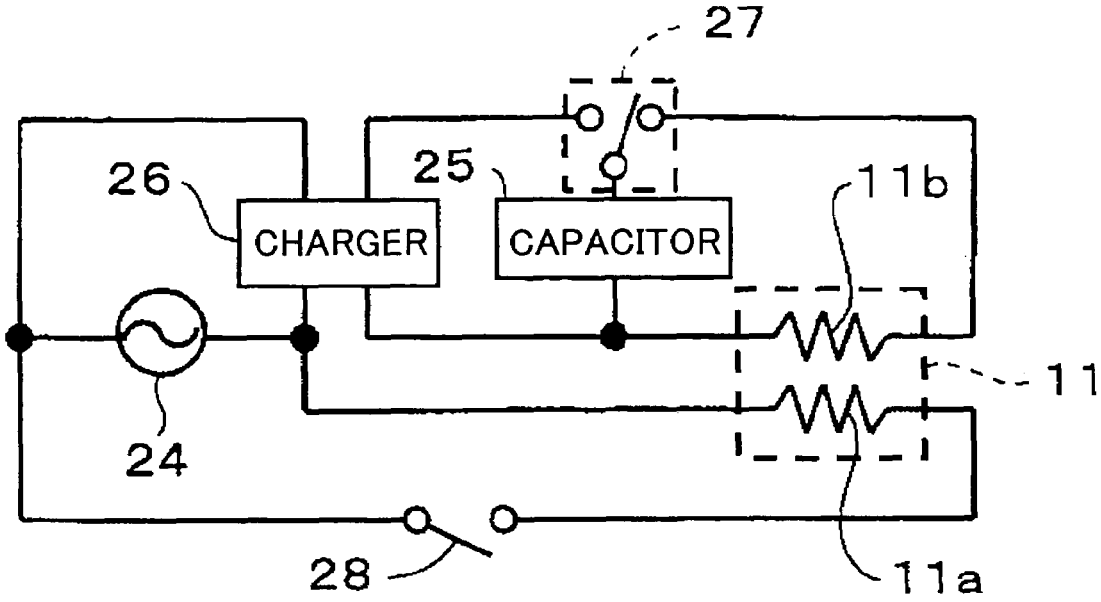
FIG. 23 is a schematic diagram showing a Comparative Example of circuit configuration of the fixing apparatus for comparison purposes.

Next, the temperature rise in the case of the heating roller 11 is considered, wherein an auxiliary power supply uses an electric double layer capacitor that is constituted by two or more capacitors, each having a capacity of 1300 F at 2.5 V, which are connected in series. According to a configuration as shown by FIG. 23, which is a comparative example for comparing with Embodiment 14, the configuration does not employ the step-up means 35. In the comparative example, the voltage of the electric double layer capacitor of the auxiliary power supply 25 is set at the high voltage of 50 V, and a halogen heater rated at 12 A is used as the heating unit 11*b*. Accordingly, power of 600 W can be taken out from the electric double layer capacitor. In addition to the 600 W of power, 1200 W of power from the commercial power supply, i.e., a total of 1800 W, can be supplied to the heating roller 11, and the temperature rise time of the heating roller 11 is shortened to about 6 seconds from the conventional 10 seconds.

However, since this fixing apparatus does not use the step-up means 35, it is necessary to connect 20 capacitor cells, each being capable of 2.5 V, in series to obtain 50 V for the auxiliary power supply 25. By this arrangement, the energy that the auxiliary power supply 25 holds amounts to about 80,000 J. However, for the temperature of the heating roller 11 to rise, about ⅙ of the energy is necessary. That is, as far as energy is concerned, energy of only three capacitor cells connected in series is sufficient. Furthermore, when supplying the power of 600 W to the heating roller 11 for 10 seconds, it takes out only about 6000 J from the auxiliary power supply 25. This represents a little less than 8% of the 80,000 J of energy that the auxiliary power supply 25 holds.

Thus, if the auxiliary power supply of the fixing apparatus employs this configuration, wherein two or more capacitor cells are connected in series for simply raising the voltage of the auxiliary power supply, an excessive quantity of capacitor cells are needed. Further, it is difficult to take out the electric energy held within a short period of time for raising the temperature of the heating roller 11. As the result, the number of capacitor cells of the auxiliary power supply is increased, volume becomes large, and cost is also increased.

Next, in the case that step-up means is used by the auxiliary power supply using the electric double layer capacitor for heating the heating unit of the fixing apparatus, power of low voltage and large current from the auxiliary power supply can be converted to power of high voltage and small current by using an IGBT element, and the like. For example, like Embodiment 14 (FIG. 21), eight capacitor cells of 2.5 V are connected in series in order to obtain 20 V for the auxiliary power supply. Assuming a current rating of 60 A, power of 1200 W is available from the auxiliary power supply. The power can be converted to 100 V and 12 A by using the step-up means 35. The eight capacitor cells of the auxiliary power supply hold energy equivalent to 32,500 J. Accordingly, when 1200 W are used for 10 seconds, a little less than 12,000 J are used. This represents 36% of the energy that the capacitor cells of the auxiliary power supply hold, and represents 4.5 times as high use efficiency as the 8% that is the use efficiency at the time of simply connecting the 20 capacitor cells in series.

Thus, higher power becomes available from fewer capacitor cells by using the step-up means 35. In the above example of the fixing apparatus using the eight capacitor cells, 1200 W came to be available, comparing with only 600 W being conventionally available using 20 capacitor cells. Two remarkable advantages are present. One of them is that high power is available, and it can further shorten the temperature rise time of the heating roller. The other is that the number of capacitor cells becomes smaller, reducing the weight and the volume of the capacitor cells, and greatly reducing the cost of the capacitor cells. With the fixing apparatus using eight capacitor cells, the number of the capacitor cells decreases to below a half compared with the fixing apparatus that uses 20 capacitor cells.

Thus, although the power that can be supplied to the heating roller is conventionally restricted to 1200 W that is the maximum of the power supply from the conventional commercial power supply, a fixing apparatus having a configuration that can shorten the temperature rise time of the heating roller by increasing the power supplied to the heating roller to 1800 W or greater, such as 2000 W, is realized. Not only that, according to Embodiment 14, the configuration is such that the step-up means 35 increases supply voltage from the auxiliary power supply 25 to the heating unit 11*b*, thereby enhancing the use efficiency of the energy held by the capacitor cells of the auxiliary power supply 25, reducing the number of required capacitor cells, and reducing the volume of the auxiliary power supply 25. Furthermore, it is possible to make an installation space smaller, and to reduce the cost of the auxiliary power supply.

Thus, according to Embodiment 14, since the number of capacitor cells of the auxiliary power supply 25, which capacitor cells are connected in series in order to secure the high voltage to be supplied to the heating unit 11*b*, is reduced, the auxiliary power supply 25 for shortening temperature rise time of the heating roller 11 is miniaturized.

Further, even when the system becomes out of control, the power supply from the auxiliary power supply 25 to the heating unit 11*b* automatically declines after a fixed time. In this manner, there is no risk of the temperature of the heating roller 11 becoming too high, and a heating apparatus that is capable of raising the temperature in a short period of time providing safety at the time of a system runaway is realized.

Further, since the voltage to the heating unit 11*b* is high, even if the maximum current that flows to the heating unit 11*b* is small, high power can be supplied to the heating unit 11*b*, and the temperature of the heating roller 11 is raised in a short period of time.

Further, since a maximum supply power exceeding the limit of the supply power of the commercial power supply can be supplied to the heating apparatus, the heating apparatus with a short starting time can be offered.

Figure 24:
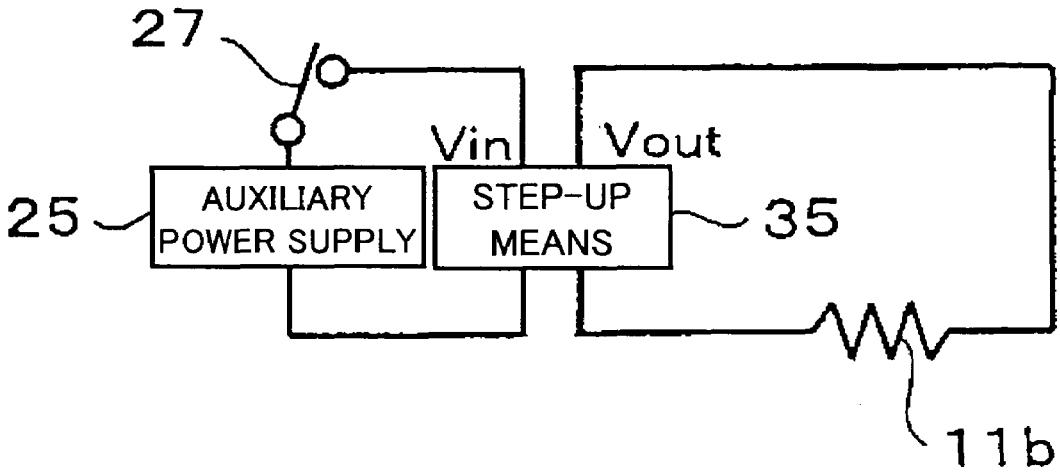
FIG. 24 is a schematic diagram showing a part of circuit configuration of the fixing apparatus according to Embodiment 15 of the present invention.
Figure 25:
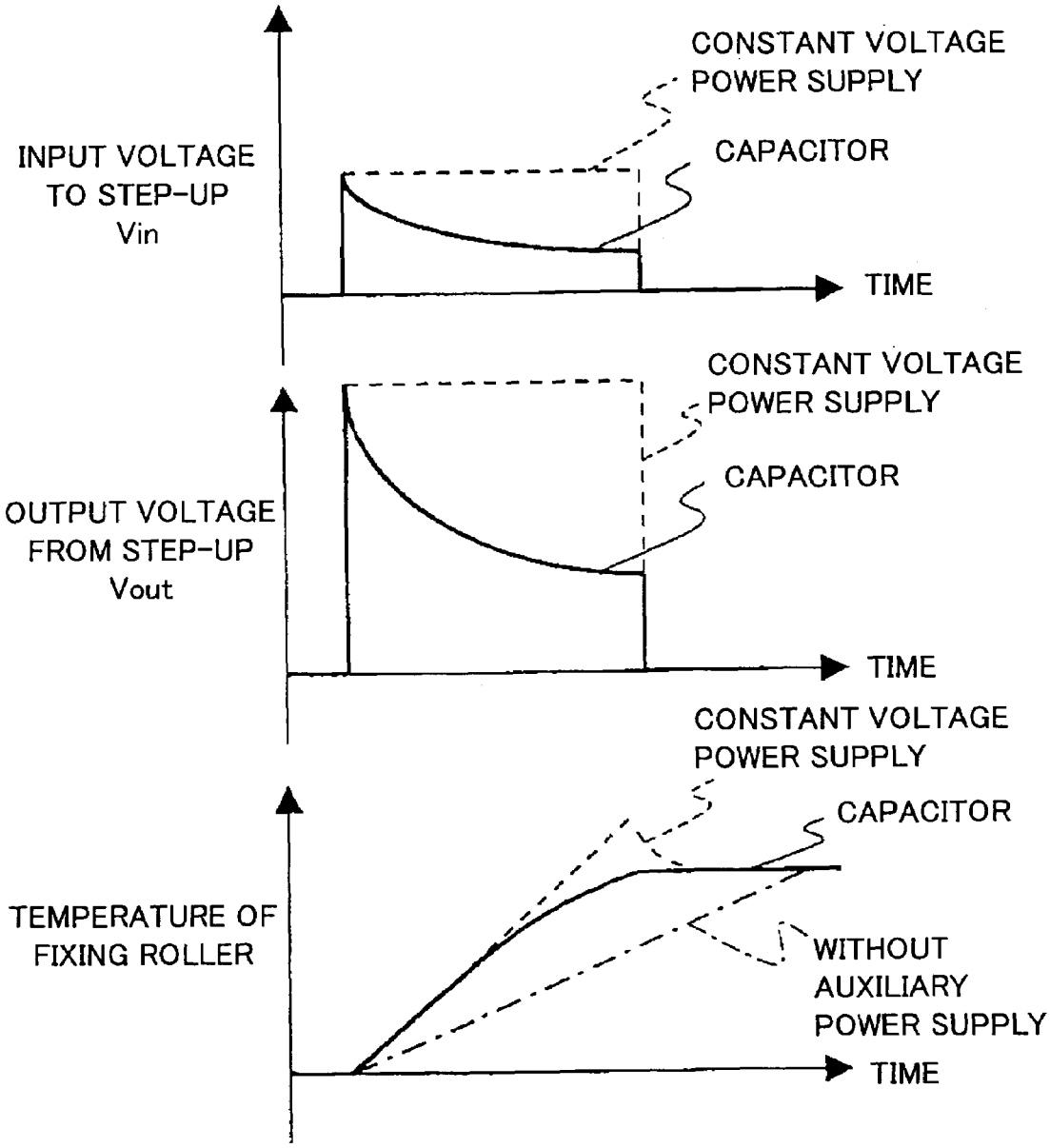
FIG. 25 is a set of graphs showing temporal changes of an input voltage Vin, an output voltage Vout, and the temperature of the heating roller concerning a step-up means according to Embodiment 15 of the present invention.

FIG. 24 shows a part of a circuit configuration of the fixing apparatus according to Embodiment 15 of the present invention. FIG. 25 shows temporal changes of an input voltage Vin to the step-up means 35 in Embodiment 15, an output voltage Vout to the auxiliary heating unit 11*b* from the step-up means 35, and the surface temperature of the heating roller 11. Embodiment 15 is the same as Embodiment 14, except for differences that are described below.

In order to shorten the temperature rise time of the heating roller 11, what is necessary is to increase the power supplied to the heating unit 11*b*. For example, the commercial power supply of 200 V or constant voltage power supply, such as a rechargeable battery, may be used for the power supply apparatus that supplies power to the heating unit 11*b*. However, if the power supplied to the heating unit 11*b* is too high, there is a problem that the temperature of the heating roller 11 tends to overshoot.

With Embodiment 15, the input voltage Vin of the step-up means 35 falls as time elapses, which is the nature of the capacitor used by the auxiliary power supply 25. The output voltage Vout of the step-up means 35 is not controlled against variation of the input voltage Vin, and the magnification, i.e., the ratio of the output voltage Vout to the input voltage Vin, of the step-up means 35 stays constant. For this reason, while the circuit is simplified, the overshooting of the temperature of the heating roller 11 at the time of the temperature rise is prevented.

The circuit is simplified because there is no need for especially preparing detection means for control, and compensating for a drop of the input voltage Vin of the auxiliary power supply 25 by raising the magnification of the step-up means. Further, when the temperature of the heating roller 11 is low, full power is supplied to the heating unit 11*b*, and when the temperature of the heating roller 11 is high, the power to the heating unit 11*b* is automatically reduced, preventing the overshooting of the temperature of the heating roller 11 from occurring.

This is because when the temperature of the heating roller 11 is being raised, the power from the auxiliary power supply 25 is consumed while the temperature of the heating roller 11 goes up, as shown by FIG. 25, the supply voltage to the heating unit 11*b* decreases, and the total power supplied to the heating units 11*a* and 11*b* is gradually reduced. In this manner, when the temperature of the heating roller 11 is low, like immediately after electric supply to the heating units 11*a* and 11*b* being started, the highest available power is supplied to the heating units 11*a* and 11*b*; and when the temperature of the heating roller 11 is high, as the electric discharge of the auxiliary power supply 25 progresses, the voltage of the auxiliary power supply 25 drops, and the supply power of the auxiliary power supply 25 is automatically decreased.

Next, Embodiment 15 is specifically explained. Suppose that the auxiliary power supply 25 includes eight capacitor cells, each having a capacity of 1300 F, connected in series; and the step-up means 35 increases the input voltage Vin of 20 V to 100 V, and supplies 1200 W to the auxiliary heating unit 11*b*. Assuming that the step-up means 35 does not cause a loss, and has a fixed magnification, the input voltage Vin of the step-up means 35 falls to 13 V in 30 seconds, and then, the power supplied to the auxiliary heating unit 11*b* becomes about 400 W. Accordingly, in the case that the main power supply 24 supplies 1200 W to the main heating unit 11*a*, a total of 2400 W is supplied to the heating units 11*a* and 11*b* when the temperature of the heating roller 11 is low; and as the temperature of the heating roller 11 rises, the total power supplied to the heating units 11*a* and 11*b* drops to about 1600 W.

In this manner, Embodiment 15 prevents the temperature overshoot, wherein the temperature rise of the heating roller is too quick and too much, which overshoot is the problem of a configuration that employs a constant voltage power supply as the auxiliary power supply. Further Embodiment 15 is effective in shortening the temperature rise time of the heating roller 11 since the power to the auxiliary heating unit 11*b* is high, when the temperature of the heating roller 11 is low.

Thus, according to Embodiment 15, the circuit is simplified, and the temperature overshoot is prevented from occurring, with no complicated controls.

Figure 26:
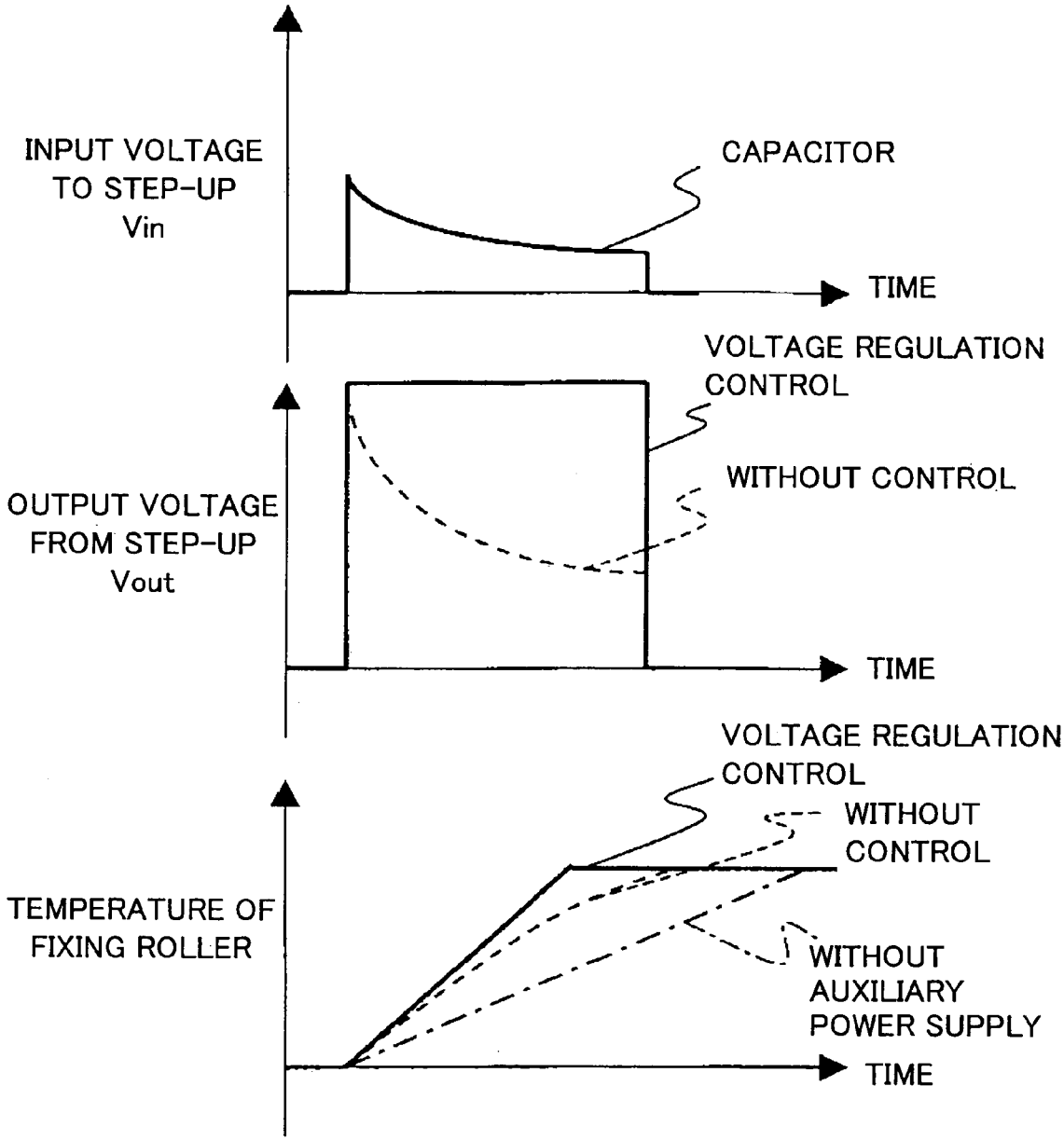
FIG. 26 is a set of graphs showing temporal changes of an input voltage Vin, an output voltage Vout, and the temperature of the heating roller concerning a step-up means according to Embodiment 16 of the present invention.

FIG. 26 shows an example of the temporal changes of the input voltage Vin input to the step-up means 35, the output voltage Vout output to the auxiliary heating unit 11*b* from the step-up means 35, and the temperature of the heating roller 11 according to Embodiment 16 of the present invention. Embodiment 16 is the same as Embodiment 14, except for the difference that is described next.

First, the case where the output voltage Vout of the step-up means 35 is not controlled is considered, wherein the auxiliary power supply 25 includes eight capacitor cells, each having a capacity of 1300 F, connected in series, and the step-up means 35 increases the input voltage Vin of 20 V to 100 V, providing 1200 W to the auxiliary heating unit 11*b*, assuming that the step-up means 35 causes no loss, and has a fixed magnification. The input voltage Vin to the step-up means 35 drops to 13 V in 30 seconds, and the power supplied to the auxiliary heating unit 11*b* is decreased to about 400 W.

Accordingly, if the power supplied to the main heating unit to 11*a* is set at 1200 W, the total power supplied to the heating units 11*a* and 11*b* is 2400 W when the temperature of the heating roller 11 is low; and the total power is decreased to about 1600 W as the temperature of the heating roller 11 is raised. In order to further shorten the temperature rise time of the heating roller 11, the step-up means 35 is to be controlled to provide a fixed output voltage Vout such that the supply power to the auxiliary heating unit 11*b* is made almost constant.

Then, according to Embodiment 16, the step-up means 35 includes a control means for controlling the magnification of step-up as the input voltage Vin falls to 13 V. In this manner, the power supplied to the heating roller 11 is increased, and the temperature rise time of the heating roller 11 is shortened. Here, the control means can be provided outside of the step-up means 35.

Thus, according to Embodiment 16, high power can be supplied to the heating unit 11*b*, and the temperature rise time of the heating roller 11 is shortened.

Figure 27:
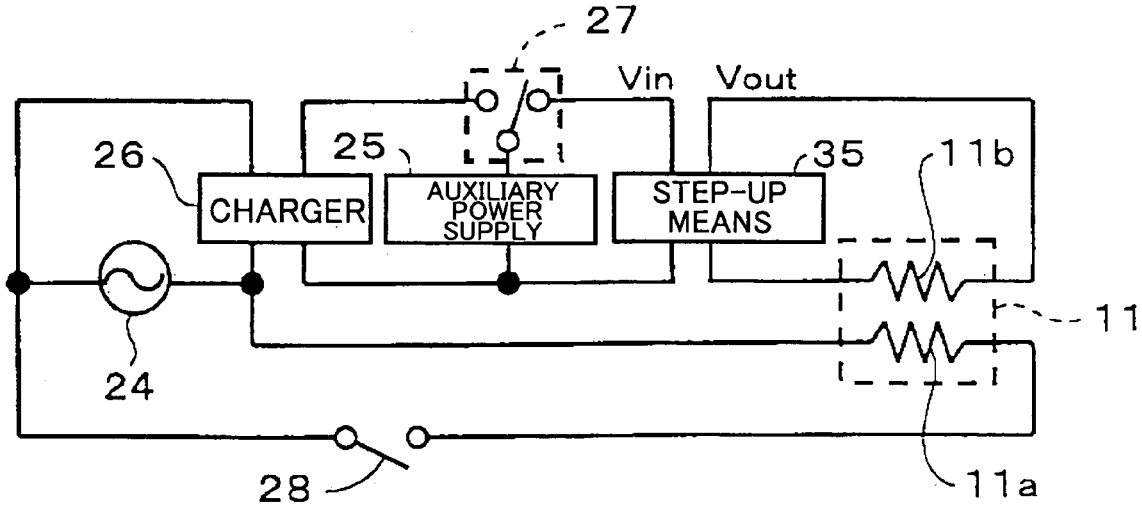
FIG. 27 is a schematic diagram showing the circuit configuration of the fixing apparatus according to Embodiment 17 of the present invention.
Figure 28:
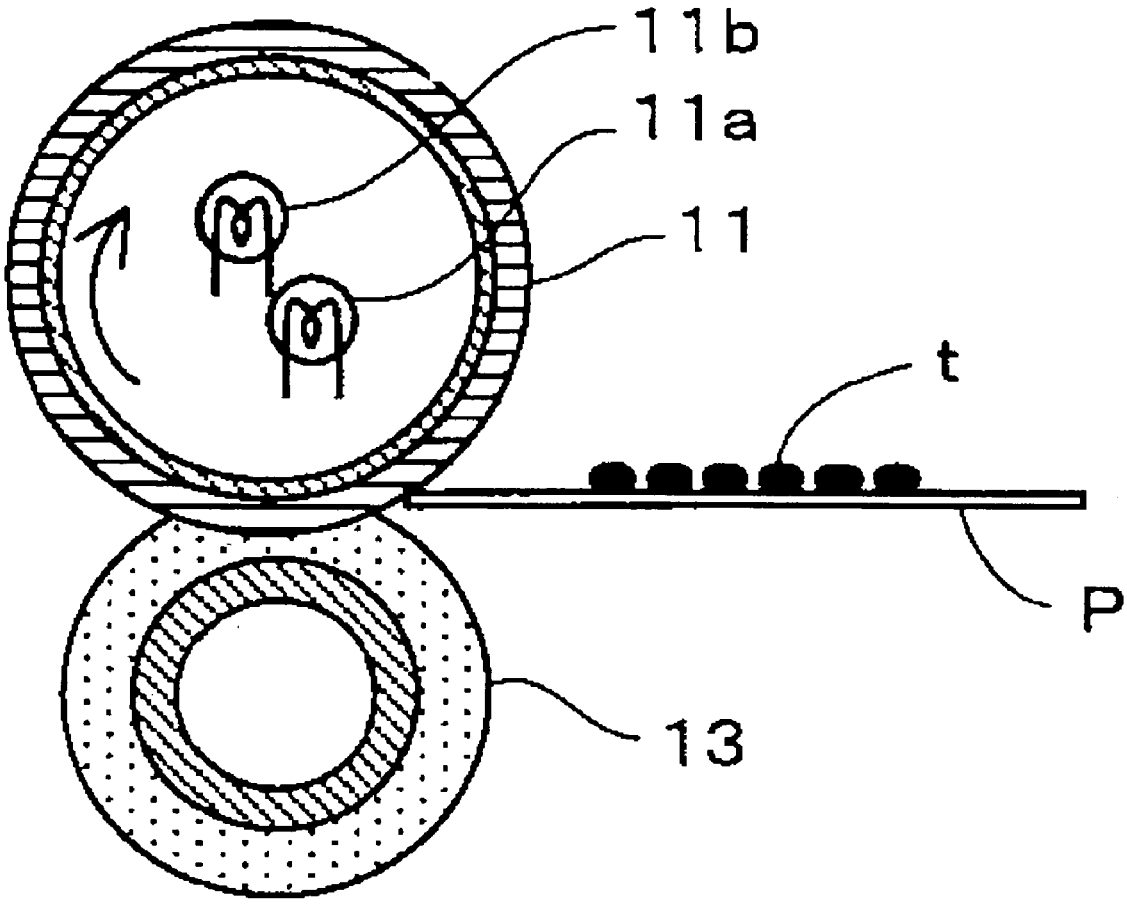
FIG. 28 is a cross-sectional view showing the outline of the fixing apparatus according to Embodiment 17 of the present invention.

FIG. 27 shows a circuit configuration of the fixing apparatus according to Embodiment 17 of the present invention, and FIG. 28 shows an outline of this fixing apparatus. Embodiment 17 is the same as Embodiment 14, except for the difference described below. Each of the main heating unit 11*a* and the auxiliary heating unit 11*b* includes a halogen heater, radiant heat of which heats the heating roller 11 that includes a metal roller. The auxiliary heating unit 11*b* has a resistance that is lower than the main heating unit 11*a*, and is capable of passing a large current.

The heating roller 11 is desirably made from metal, such as aluminum and iron, from viewpoints of durability and strength against deformation by pressurization. Further, it is desirable to form a demolding layer for preventing adherence of toner on the surface of the heating roller 11. It is also desirable that the inside of the heating roller 11 be blackened such that the heat of the halogen heaters (heating units) 11*a* and 11*b* is efficiently absorbed.

The main heating unit 11*a* is capable of providing a 1200 W output by passing 10 A at 100 V, while the auxiliary heating unit 11*b* is capable of providing a 1440 W output by passing 12 A at 120 V. Although the voltage to the main heating unit 11*a* is set as 100 V by the commercial power supply, since the voltage of the auxiliary heating unit 11*b* can be made high by increasing the setting magnification of the step-up means 35, the auxiliary heating unit 11*b* can provide higher power.

By providing the auxiliary heating unit 11*b* with a halogen heater having power that is higher than the power supplied to the main heating unit 11*a*, the temperature rise time of the heating roller 11 can be shortened. Further, the energy that the auxiliary power supply 25 holds can be consumed without waste within a short period of time.

Thus, according to Embodiment 17, since high power can be supplied to the auxiliary heating unit 11*b*, it is possible to use up the energy stored by the auxiliary power supply 25 in a short period of time, and shortening of the temperature rise time of the heating roller 11 is realized.

Further, since the voltage to the halogen heater unit 11*b* is high, even if the maximum current that can flow through the halogen heater unit 11*b* is small, it is possible to supply high power to the halogen heater unit 11*b*, and it is possible to shorten the temperature rise time of the heating roller 11.

Figure 29:
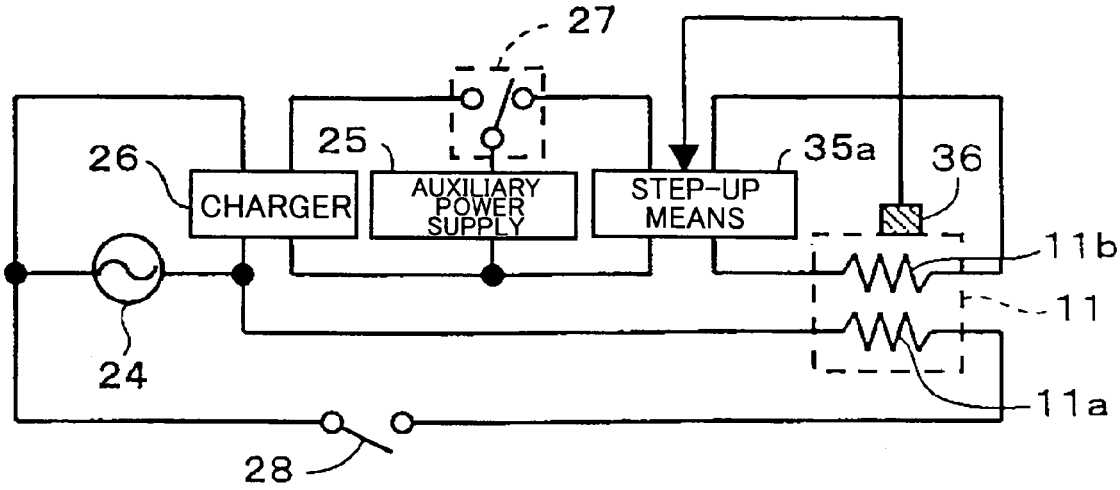
FIG. 29 is a schematic diagram showing the circuit configuration of the fixing apparatus according to Embodiment 18 of the present invention.

FIG. 29 shows a circuit configuration of the fixing apparatus according to Embodiment 18 of the present invention. Embodiment 18 is the same as Embodiment 14, except that step-up means 35*a* is prepared instead of the step-up means 35. The input side of the step-up means 35*a* is connected to the auxiliary power supply 25 through the charging/discharging switching means 27, and the output side of the step-up means 35*a* is connected to the heating unit 11*b*.

The auxiliary power supply 25 is structured, for example, by connecting two or more capacitor cells of 1300 F and 2.5 V in series. Power from the auxiliary power supply 25 through the charging/discharging switching means 27 is stepped-up in voltage by the step-up means 35*a*, and is supplied to the heating unit 11*b*. Temperature detection means 36 detects the surface temperature of the heating roller 11. The step-up means 35*a* includes control means for controlling the step-up magnification and timing thereof, i.e., when and how much the input voltage from the auxiliary power supply 25 is to be stepped-up based on a detection signal from the temperature detection means 36. The control means may be prepared outside the step-up means 35*a*.

Figure 30:
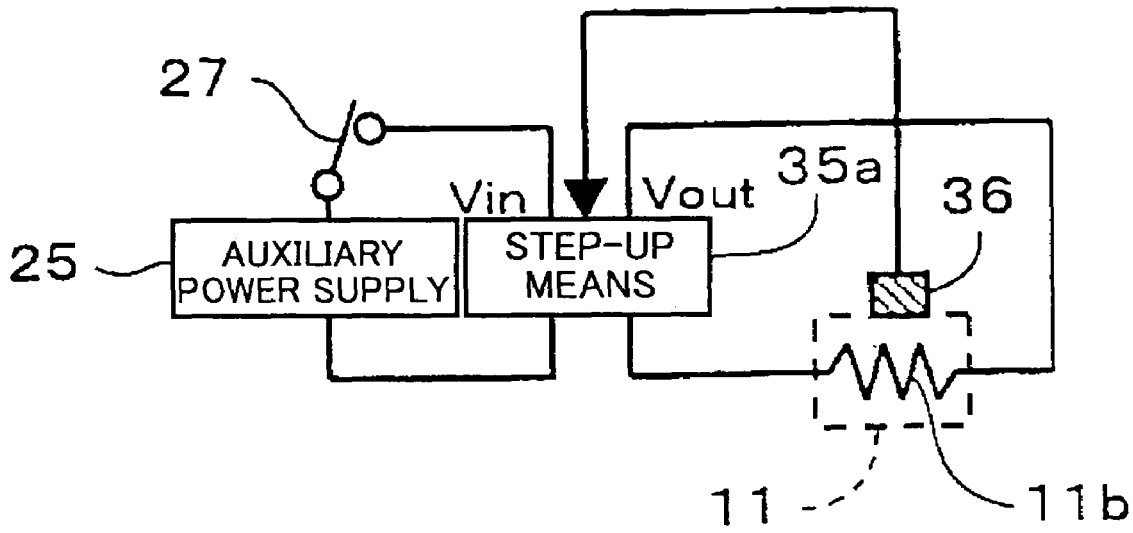
FIG. 30 is a schematic diagram showing a part of the circuit configuration of the fixing apparatus according to Embodiment 17 of the present invention.
Figure 31:
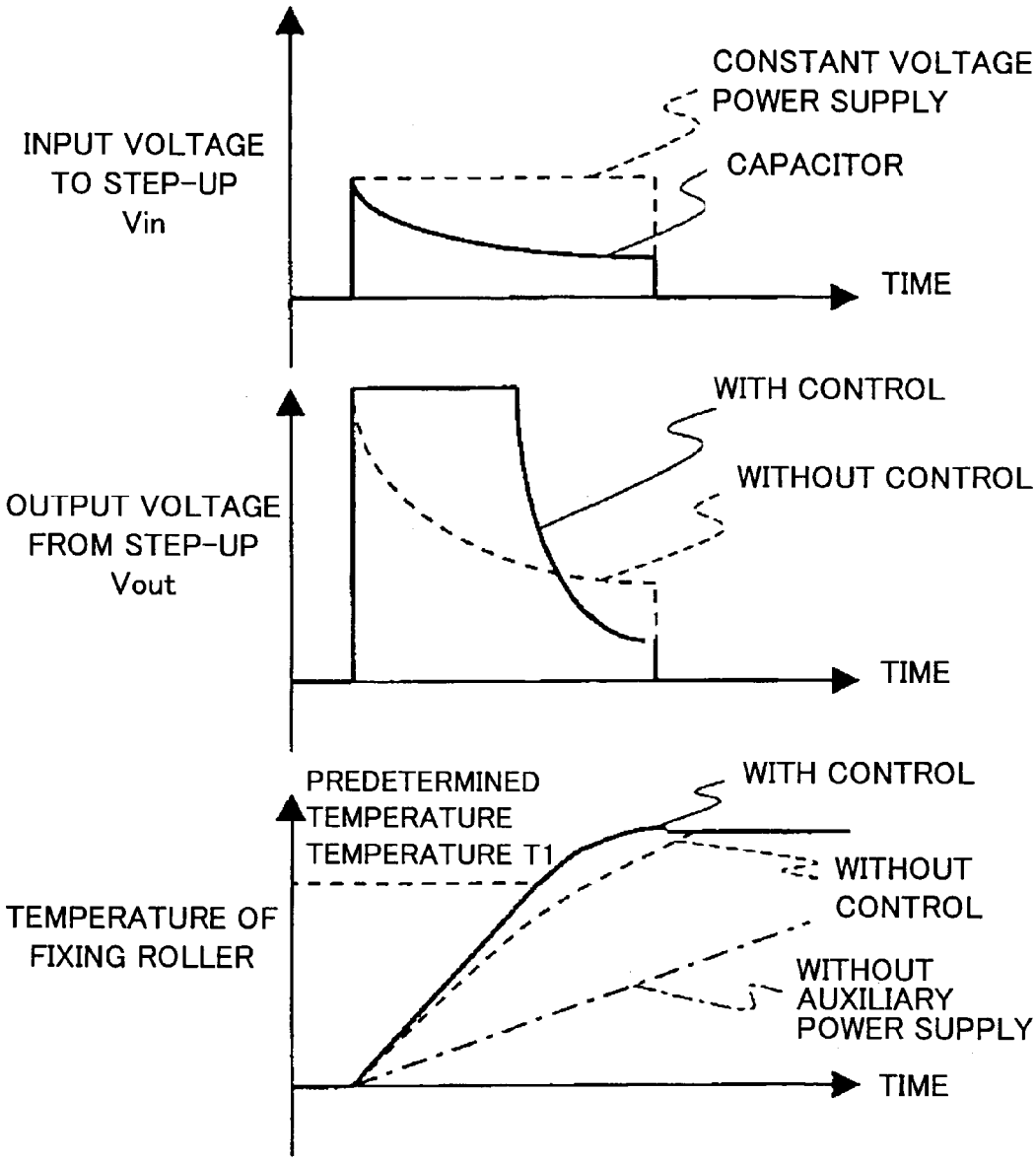
FIG. 31 is a set of graphs showing a Comparative Example of operations of the fixing apparatus according to Embodiment 18 of the present invention.

As shown by FIG. 30, the step-up means 35*a* through the control means changes the step-up magnification setup based on the information from the temperature detection means 36 that detects the temperature of the heating roller 11 that is heated by the auxiliary heating unit 11*b*. FIG. 31 shows temporal changes of the input voltage Vin that is input to the step-up means 35*a* from the auxiliary power supply 25, the output voltage Vout that is output to the auxiliary heating unit 11*b* from the step-up means 35*a*, and the temperature of the heating roller 11.

In order to shorten the temperature rise time of the heating roller 11, what is necessary is to increase the power supplied to the auxiliary heating unit 11*b*. For example, a power supply apparatus that supplies power to the auxiliary heating unit 11*b* can use a commercial power supply of 200 V, or a constant voltage power supply, such as a rechargeable battery, and the like. However, if the power supplied to the auxiliary heating unit 11*b* is increased too much, detection time delay of the temperature detection means 36 poses a problem in that the temperature of the heating roller 11 overshoots. According to Embodiment 18, wherein a capacitor of the auxiliary power supply 25 is used as the means for increasing the power supplied to the auxiliary heating unit 11*b*, the step-up means 35*a* through the control means reduces the output voltage Vout from a predetermined voltage, when the temperature of the heating roller 11 reaches a predetermined temperature T1 in order to prevent the temperature overshoot of the heating roller 11.

In this manner, the temperature overshoot of the heating roller 11 at the time of temperature rise is reliably reduced, regardless of the temperature of the heating roller 11 before the power is supplied. This functions effectively, especially when the temperature of the heating roller 11 is relatively high, such as when the image forming apparatus of Embodiment 18 is to be used soon after the previous use.

Thus, according to Embodiment 18, when the temperature of the heating roller 11 is high, since the supply voltage to the auxiliary heating unit 11*b* is lowered and the power supply to the heating roller 11 is lessened, the temperature rise of the heating roller 11 is eased. For this reason, even if there is time delay of the temperature detection by the temperature detection means 36, the temperature detection of the heating roller 11 can be correctly performed and the accuracy of feedback goes up. Accordingly, the heating roller 11 can be heated by a heating structure that is safe and capable of raising the temperature in a short period of time with minimum overshoot.

Further, even if the system loses control and runaway occurs, and ON/OFF control of the power supply to the heating roller 11 becomes impossible, the power supply from the auxiliary power supply 25 to the heating unit 11*b* automatically declines. Accordingly, the risk of the heating roller 11 becoming too hot and recording paper igniting can be reduced. In this manner, the heating apparatus being capable of providing a fast temperature rise with safety at the time of a system runaway is realized.

Further, when the temperature of the heating roller 11 is high, the supply voltage to the heating roller 11 is lowered such that the power supply to the heating unit 11*b* is lessened. Accordingly, there is no problem from time delay in temperature detection by the temperature detection means 36, and exact feedback is attained. As a result, a temperature rise configuration that provides quick temperature rise, and is safe with minimized temperature overshoot of the heating roller 11, is realized.

Further, when the temperature of the heating roller 11 rises and reaches a high temperature, the supply voltage to the heating roller 11 is lowered such that the power supply to the heating unit 11*b* is reduced. Accordingly, even if there is time delay in the temperature detection by the temperature detection means 36, correct feedback is attained, and the temperature overshoot of the heating roller 11 is minimized, resulting in a configuration that provides fast and safe temperature rise.

Further, since maximum supply power exceeding the limit of the commercial power supply can be supplied to the heating apparatus, a heating apparatus with short starting time can be offered.

Further, since maximum supply power exceeding the limit of the commercial power supply can be supplied to the heating apparatus, an image forming apparatus with the heating apparatus having a short starting time can be offered.

Next, Embodiment 19 of the present invention is described. Embodiment 19 is the same as Embodiment 18, except that step-up means, instead of the step-up means 35*a*, is used. The step-up means here includes control means that changes the output voltage Vout by changing the step-up setup based on the information from the temperature detection means 36 for detecting the temperature of the heating roller 11 that is heated by the auxiliary heating unit 11*b*.

Figure 32:
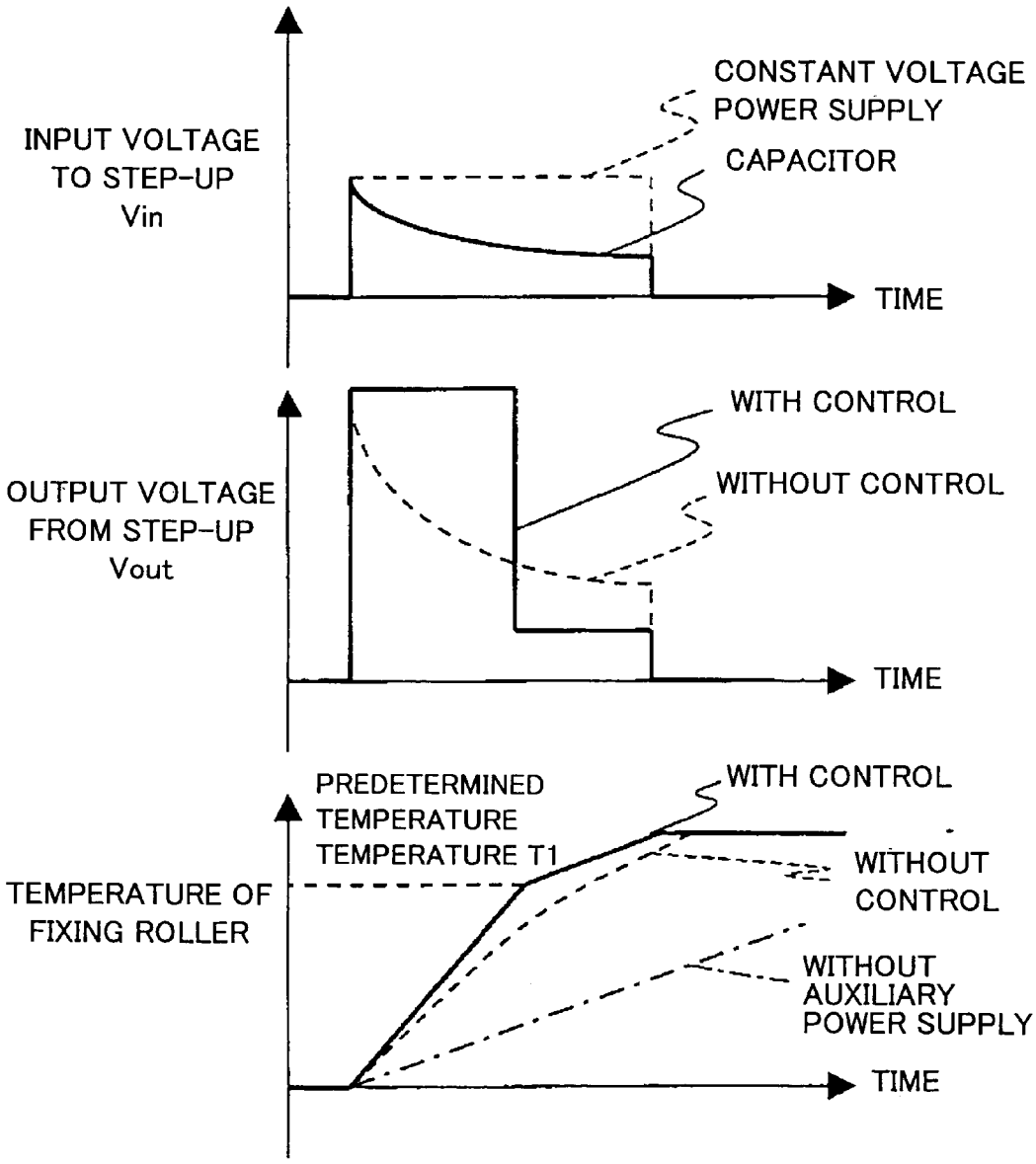
FIG. 32 is a set of graphs showing temporal changes of an input voltage Vin, an output voltage Vout, and the temperature of the heating roller concerning a step-up means according to Embodiment 19 of the present invention.

FIG. 32 shows temporal changes of the input voltage Vin that is input to the step-up means from the auxiliary power supply 25, the output voltage Vout that is output to the auxiliary heating unit 11*b* from the step-up means, and the temperature of the heating roller 11, according to Embodiment 19.

In order to shorten temperature rise time of the heating roller 11, what is necessary is to increase the power supplied to the heating unit 11*b*. The power supply apparatus that supplies power to the heating unit 11*b* may use the commercial power supply of 200 V, or a constant voltage power supply, such as a rechargeable battery. However, if the power supplied to the heating unit 11*b* is increased too much, the detection time delay of the temperature detection means 36 poses a problem in that the temperature of the heating roller 11 overshoots. According to Embodiment 19, wherein the capacitor of the auxiliary power supply 25 is used as the means for increasing the power supplied to the heating unit 11*b*, in order to prevent the temperature overshoot of the heating roller 11, the step-up means with the control means lowers the output voltage Vout, when the heating roller 11 reaches a predetermined temperature T1 based on the detection signal from the temperature detection means 36.

For this reason, the temperature overshoot of the heating roller 11 is reliably reduced at the time of temperature rise, regardless of the temperature of the heating roller 11 before the power is supplied. Embodiment 19 functions effectively, especially when the temperature of the heating roller 11 is high because the image forming apparatus is to be used shortly after the previous use.

According to Embodiment 19, the output voltage Vout of the step-up means is not gradually reduced but is switched low. For this reason, the circuit for reliably reducing the temperature overshoot of the heating roller 11 becomes simple.

Thus, according to Embodiment 19, when the temperature of the heating roller 11 rises and reaches a high temperature, the output voltage Vout of the step-up means is lowered, such that the power supplied to the heating unit 11*b* is lowered. There is no problem from time delay of temperature detection of the temperature detection means 36, and correct feedback is attained. In this manner, the heating configuration providing a fast temperature rise safely without the temperature overshoot of the heating roller 11 is realized.

Figure 34:
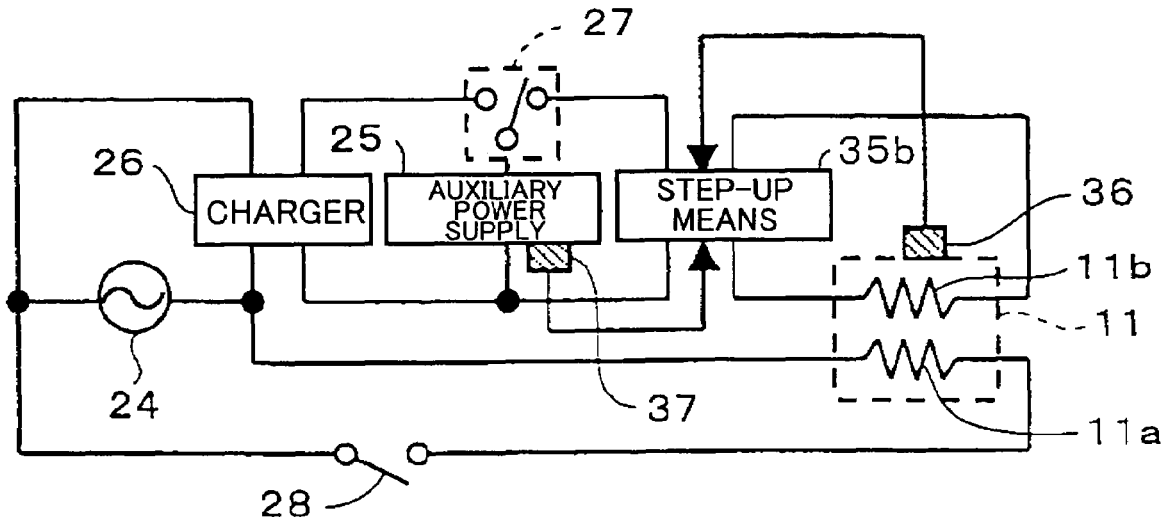
FIG. 34 is a schematic diagram showing the circuit configuration of the fixing apparatus according to Embodiment 20 of the present invention.

Next, Embodiment 20 of the present invention is explained. Embodiment 20 is the same as Embodiment 19, except that step-up means 35*b* is employed instead of the above-mentioned step-up means, as shown by FIG. 34. The input voltage Vin and the output voltage Vout of the step-up means 35*b* are almost the same as shown by FIG. 32. According to Embodiment 20, the step-up means 35*b* switches the output voltage Vout low, when the temperature of the heating roller 11 reaches the predetermined setting temperature T1, by changing the step-up setup based on the information from the temperature detection means 36 for detecting the temperature of the heating roller 11 that is heated by the auxiliary heating unit 11*b*. In addition, as shown by FIG. 34, Embodiment 20 includes control means and residual power detection means 37 for detecting residual energy of the auxiliary power supply 25, wherein the control means changes the step-up setup based on the information from the residual power detection means 37, and when the amount of residual energy of the auxiliary power supply 25 is greater than a predetermined value, the control means switches the output voltage Vout low.

Figure 33:
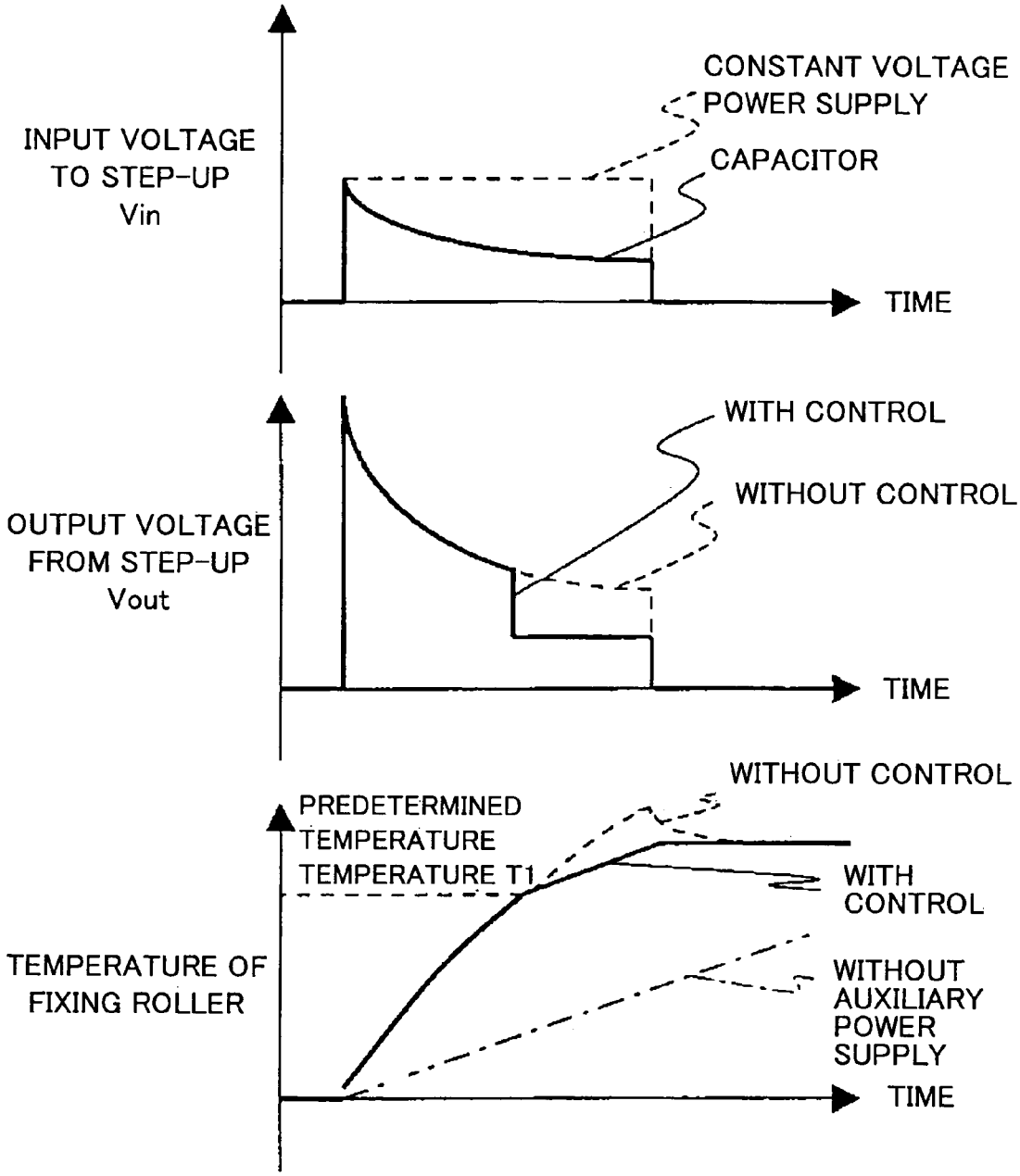
FIG. 33 is a set of graphs showing temporal changes of an input voltage Vin, an output voltage Vout, and the temperature of the heating roller concerning a step-up means according to Embodiment 20 of the present invention.

FIG. 33 shows temporal changes of the input voltage Vin that is input to the step-up means 35*b* from the auxiliary power supply 25, the output voltage Vout that is output to the auxiliary heating unit 11*b* from the step-up means 35*b*, and the temperature of the heating roller 11. If there is much residual energy in the auxiliary power supply 25 in the case that the temperature of the heating roller 11 is high, high power is continuously supplied to the auxiliary heating unit 11*b*, and the temperature of the heating roller 11 rises beyond the predetermined temperature, i.e., overshooting occurs. In order to avoid this, the step-up means 35*b* with the control means detects the amount of residual energy of the auxiliary power supply 25 using the information provided by the residual power detection means 37, when the temperature of the heating roller 11 reaches a predetermined temperature Y1 for changing the set-up. When the amount of the residual energy of the auxiliary power supply 25 is greater than the predetermined value, the output voltage Vout is switched low.

In this manner, the temperature overshoot of the heating roller 11 is reliably reduced at the time of temperature rise, regardless of the temperature of the heating roller 11 before the power is supplied, even when the amount of the residual energy of the auxiliary power supply 25 is large. Embodiment 20 functions effectively, especially when the temperature of the heating roller 11 is relatively high because the image forming apparatus is to be used shortly after the previous use. Further, since the step-up means 35*b* switches the output voltage Vout to low rather than gradually reducing the output voltage Vout, while the circuit is simplified, the temperature overshoot of the heating roller 11 is reliably reduced.

Thus, according to Embodiment 20, if the voltage of the auxiliary power supply 25 is high voltage, the voltage is lowered such that the power supplied to the auxiliary heating unit 11*b* is reduced. In this manner, there is no problem from time delay of the temperature detection of the temperature detection means 36, correct feedback is obtained, and the heating roller 11, the temperature of which can be raised safely and fast with minimum temperature overshoot, is realized.

In addition, the present invention is not limited to the embodiments described above, and the heating unit may be served by a fixing belt, and the like. Further, the present invention can apply to any heating apparatus, the main energy source of which is electricity, in addition to fixing apparatuses. For example, the present invention is applicable to heating apparatuses, such as an apparatus that heats a sheet-like heating target, such as transfer paper that holds an image, for modifying surface characteristics (gloss, etc.), an apparatus that carries out temporarily fixing toner on a sheet-like heating target, and apparatuses that carry out drying and lamination processes on a sheet-like target.

Availability on Industry

As mentioned above, according to the embodiments of the present invention, temperature change of a heating unit can be made small, and as much energy stored by a capacitor as possible can be used. Further, the temperature change can be made small and starting time can be shortened. Further, temperature rise can be made quickly and the temperature change can be made small. Further, high quality of an image can be achieved, and high quality and high speed can be reconciled. Further, the separation characteristics (demolding properties) of a toner image from a heating unit can be raised. Further, unevenness of an image can be eliminated and high output quality is made available.

Further, an electric shock can be prevented by lowering the output voltage of the auxiliary power supply, and safety is high. Further, electric discharge time of the auxiliary power supply can be shortened, and a safe fixing apparatus can be offered. Further, there is no useless electric discharge operation of the auxiliary power supply, there is little energy consumption, and a user-friendly apparatus can be offered. Further, electric discharge from the auxiliary power supply can be carried out without raising temperature of components of the apparatus. Further, an auxiliary power supply for heating a heating unit in a short period of time can be miniaturized.

Further, a heating apparatus capable of raising the temperature in a short period of time, and providing high safety at the time of a system runaway (running out of control) is realized. Further, an apparatus capable of raising the temperature of the heating unit in a short period of time, and providing a quick start can be offered. Further, the simplification of a circuit, and reduction of temperature overshoot of the heating component are realized. Further, a temperature raising configuration that is capable of safely heating the heating unit with a minimal temperature overshoot can be realized. Further, an apparatus without risk of an electric shock for maintenance workers can be realized. Further, a heating apparatus capable of raising the temperature in a short period of time provided with safety at the time of a system runaway can be realized.

What is claimed is:

1. A heating apparatus, comprising:

a heating unit that generates heat by power supplied;

at least an auxiliary power supply that can be charged as power supply means for supplying the power to said heating unit; and step-up means for stepping-up the output voltage of said auxiliary power supply.

2. The heating apparatus as claimed in claim 1, wherein said auxiliary power supply comprises an electric double layer capacitor.

3. The heating apparatus as claimed in claim 1, wherein the output voltage of said step-up means falls as the input voltage to said step-up means falls.

4. The heating apparatus as claimed in claim 1, further comprising:

control means for controlling the output voltage of said step-up means.

5. The heating apparatus as claimed in claim 4, wherein said control means controls such that the output voltage of said step-up means stays constant along a the time axis.

6. The heating apparatus as claimed in claim 1, wherein said heating unit comprises:

a main heating unit that generates heat by power supplied from a main power supply that is capable of providing steady power; and an auxiliary heating unit that generates heat by power supplied from said auxiliary power supply through said step-up means; wherein the power supplied to said auxiliary heating unit through said step-up means from said auxiliary power supply is greater than the power supplied to said main heating unit from said main power supply.

7. A heating apparatus, comprising:

a main power supply that is capable of supplying steady power;

a main heating unit that generates heat by the power supplied from the main power supply;

an auxiliary power supply that can be charged;

step-up means to step-up the output voltage of said auxiliary power supply;

an auxiliary heating unit that generates heat by the power supplied from said step-up means;

a heating component heated by said main heating unit and said auxiliary heating unit; and detection means for detecting a situation about said auxiliary power supply, and controlling the output voltage of said step-up means based on a determination by said detection means.

8. The heating apparatus as claimed in claim 7, wherein said auxiliary power supply comprises an electric double layer capacitor.

9. The heating apparatus as claimed in claim 7, wherein said detection means comprises temperature detection means for detecting the temperature of said heating component.

10. The heating apparatus as claimed in claim 9, wherein said output voltage of said step-up means is gradually lowered, when the temperature detected by said temperature detection means is higher than a predetermined temperature.

11. The heating apparatus as claimed in claim 9, wherein said output voltage of said step-up means is switched to a lower voltage in a step-like manner, when the temperature detected by said temperature detection means is higher than a predetermined temperature.

12. The heating apparatus as claimed in claim 9, further comprising:

residual power amount detection means for determining the amount of residual energy of said auxiliary power supply, and changing said output voltage of said step-up means according to the detection result of said residual power amount detection means.

13. The heating apparatus as claimed in claim 12, wherein said output voltage of said step-up means is lowered when the amount of residual energy of said auxiliary power supply, said amount being determined by said residual power amount detection means, is higher than a predetermined value.

14. A heating apparatus, comprising:

a first heating unit to which power is supplied from a commercial power source;

an auxiliary power supply for accumulating the power from the commercial power source;

a second heating unit to which the power is supplied from the auxiliary power supply, and step-up means for stepping up the power from the auxiliary power supply and supplying stepped-up power to the second heating unit.

15. A heating apparatus, comprising:

a first heating unit to which power is supplied from a commercial power source;

an auxiliary power supply for accumulating the power from the commercial power source;

a second heating unit to which the power is supplied from the auxiliary power supply, and step-up means for stepping-up the power from the auxiliary power supply and supplying stepped-up power to the second heating unit, wherein a magnification of a step-up of the step-up means is constant.

16. A heating apparatus, comprising:

a first heating unit to which power is supplied from a commercial power source;

an auxiliary power supply for accumulating the power from the commercial power source, a second heating unit to which the power is supplied from the auxiliary power supply, and p1 step-up means for stepping up the power from the auxiliary power supply and supplying stepped-up power to the second heating unit, wherein an output voltage of the step-up is constant.

17. A heating apparatus, comprising:

a first heating unit to which power is supplied from a commercial power source;

an auxiliary power supply for accumulating the power from the commercial power source;

a second heating unit to which the power is supplied from the auxiliary power supply;

step-up means for stepping-up the power from the auxiliary power supply and supplying stepped-up power to the second heating unit; and control means for lowering an input voltage of the step-up means to be a predetermined value while raising a magnification of a step-up of the step-up means.

18. A heating apparatus, comprising:

a first heating unit to which power is supplied from a commercial power source;

an auxiliary power supply for accumulating the power from the commercial power source;

a second heating unit to which the power is supplied from the auxiliary power supply;

temperature detection means for detecting a temperature of the heating apparatus; and step-up means for stepping-up an input voltage from the auxiliary power supply to be a given voltage at a predetermined timing based on a detection result of the temperature detection means and for supplying a stepped-up voltage to the second heating unit.

19. A heating apparatus, comprising:

a first heating unit to which power is supplied from a commercial power source;

an auxiliary power supply for accumulating the power from the commercial power source;

a second heating unit to which the power is supplied from the auxiliary power supply, temperature detection means for detecting a temperature of the heating apparatus;

step-up means for stepping-up a voltage from the auxiliary power supply and for supplying a stepped-up voltage to the second heating unit; and control means for changing a step-up setting based on a detection result of the temperature detection means and for changing an output voltage of the step-up means.

20. A heating apparatus, comprising:

a first heating unit to which power is supplied from a commercial power source;

an auxiliary power supply for accumulating the power from the commercial power source;

a second heating unit to which the power is supplied from the auxiliary power supply, temperature detection means for detecting a temperature of the heating apparatus;

residual power detection means for detecting residual power of the auxiliary power supply;

step-up means for stepping-up a voltage from the auxiliary power supply and for supplying a stepped-up voltage to the second heating unit; and control means for controlling an output voltage of the step-up means based on both detection results of the temperature detection means and the residual power detection means.

21. The heating apparatus as claimed in claim 14, wherein the auxiliary power supply is an electric double layer capacitor.

22. The heating apparatus as claimed in claim 16, wherein the auxiliary power supply is an electric double layer capacitor.

23. The heating apparatus as claimed in claim 18, wherein the auxiliary power supply is an electric double layer capacitor.

24. The heating apparatus as claimed in claim 19, wherein the auxiliary power supply is an electric double layer capacitor.

25. The heating apparatus as claimed in claim 20, wherein the auxiliary power supply is an electric double layer capacitor.

26. The heating apparatus as claimed in claim 14, wherein the step-up means includes an IGBT element.

27. The heating apparatus as claimed in claim 16, wherein the step-up means includes an IGBT element.

28. The heating apparatus as claimed in claim 18, wherein the step-up means includes an IGBT element.

29. The heating apparatus as claimed in claim 19, wherein the step-up means includes an IGBT element.

30. The heating apparatus as claimed in claim 20, wherein the step-up means includes an IGBT element.

* * * * *